US005330866A

United States Patent [19]

Ueda

[11] Patent Number: 5,330,866

[45] Date of Patent: Jul. 19, 1994

[54] PHOTOSENSITIVE MEMBER COMPRISING AN AMINO COMPOUND

[75] Inventor: Hideaki Ueda, Kawanishi, Japan

[73] Assignee: Minolta Camera Kabushiki Kaisha, Osaka, Japan

[21] Appl. No.: 835,574

[22] Filed: Feb. 14, 1992

[30] Foreign Application Priority Data

| | | | |
|---|---|---|---|
| Feb. 18, 1991 | [JP] | Japan | 3-023174 |
| Aug. 15, 1991 | [JP] | Japan | 3-205201 |
| Oct. 17, 1991 | [JP] | Japan | 3-269283 |
| Oct. 18, 1991 | [JP] | Japan | 3-270847 |

[51] Int. Cl.[5] ..... G03G 5/06

[52] U.S. Cl. ..... 430/59; 430/56; 430/73; 430/74; 430/75; 430/96

[58] Field of Search ..... 430/59, 73, 74, 75, 430/72, 56

[56] References Cited

U.S. PATENT DOCUMENTS

| | | | |
|---|---|---|---|
| 4,273,846 | 6/1981 | Pai et al. | 430/59 |
| 4,297,425 | 10/1981 | Pai et al. | 430/58 |
| 4,301,226 | 11/1981 | Contois et al. | 430/72 |
| 4,304,829 | 12/1981 | Limburg et al. | 430/59 |
| 4,835,081 | 5/1989 | Ong et al. | 430/59 |
| 4,869,988 | 9/1989 | Ong et al. | 430/59 |
| 4,877,702 | 10/1989 | Miyamoto et al. | 430/72 |
| 4,920,022 | 4/1990 | Sakakibara et al. | 430/59 |
| 5,059,503 | 10/1991 | Muto et al. | 430/83 |
| 5,149,609 | 9/1992 | Yu et al. | 430/58 |

FOREIGN PATENT DOCUMENTS 2-190864 7/1990 Japan .

*Primary Examiner*—Marion E. McCamish
*Assistant Examiner*—Rosemary Ashton
*Attorney, Agent, or Firm*—Burns, Doane, Swecker & Mathis

[57] ABSTRACT

The present invention provides a new amino compound represented by the following general formula [I] excellent in charge transporting properties.

[I]

The present invention provides a photosensitve member and an electroluminescence device both of which comprise the amino compound of the general formula [I] as a charge transporting material.

28 Claims, 6 Drawing Sheets

PHOTOSENSITIVE MEMBER COMPRISING AN AMINO COMPOUND

The present invention relates to a new compound with a amino structure. The amino compound is used as a photosensitive material. In particular, the amino compound is apllied to a photosensitive member or an electroluminescence device as a charge transporting substance.

Many organic compounds such as anthracenes, anthraquinone, imidazole, carbazole, hydrazones, and styryl derivatives, which can be used as a photosensitive material or a charge transporting material, have been known. Japanese patent laid open No. Hei 1-142646 discloses a compound represented by the following general formula below;

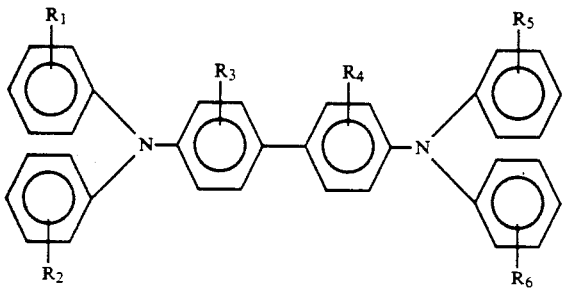

in which $R_1$ to $R_6$ are the ones disclosed in the above described reference. Japanese patent laid open No. Sho 58-58551 discloses a compound represented by the following general formula below;

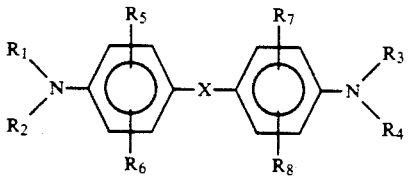

in which $R_1$ to $R_8$ are the ones disclosed in the above described reference.

However, when the materials described above are applied, for example, to a photosensitive member, not durability and weathering resistance are required basically as well as good photosensitivity, good charge transportability and compatibility with other members. The fact is that there are few materials meeting such characteristics as above mentioned.

SUMMARY OF THE INVENTION

The object of the present invention is to provide a new amino compound.

Another object of the present invention is to provide a photosensitive member containing the new amino compound.

Another object of the present invention is to provide an electroluminescence device.

The present invention relates to an amino compound represented by the following general formula [I]:

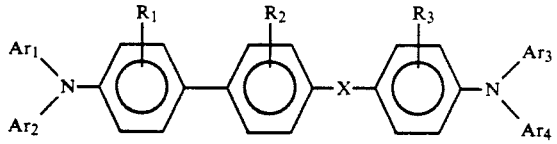

[I]

in which $Ar_1$, $Ar_2$, $Ar_3$, $Ar_4$ represent respectively an alkyl group, an aralkyl group, an aryl group, a biphenyl group or a heterocyclic group, each of which may have a substituent; $Ar_1$ and $Ar_2$, and/or $Ar_3$ and $Ar_4$ may form a ring in combination; $R_1$, $R_2$ and $R_3$represent respectively a hydrogen atom, an alkyl group, an alkoxy group or a halogen atom; X represent —O—, —S— , —N($R_4$)— or —($R_5$)C($R_6$)— (in which $R_4$ represents an alkyl group, an aralkyl group, an aryl group, a biphenyl group or a heterocyclic group, each of which may have a substituent; $R_5$ and R6 represent respectively a hydrogen atom, an alkyl group or an aryl group).

The amino compound is applied to a photosensitive member or an electroluminescence device.

DETAILED DESCRIPTION OF THE INVENTION

Figure 1:
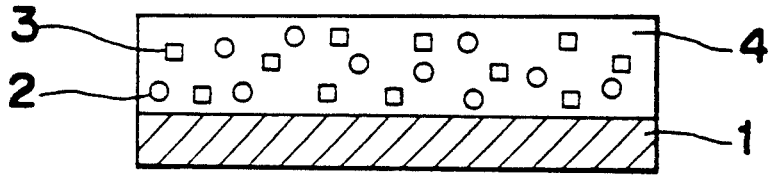
FIG. 1 is a schematic sectional view of a dispersion-type photosensitive member having a photosensitive layer on an electrically substrate.

The present invention relates to an amino compound represented by the following general formula [I]:

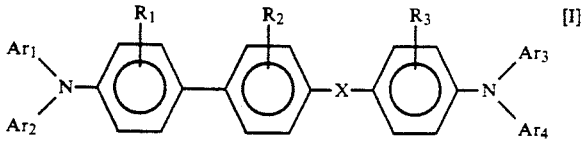

[I]

in which $Ar_1$, $Ar_2$, $At_3$, $Ar_4$ represent respectively an alkyl group such as methyl and ethyl, an aralkyl group such as benzyl and phenethyl, an aryl group such as phenyl, naphthyl, tolyl and biphenyl or a heterocyclic group such as a residue of thiophene, furan, pyridine, thiazole or dithiophene. $Ar_1$, $Ar_2$, $Ar_3$ and $Ar_4$ may have a substituent exemplified by an alkyl group such as methyl, an alkoxy group such as methoxy, a halogen atom such as chlorine atom and bromine atom, an hydroxyl group and a phenoxy group. A biphenyl group having an alkyl group is preferable. More preferably, $Ar_1$ and $Ar_3$are respectively a biphenyl group, because sensitivity is improved effectively.

$Ar_1$ and $Ar_2$, and/or $Ar_3$ and $Ar_4$ may form a ring in combination as represented by the following formula below:

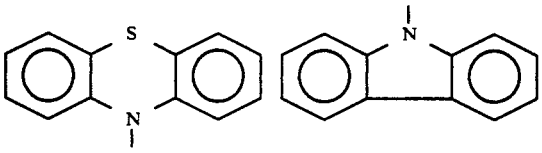

-continued

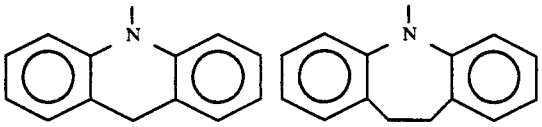

$R_1$, $R_2$ and $R_3$ represent respectively a hydrogen atom, an alkyl group such as methyl and ethyl, an alkoxy group such as methoxy and ethoxy or a halogen atom such as chlorine atom and bromine atom.

X represent —O—, —S—, —N($R_4$)— or —($R_5$)C($R_6$)—.

$R_4$ represents an alkyl group such as methyl, ethyl, propyl and buthyl, an aralkyl group such as benzyl and phenethyl, an aryl group such as phenyl, tolyl and xylyl, a biphenyl group or a heterocyclic group such as thienyl, thienylmethyl and a residue of dioxaindane. $R_4$ may have a substituent exemplified by an alkyl group such as methyl and ethyl, an alkoxy group such as methoxy and ethoxy, a phenoxy group and a halogen atom such as chlorine atom and bromine atom. Preferable $R_4$ is a phenyl group and a biphenyl group.

$R_5$ and $R_6$ represent respectively a hydrogen atom, an alkyl group such as methyl, ethyl and propyl or an aryl group such as phenyl and tolyl.

Concrete compounds having the amino structure represented by the general formula [I] are exemplified as shown below:

[I-1]

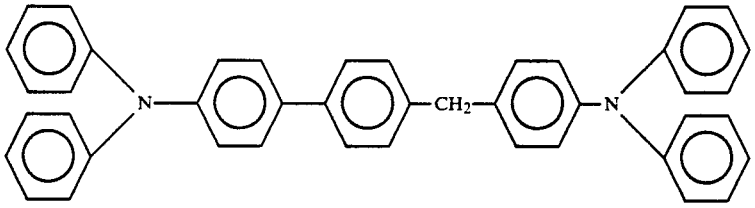

[I-2]

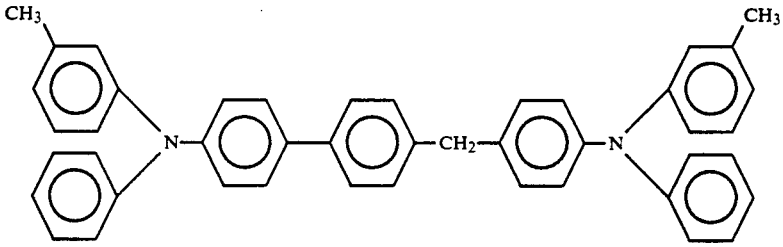

[I-3]

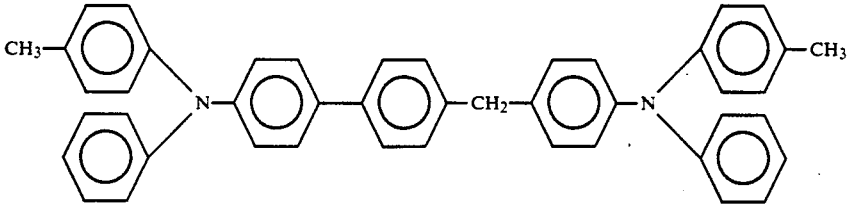

-continued
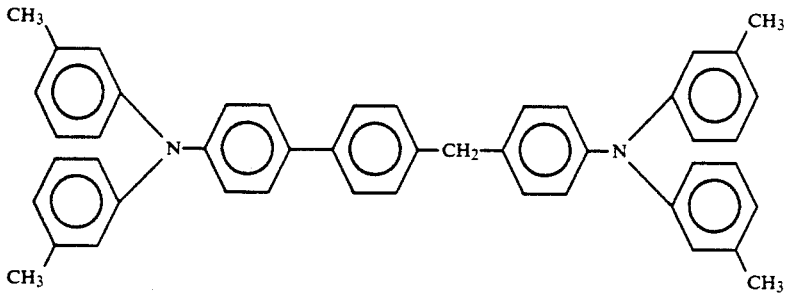
[I-4]
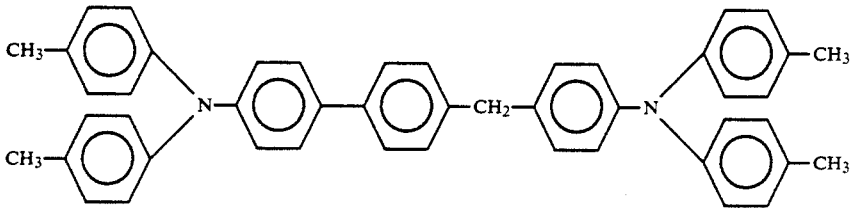
[I-5]
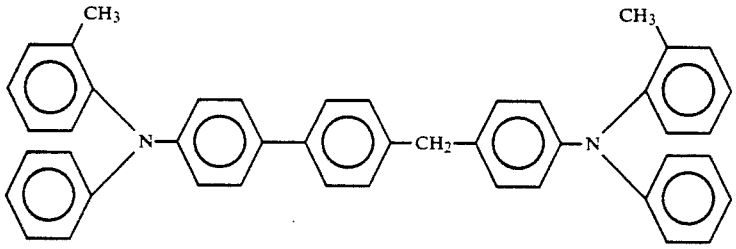
[I-6]
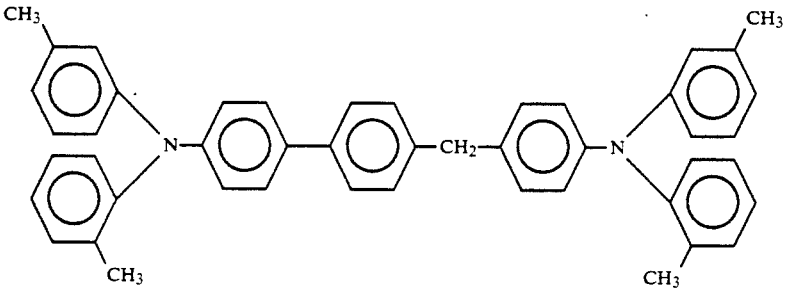
[I-7]
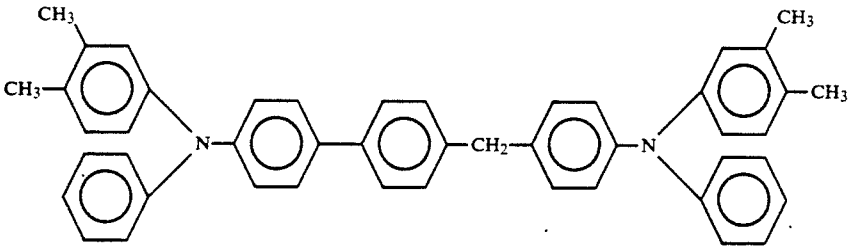
[I-8]
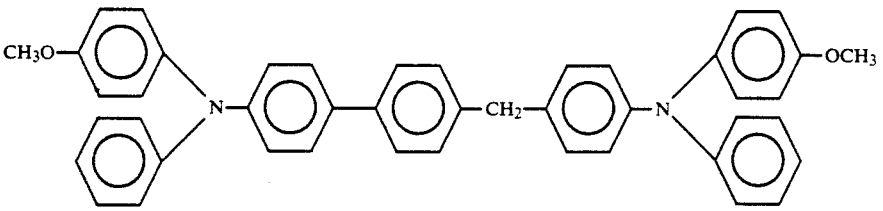
[I-9]

-continued
[I-10]
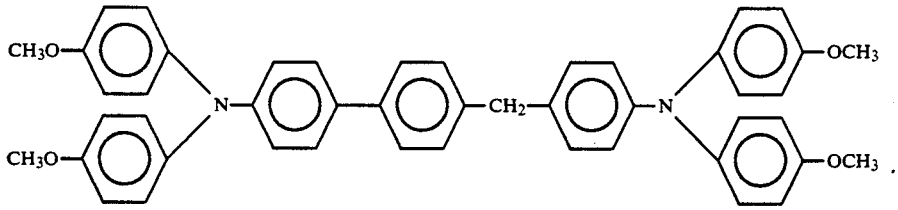
[I-11]
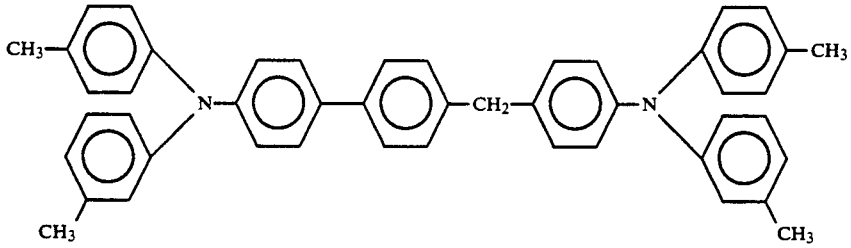
[I-12]
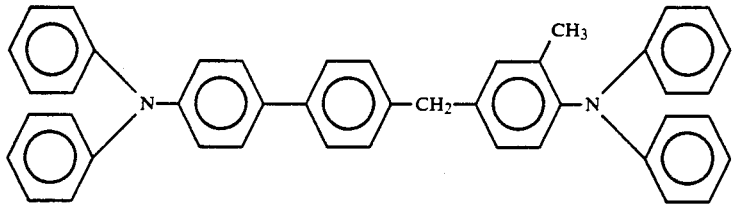
[I-13]
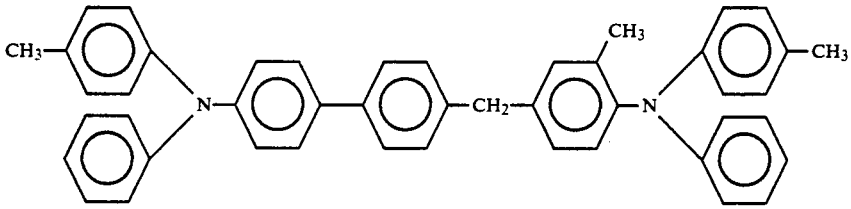
[I-14]
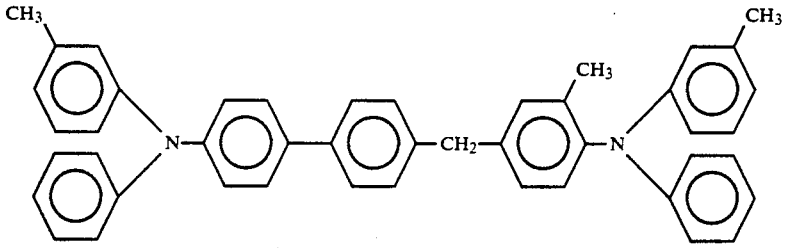
[I-15]
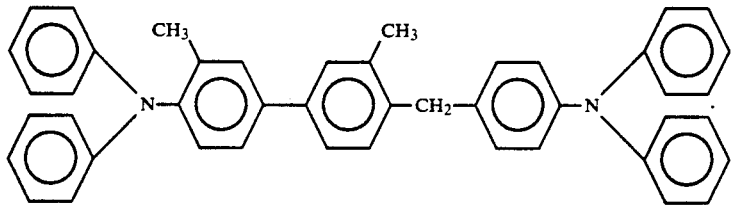
[I-16]
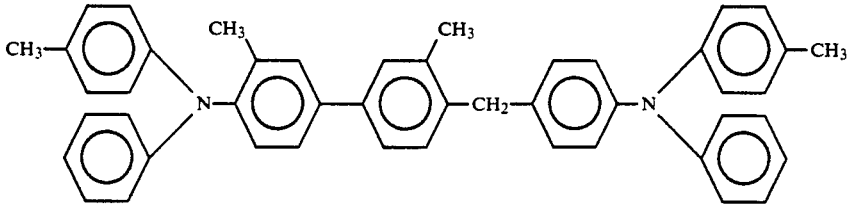

-continued
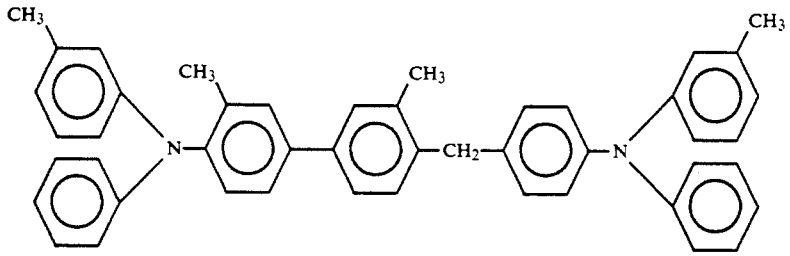
[I-17]
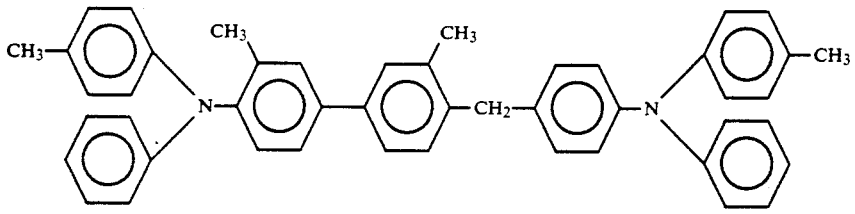
[I-18]
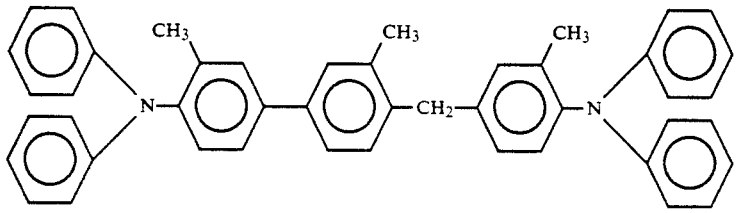
[I-19]
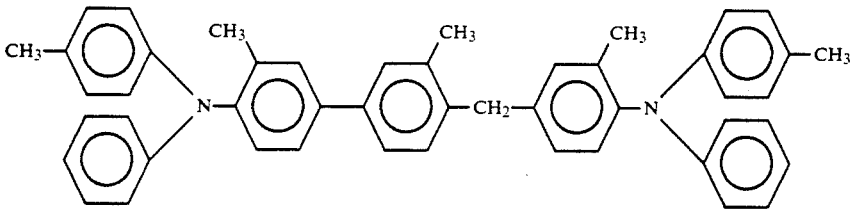
[I-20]
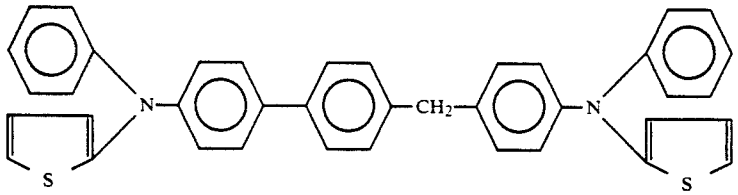
[I-21]
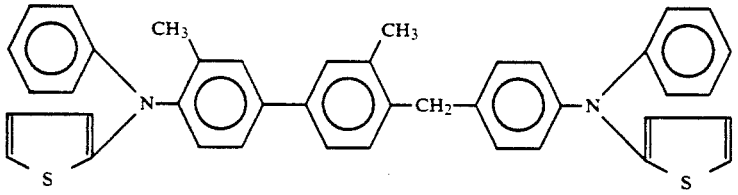
[I-22]
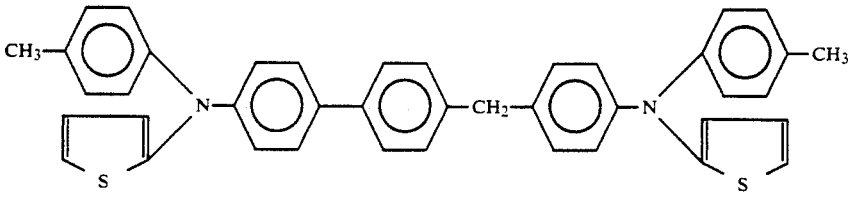
[I-23]

-continued
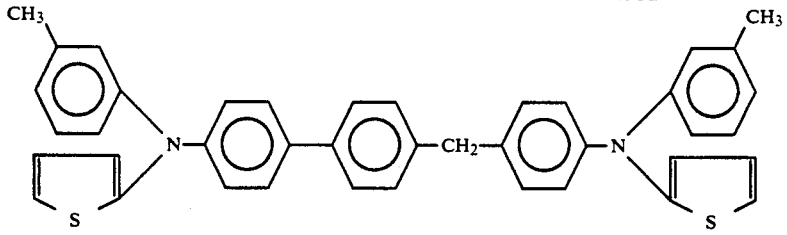
[I-24]
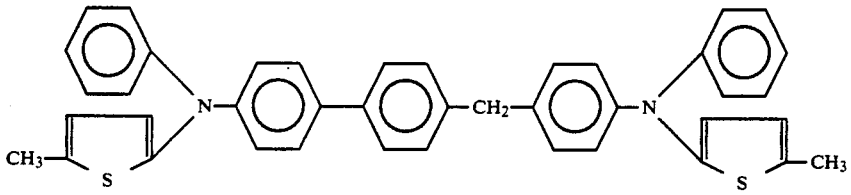
[I-25]
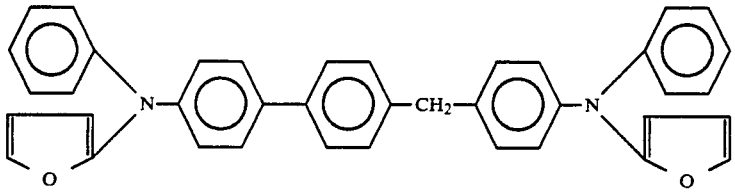
[I-26]
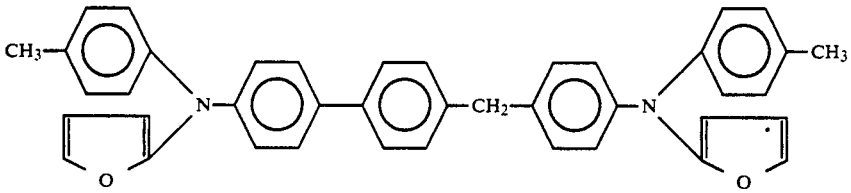
[I-27]
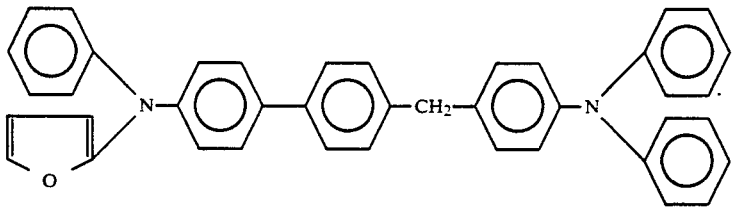
[I-28]
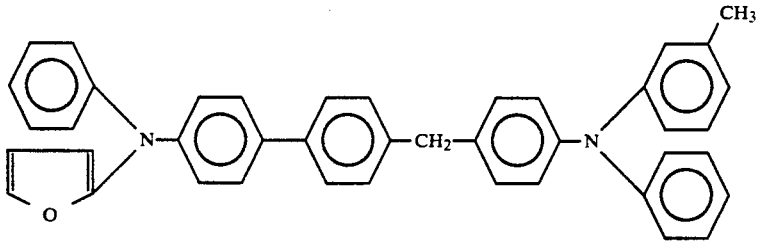
[I-29]
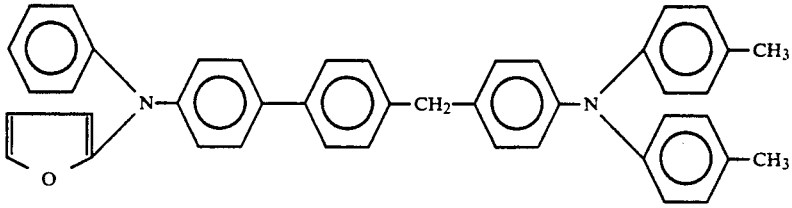
[I-30]

-continued
[I-31]
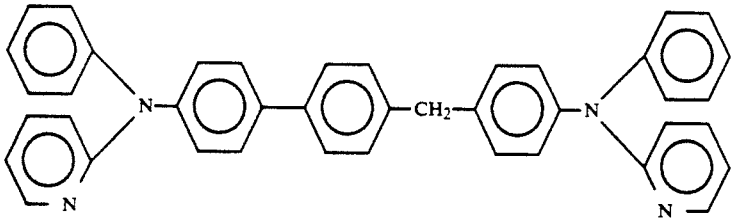
[I-32]
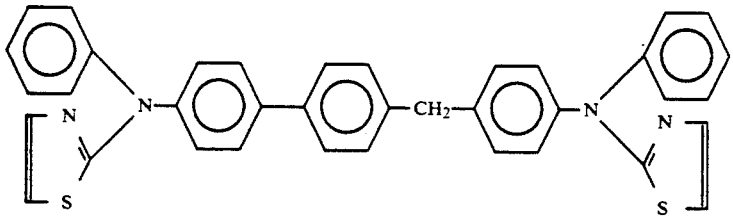
[I-33]
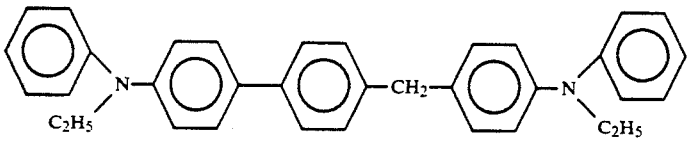
[I-34]
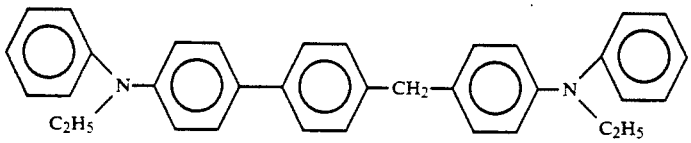
[I-35]
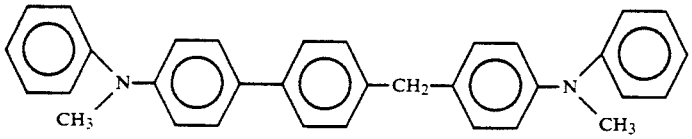
[I-36]
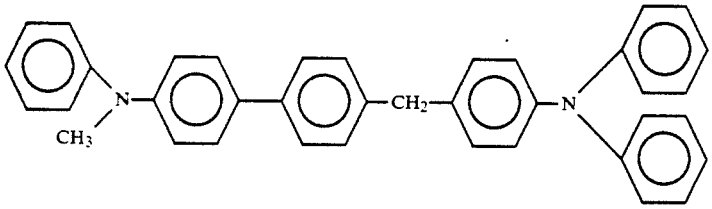
[I-37]
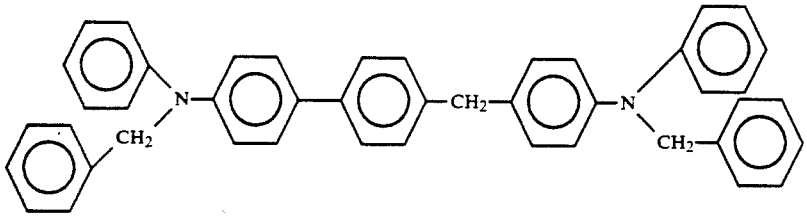
[I-38]
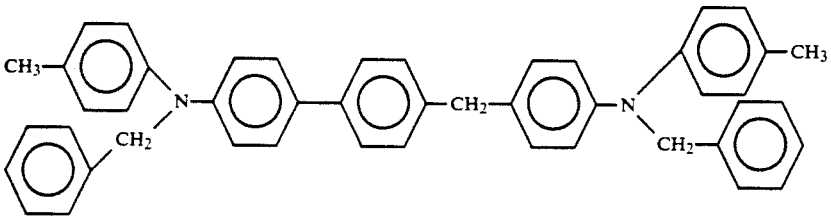

-continued
[I-39]
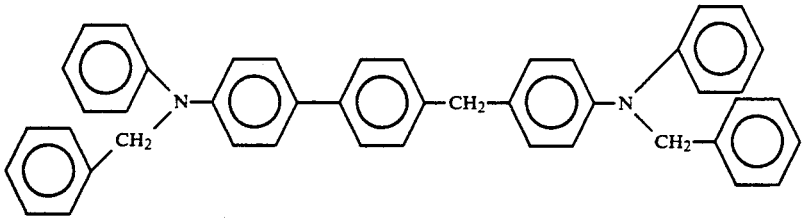
[I-40]
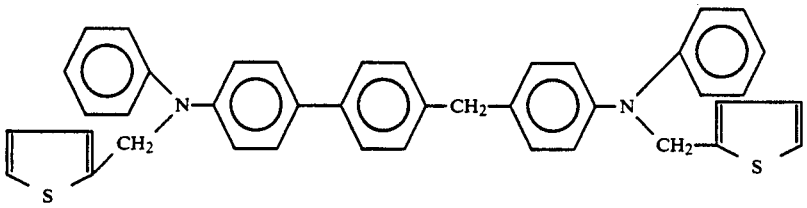
[I-41]
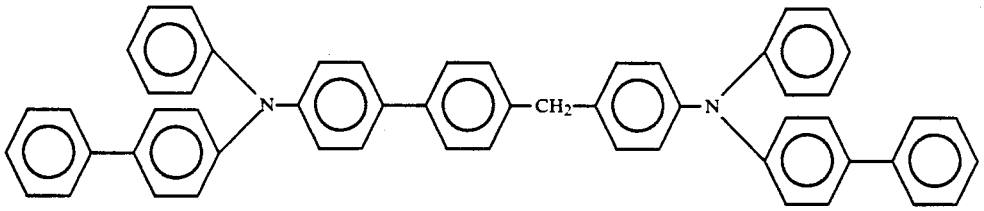
[I-42]
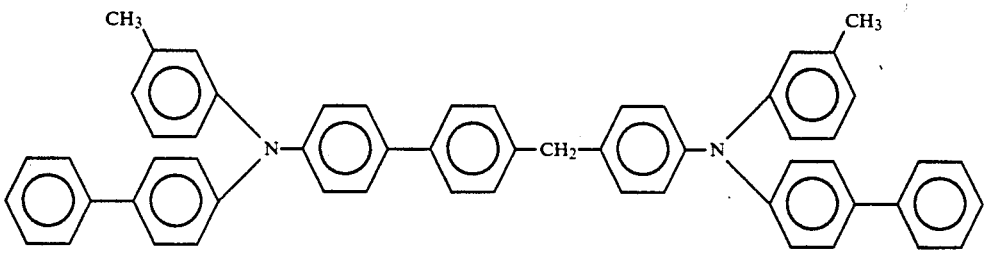
[I-43]
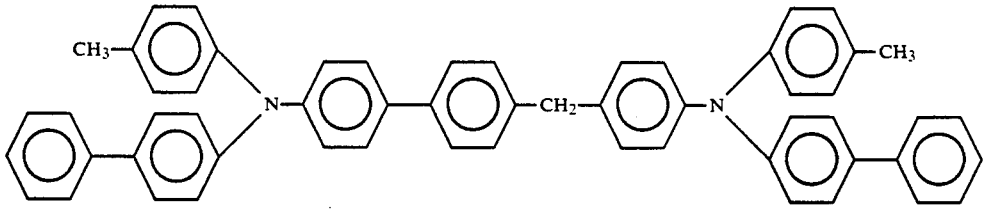
[I-44]
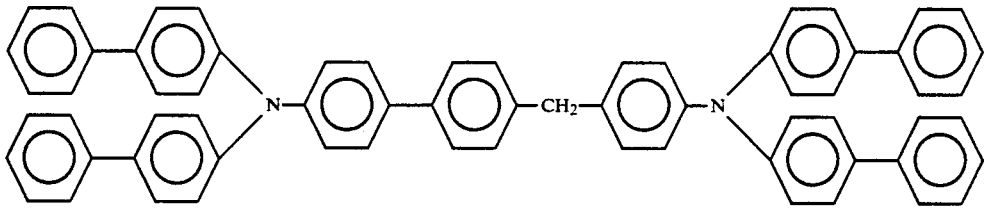
[I-45]
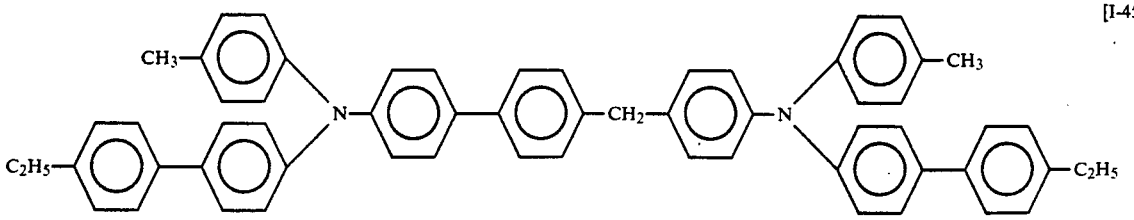

-continued
[I-46]
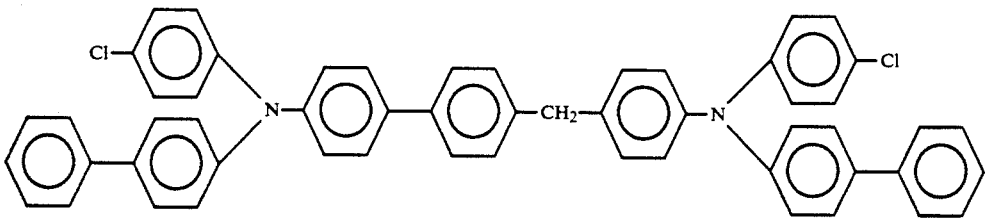
[I-47]
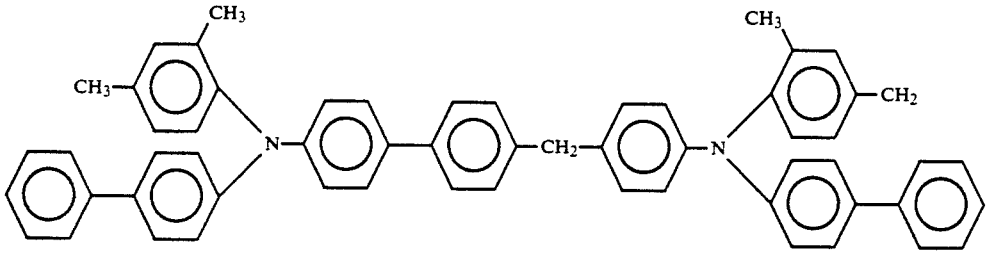
[I-48]
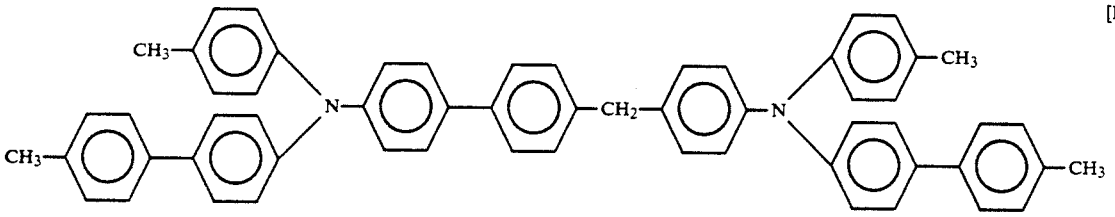
[I-49]
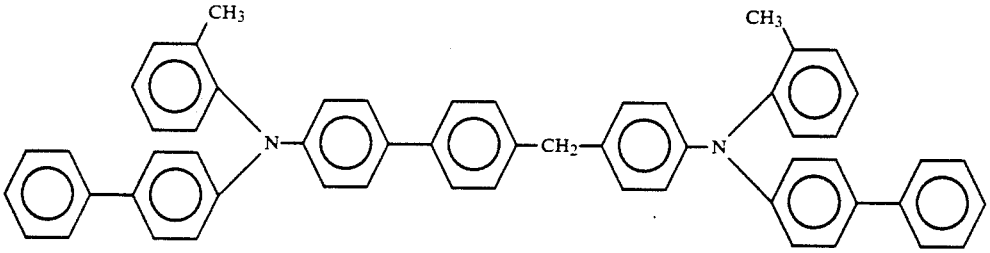
[I-50]
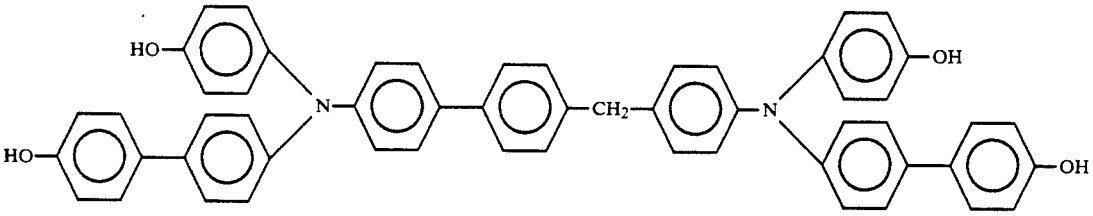
[I-51]
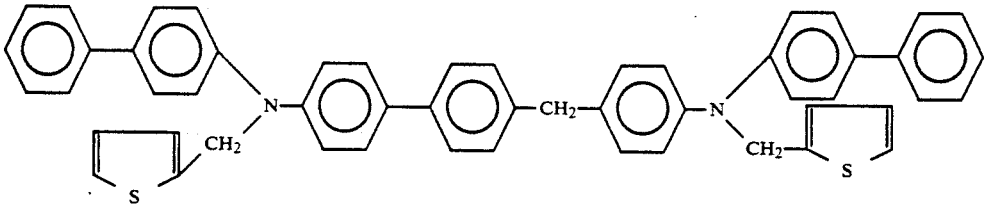
[I-52]
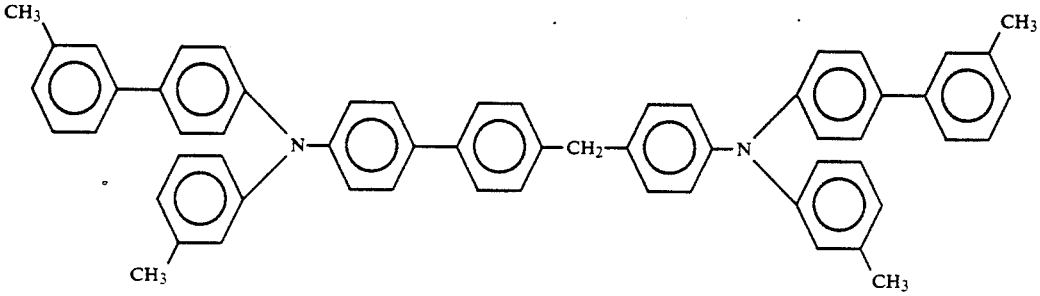

-continued
[I-53]
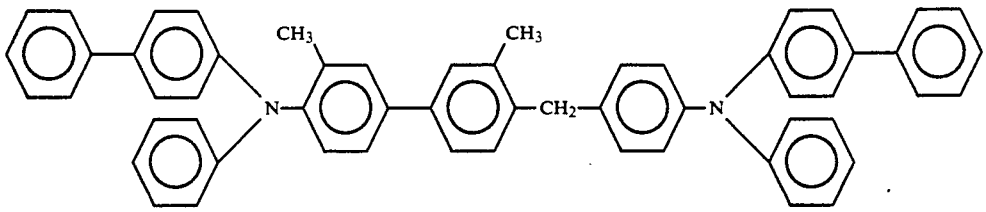
[I-54]
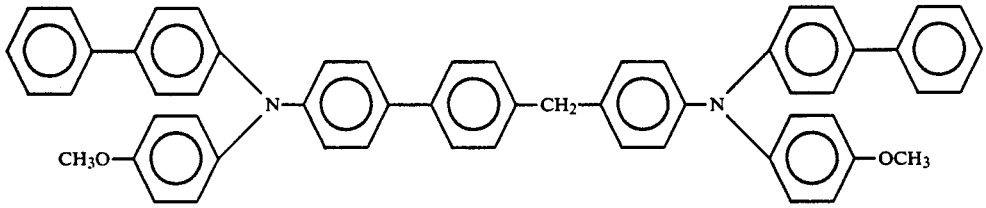
[I-55]
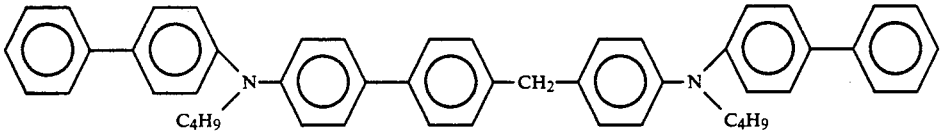
[I-56]
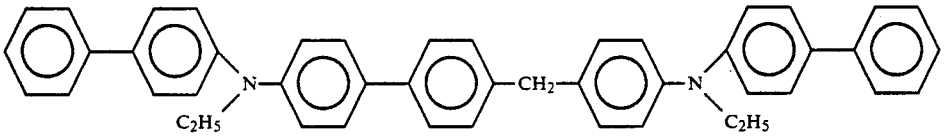
[I-57]
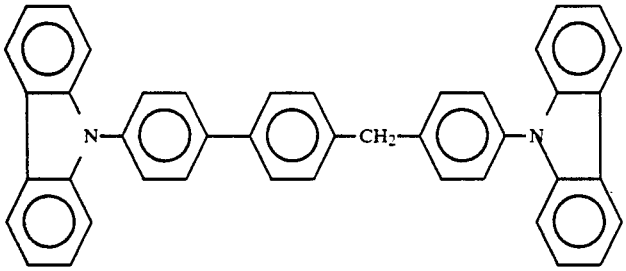
[I-58]
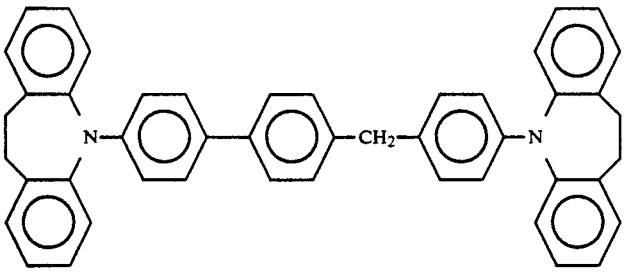
[I-59]
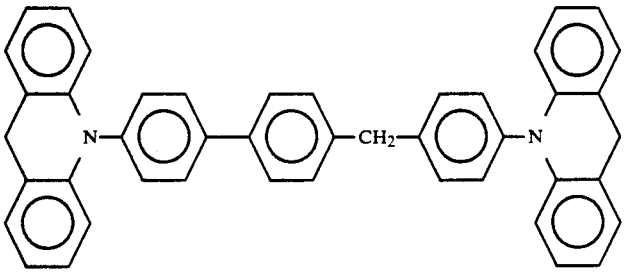

-continued
[I-60]
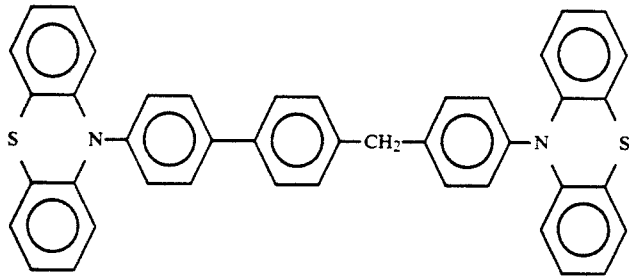
[I-61]
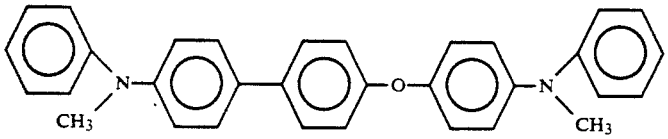
[I-62]
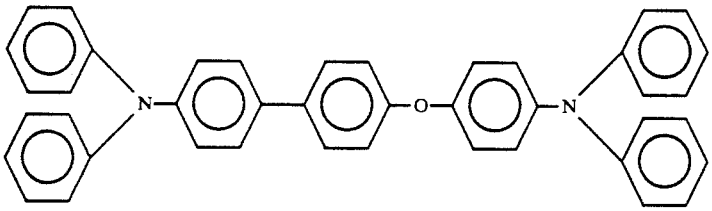
[I-63]
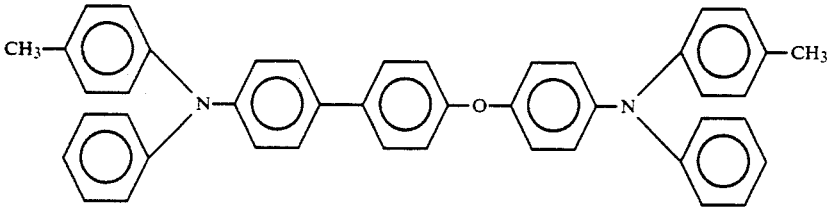
[I-64]
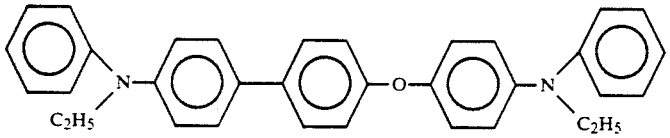
[I-65]
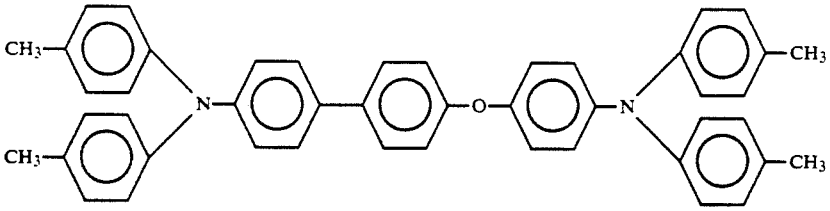
[I-66]
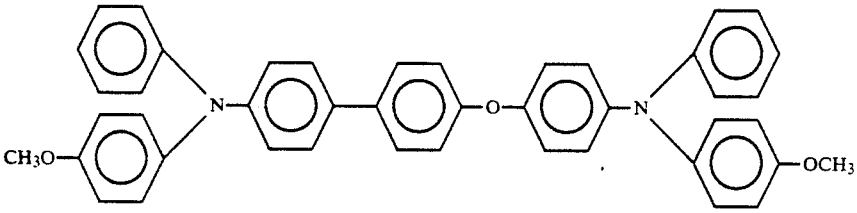

-continued
[I-67]
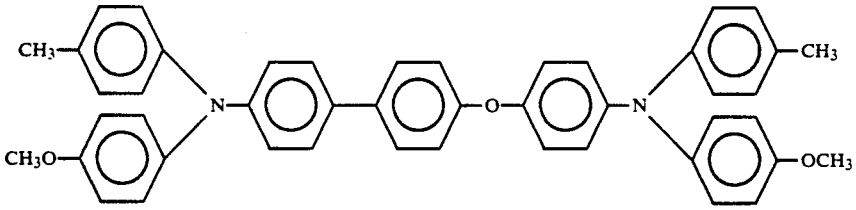
[I-68]
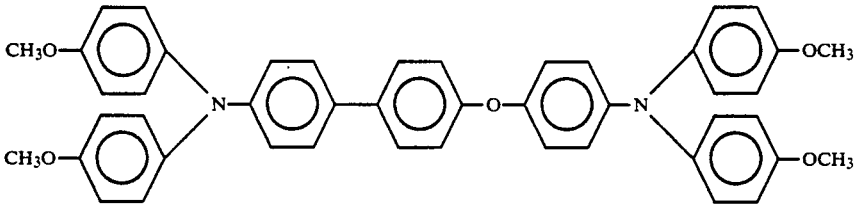
[I-69]
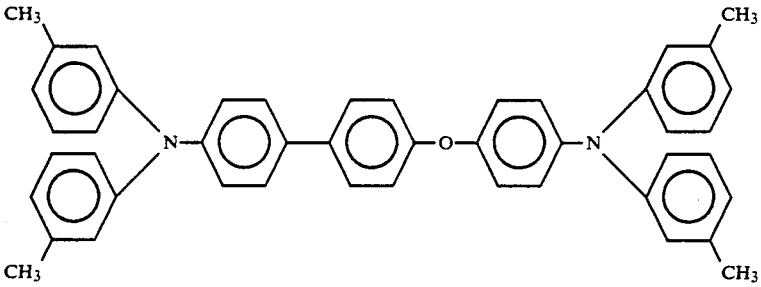
[I-70]
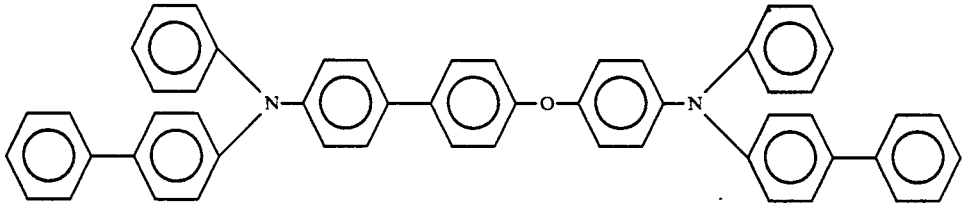
[I-71]
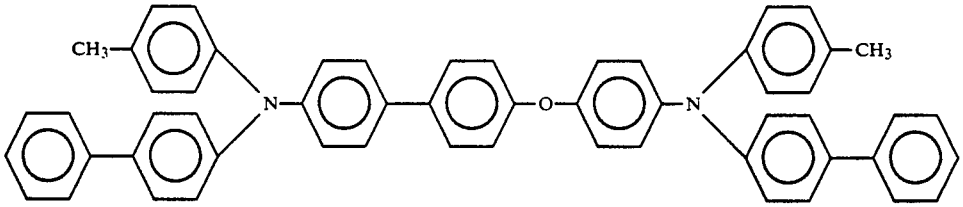
[I-72]
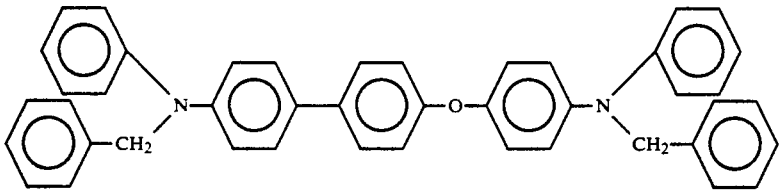
[I-73]
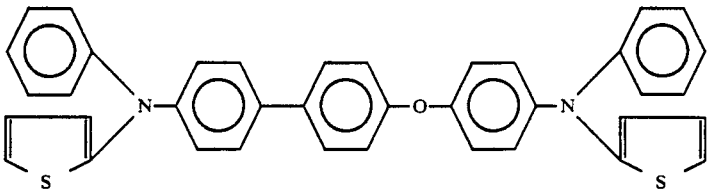

-continued
[I-74]
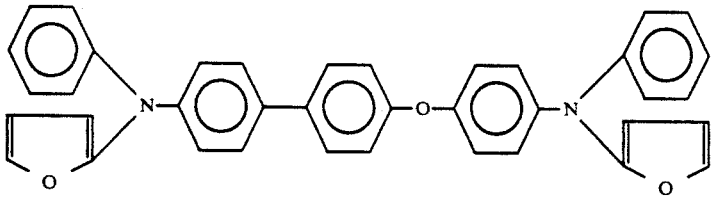
[I-75]
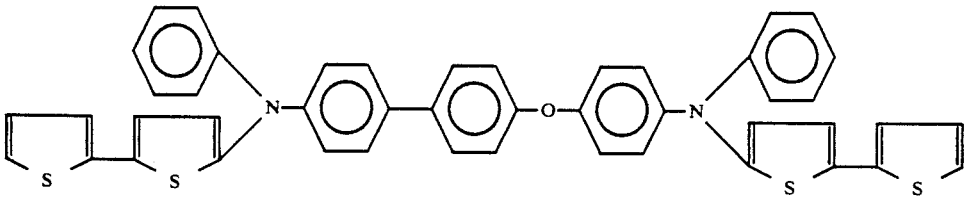
[I-76]
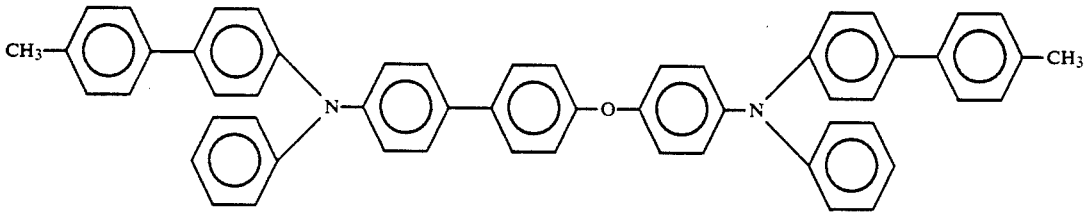
[I-77]
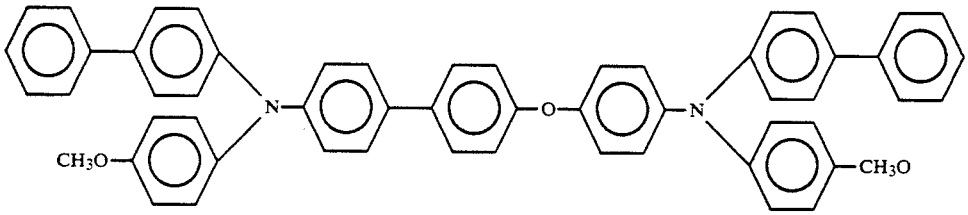
[I-78]
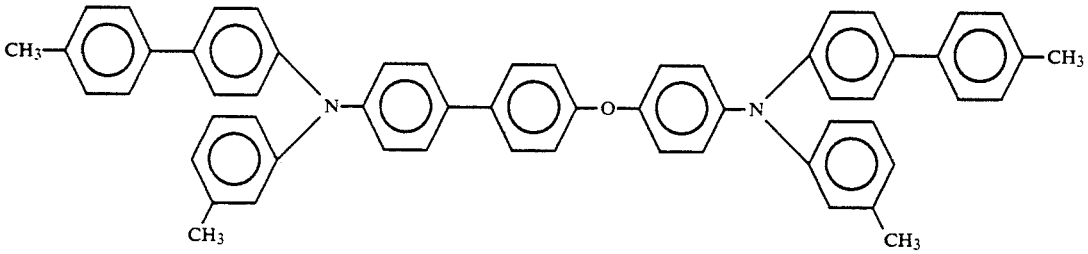
[I-79]
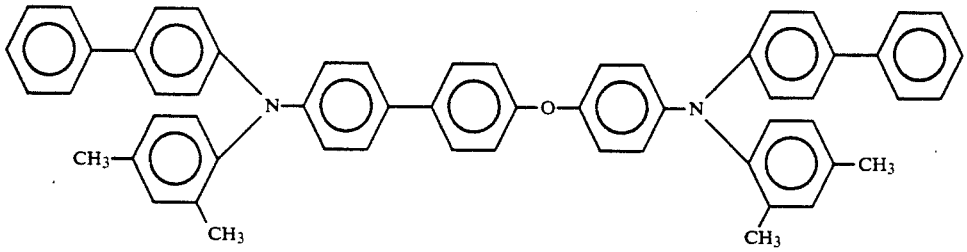
[I-80]
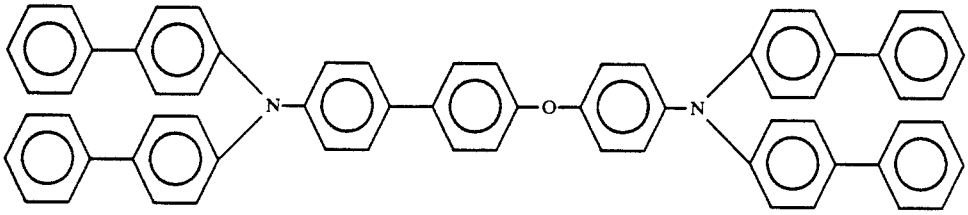

-continued
[I-81]
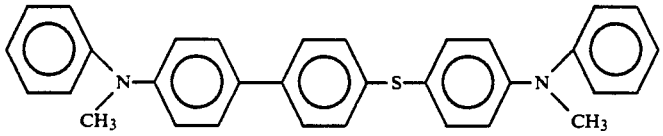
[I-82]
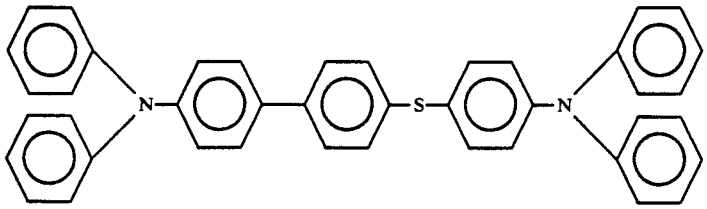
[I-83]
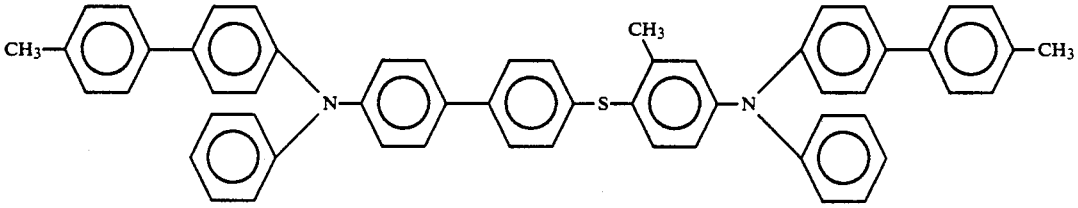
[I-84]
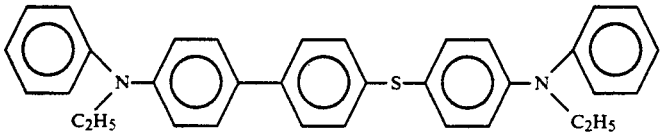
[I-85]
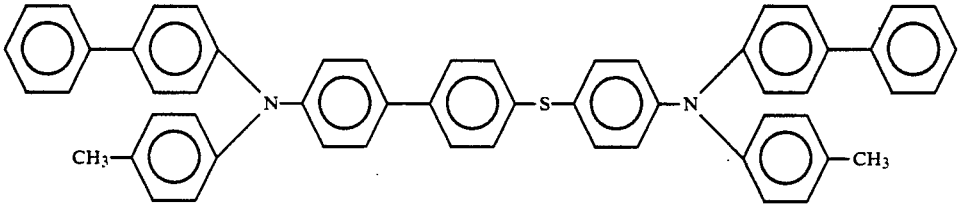
[I-86]
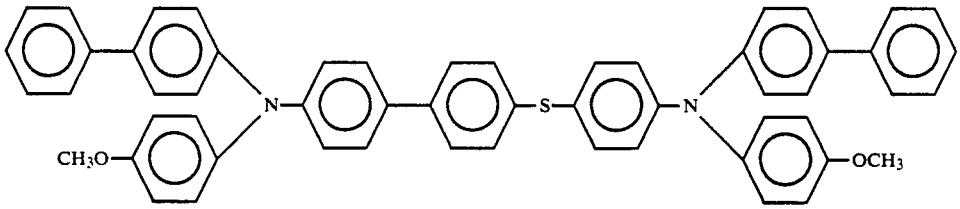
[I-87]
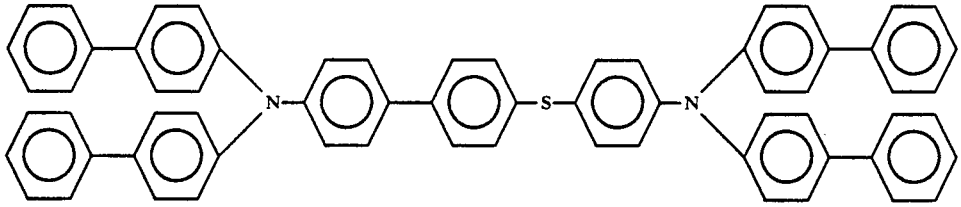
[I-88]
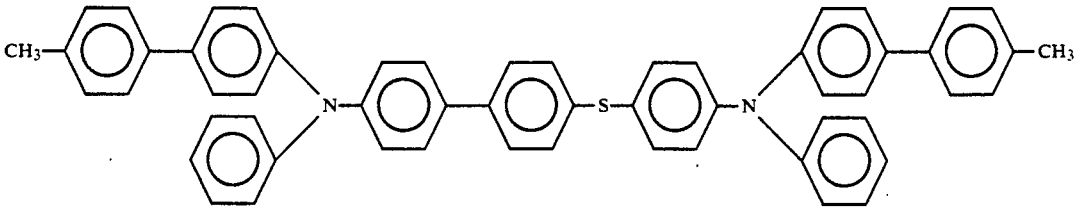

-continued
[I-89]
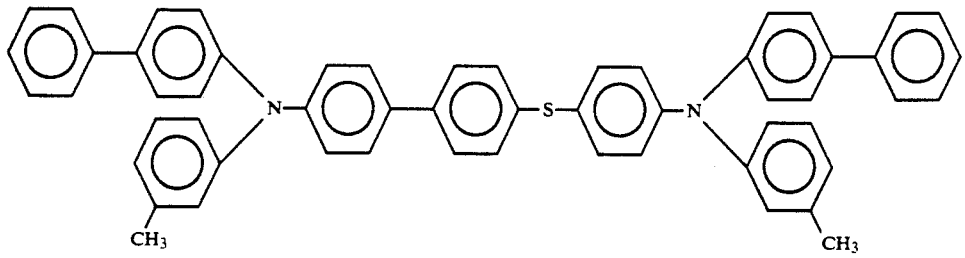
[I-90]
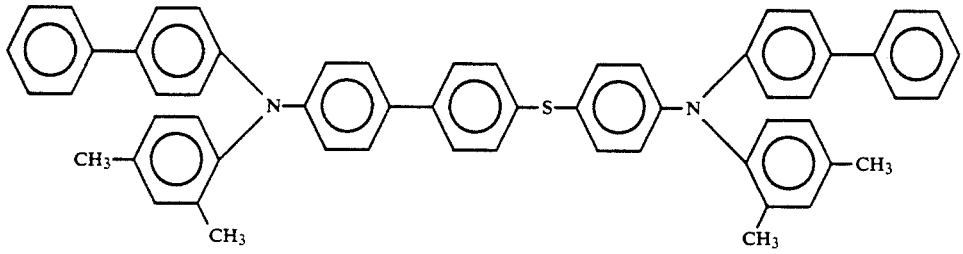
[I-91]
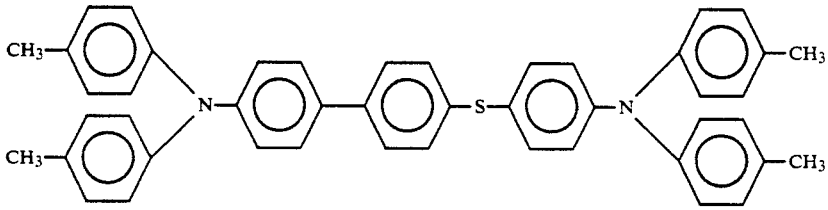
[I-92]
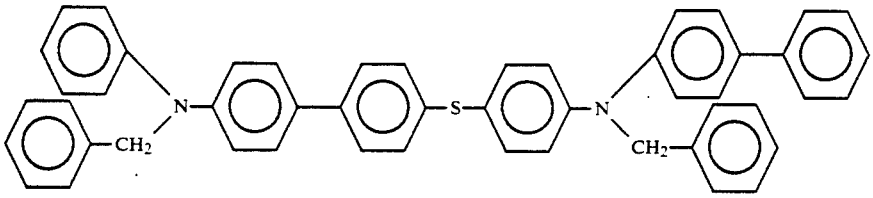
[I-93]
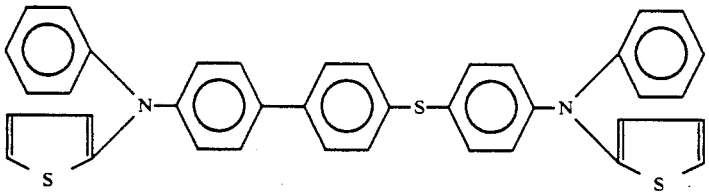
[I-94]
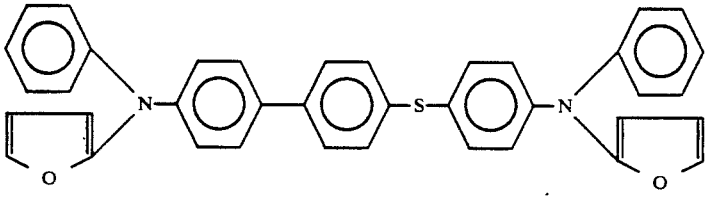
[I-95]
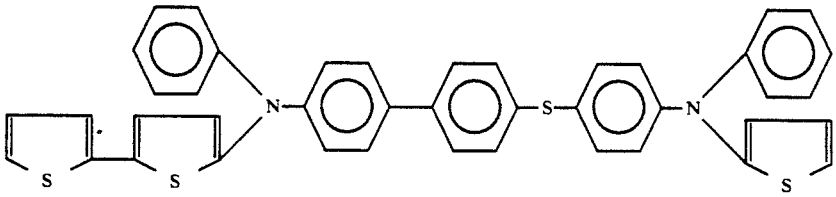

-continued
[I-96]
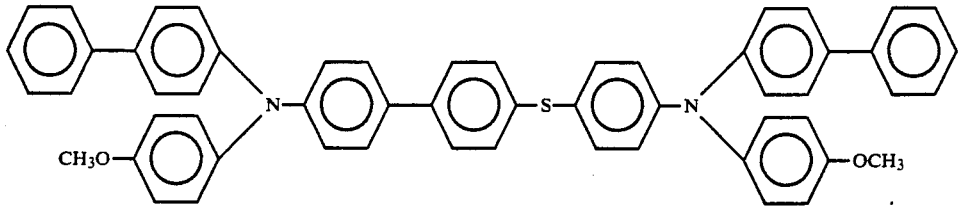
[I-97]
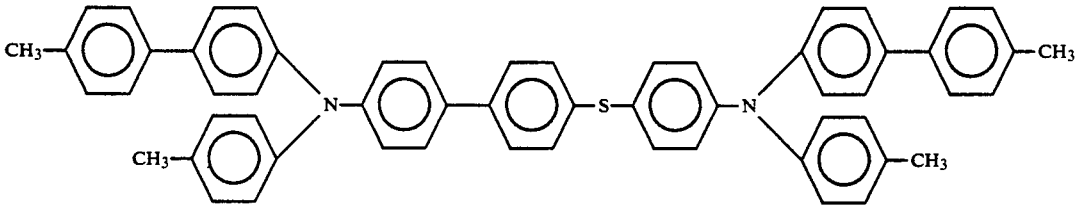
[I-98]
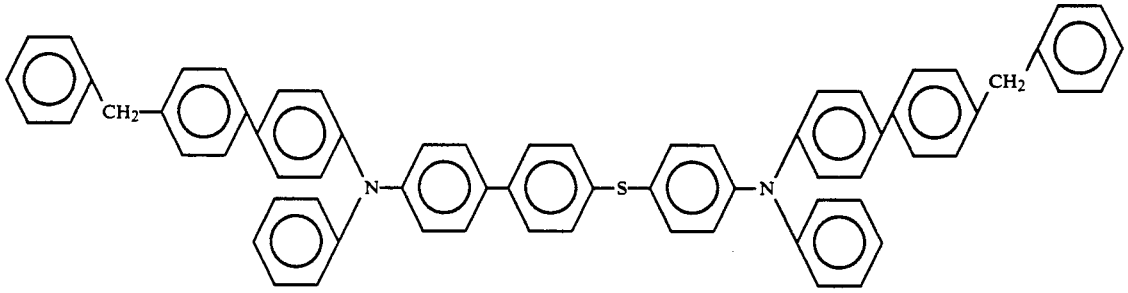
[I-99]
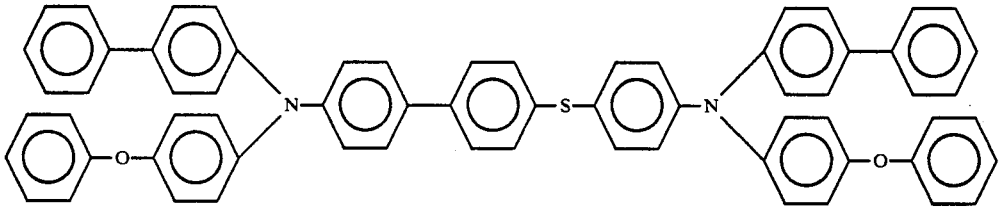
[I-100]
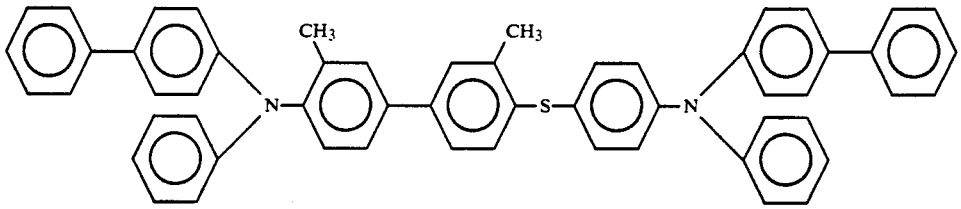
[I-101]
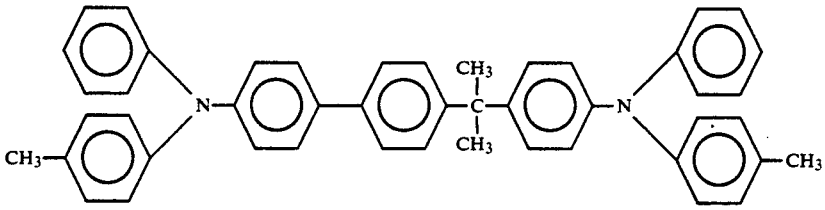
[I-102]
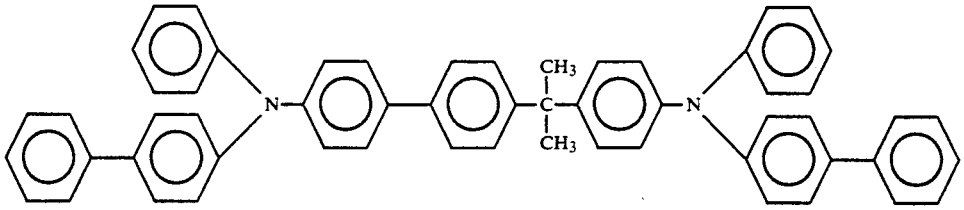

-continued
[I-103]
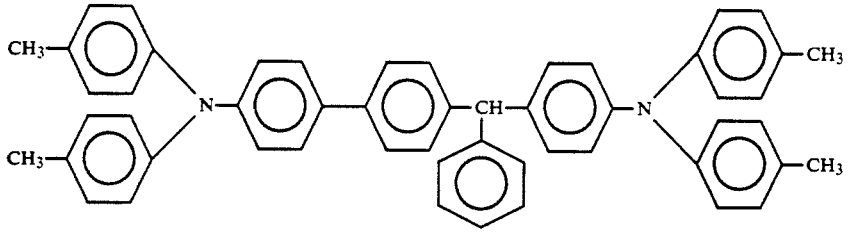
[I-104]
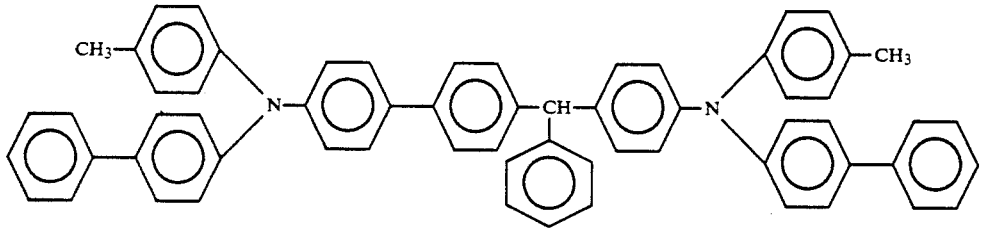
[I-105]
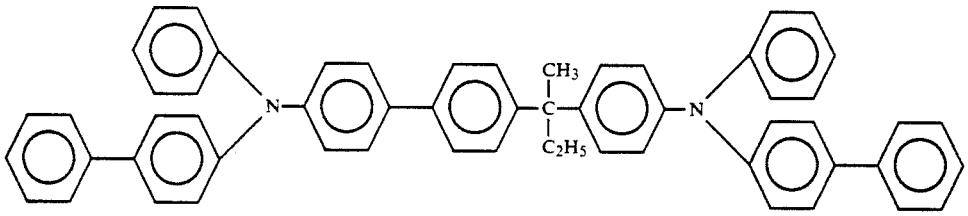
[I-106]
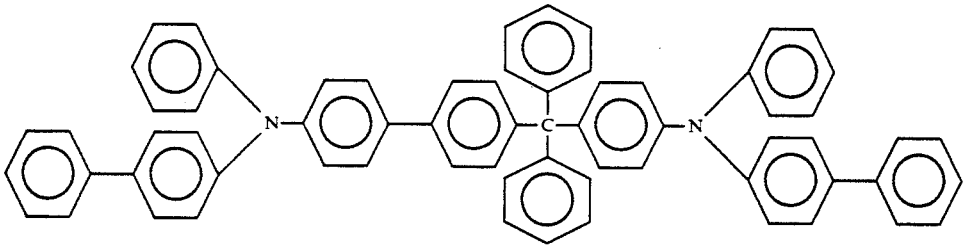
[I-107]
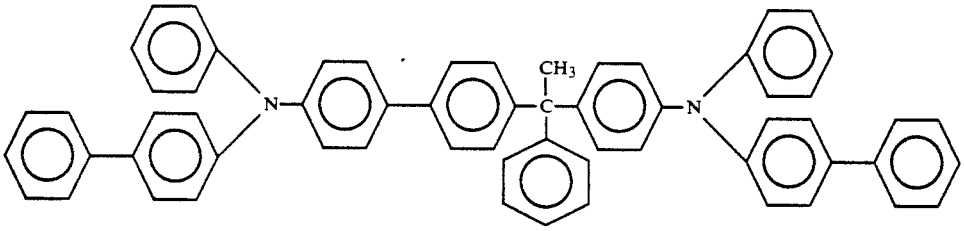
[I-108]
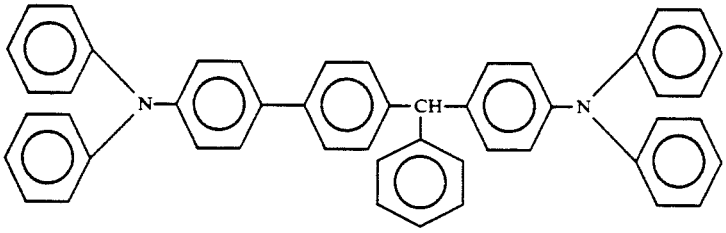

-continued
[I-109]
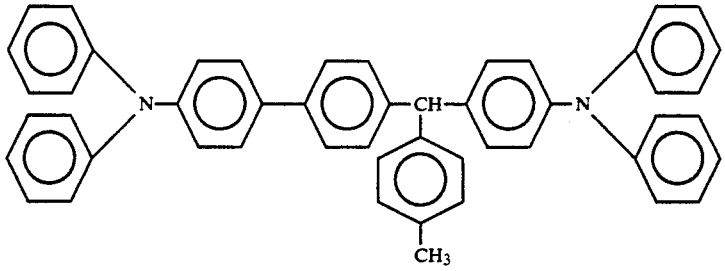
[I-110]
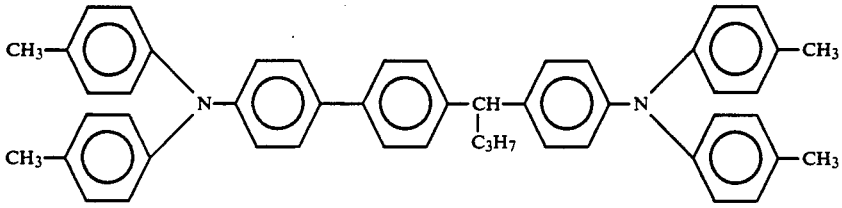
[I-111]
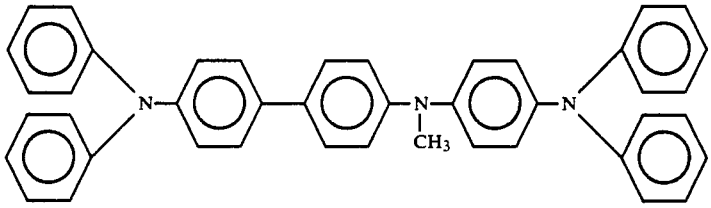
[I-112]
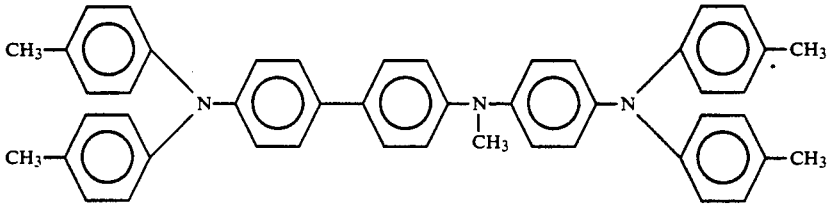
[I-113]
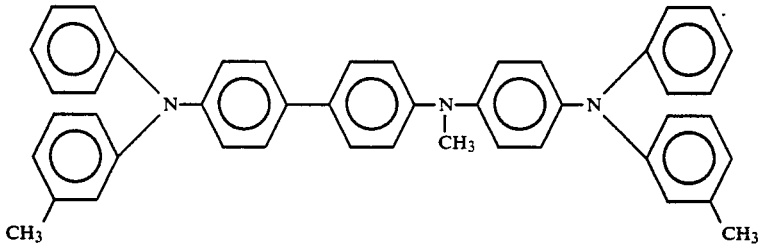
[I-114]
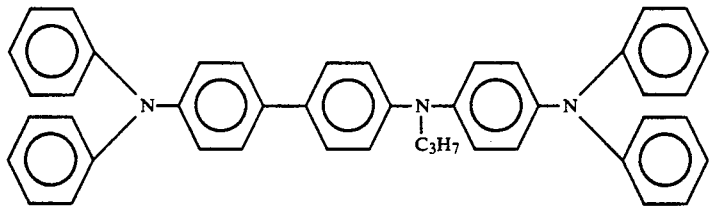
[I-115]
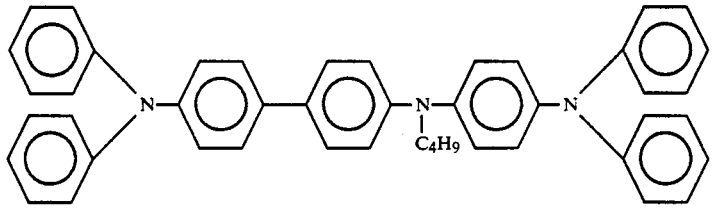

-continued
[I-116]
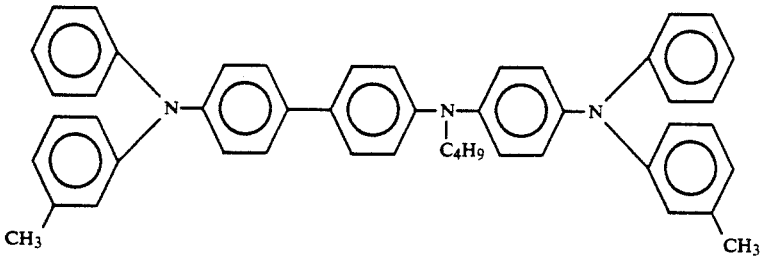
[I-117]
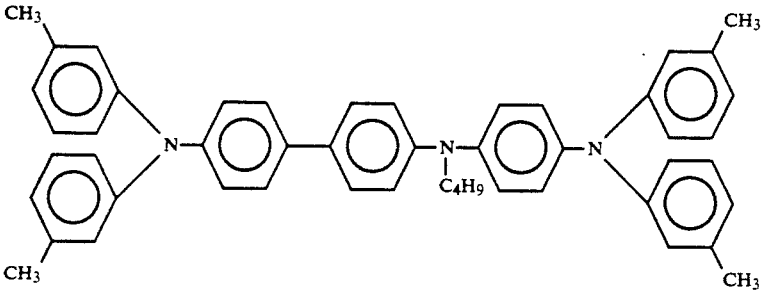
[I-118]
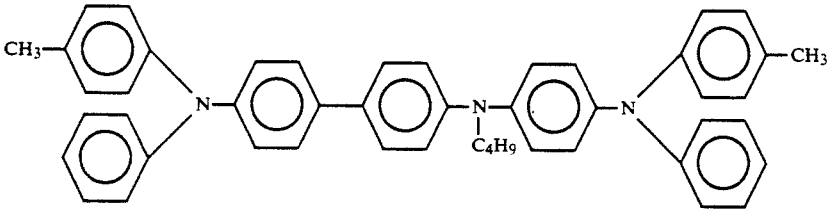
[I-119]
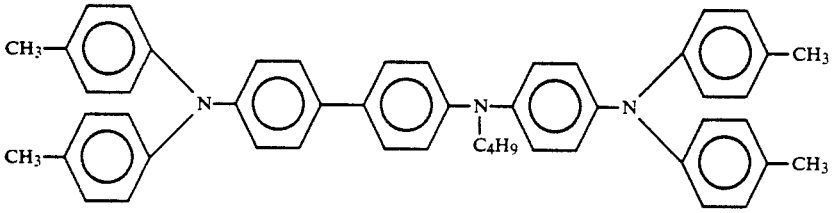
[I-120]
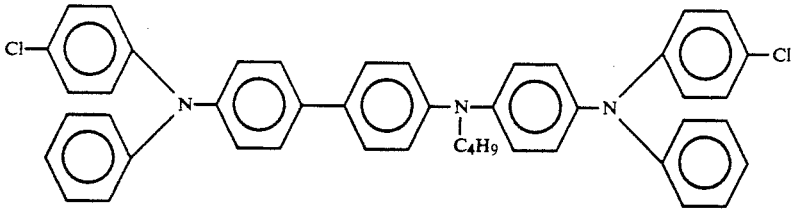
[I-121]
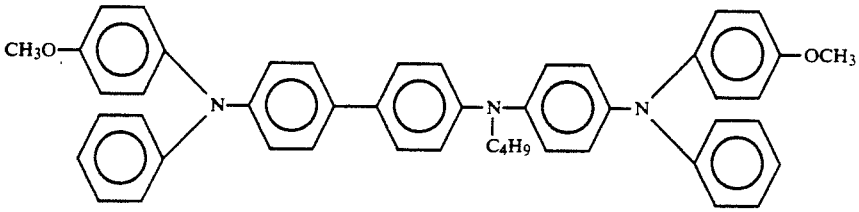

-continued
[I-122]
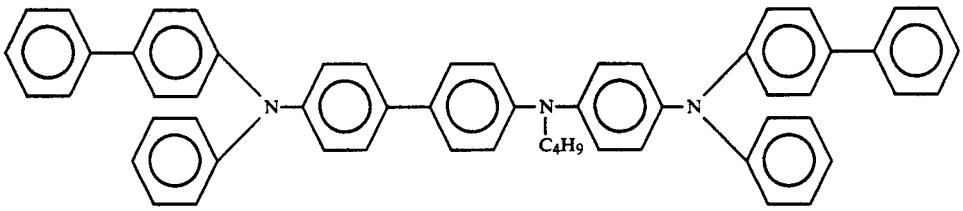
[I-123]
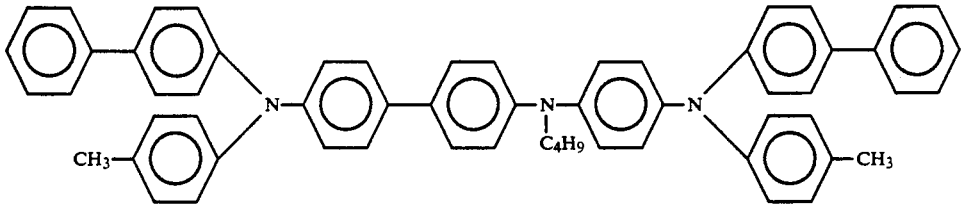
[I-124]
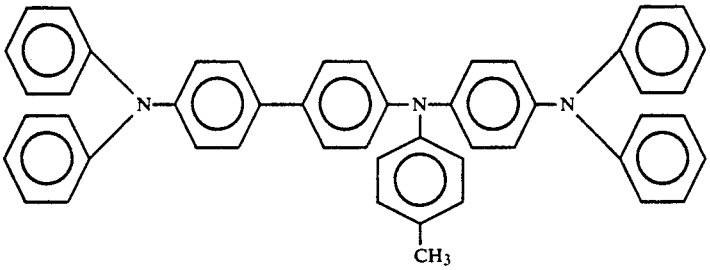
[I-125]
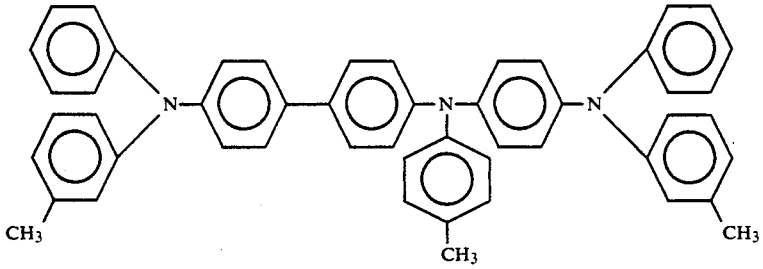
[I-126]
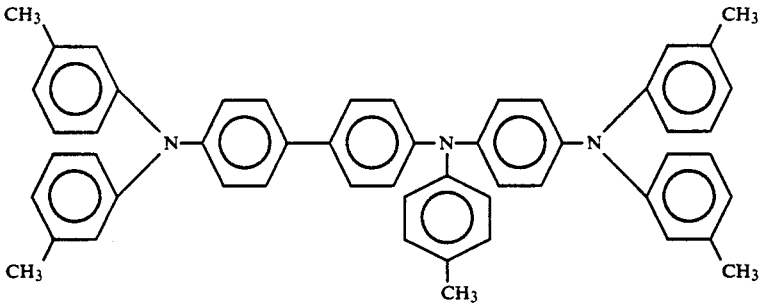
[I-127]
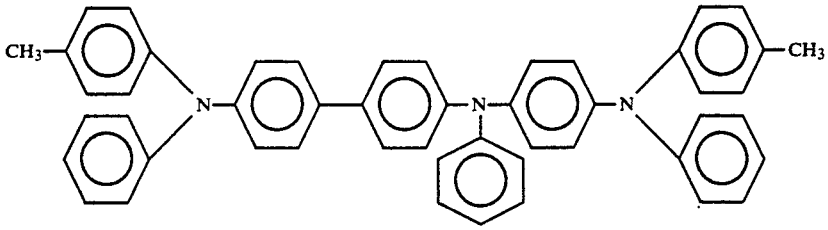

-continued
[I-128]
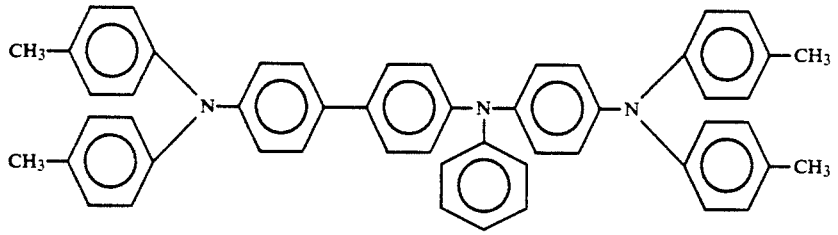
[I-129]
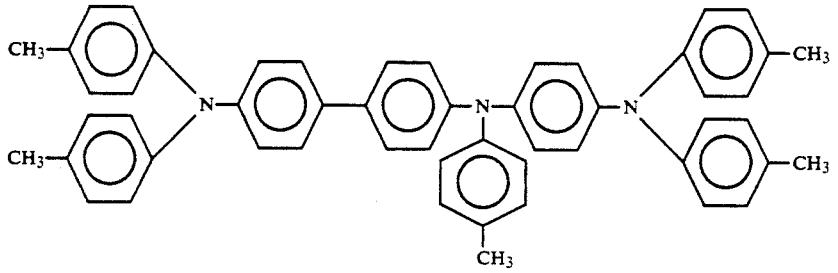
[I-130]
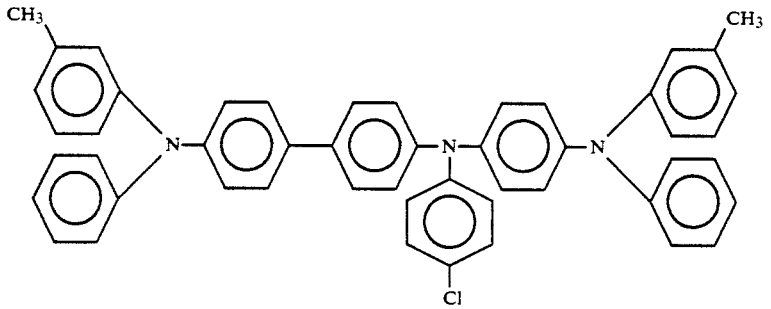
[I-131]
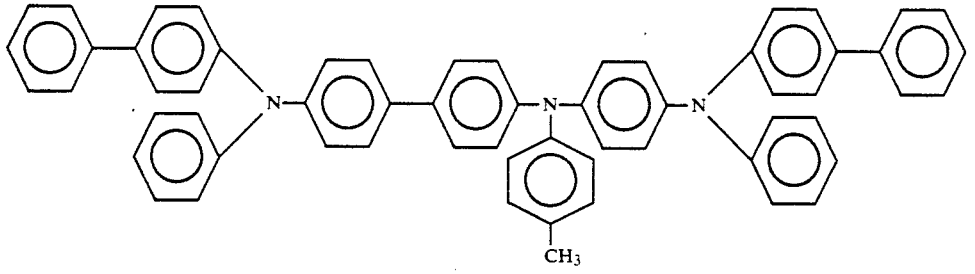
[I-132]
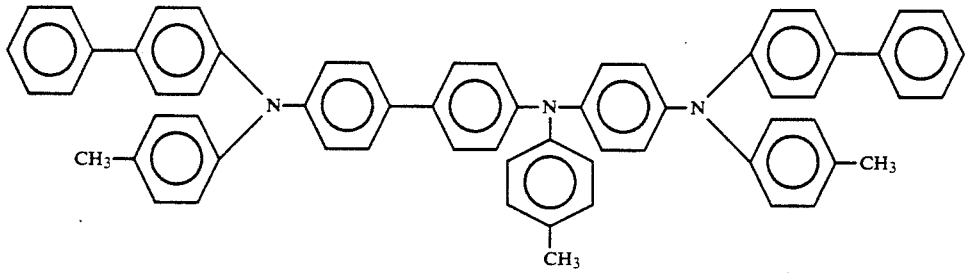
[I-133]
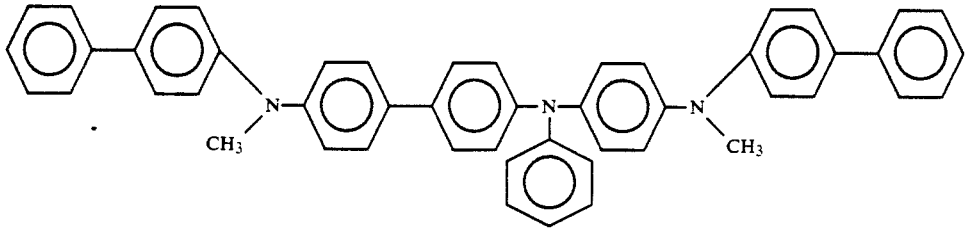

-continued
[I-134]
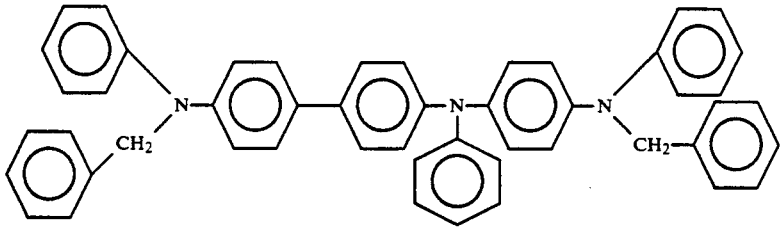
[I-135]
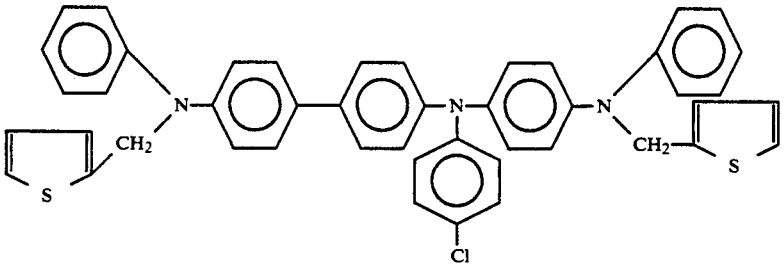
[I-136]
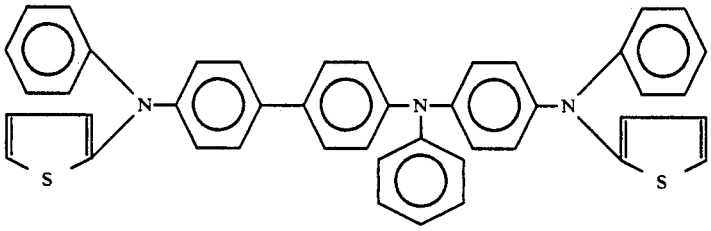
[I-137]
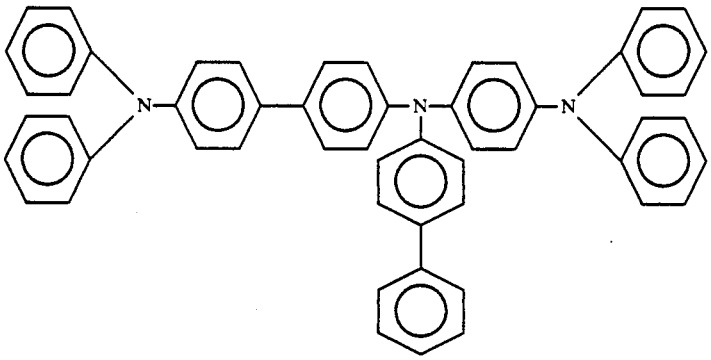
[I-138]
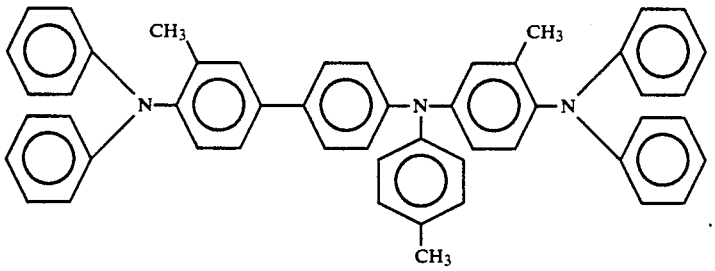
[I-139]
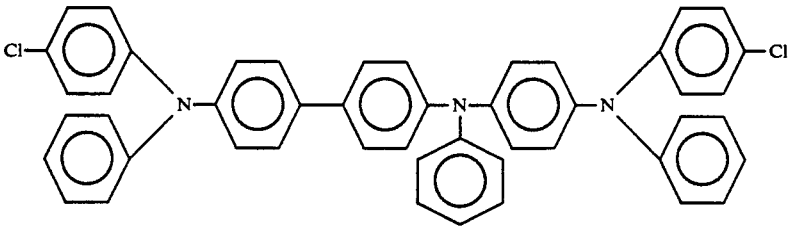

-continued
[I-140]
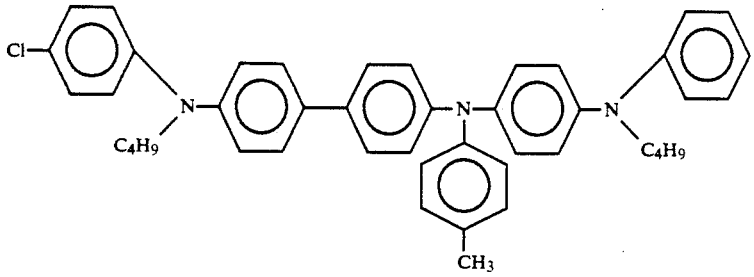
[I-141]
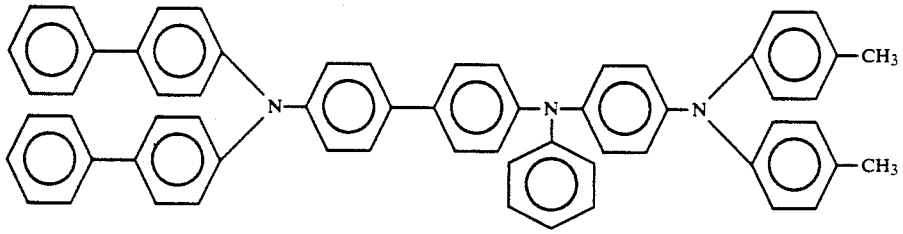
[I-142]
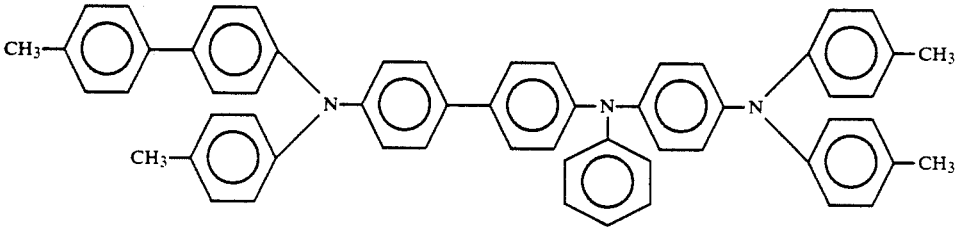
[I-143]
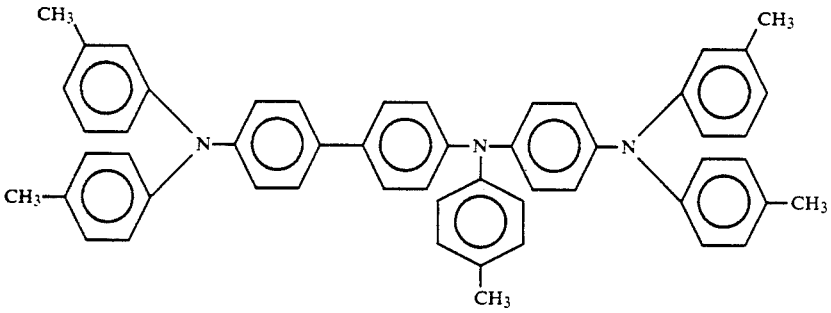
[I-144]
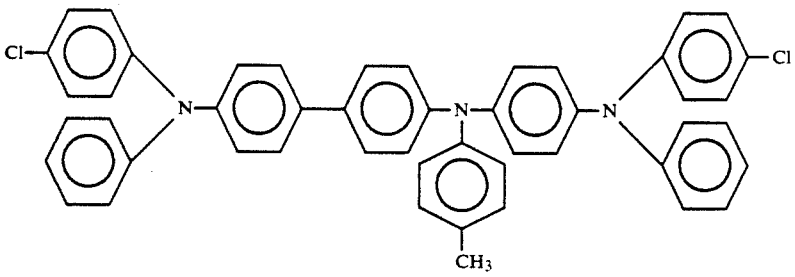
[I-145]
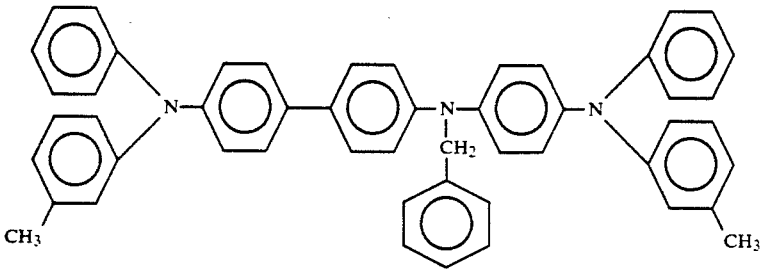

-continued
[I-146]
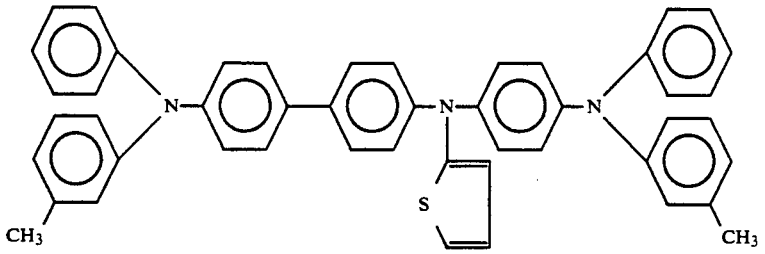
[I-147]
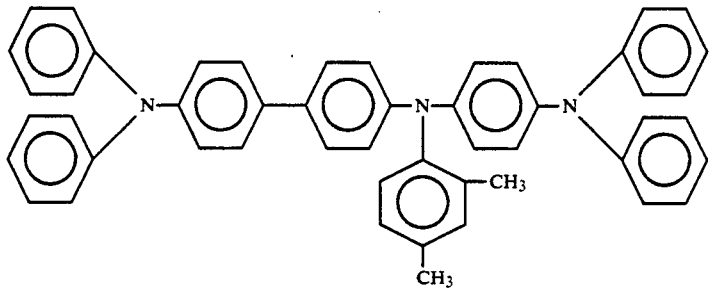
[I-148]
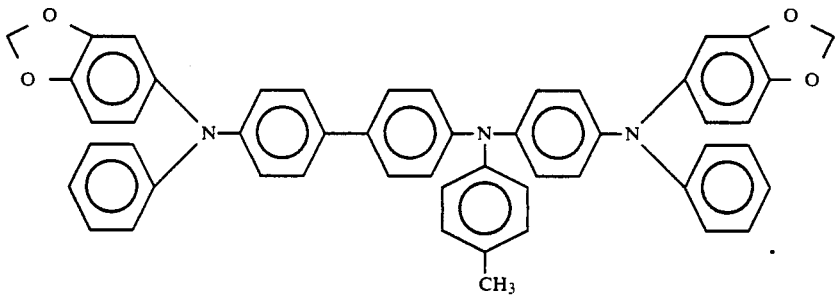
[I-149]
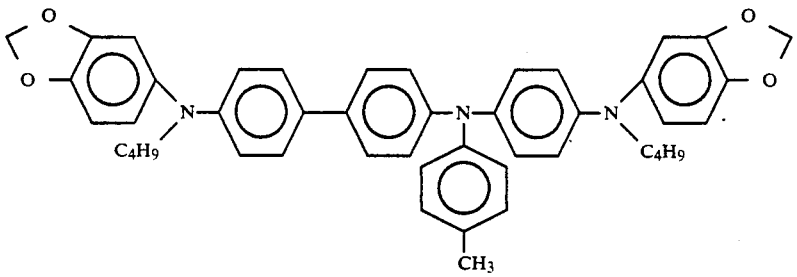
[I-150]
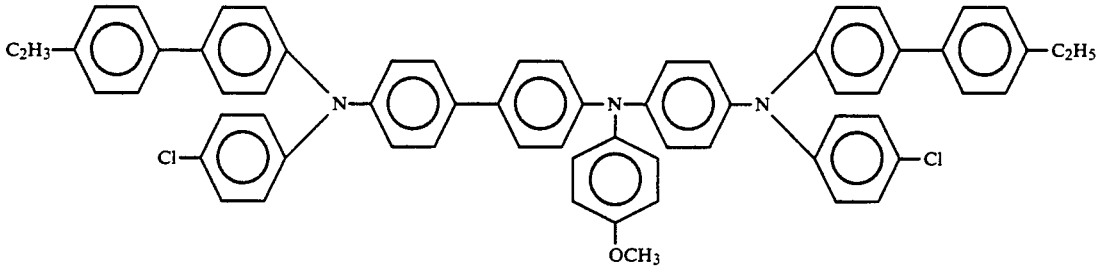
An amino compound represented by the general formula [I] can be prepared by a following method.
An iodide compound represented by the following general formula [II]:
[II]
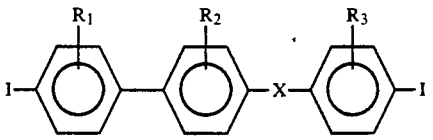
in which $R_1$, $R_2$ and $R_3$ are the same as those in the formula [I ], is treated with amino compounds represented by the following general formulas [III] and [IV]:

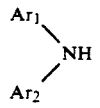

[III]

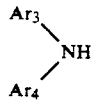

[IV]

in which $Ar_1$, $Ar_2$, $Ar_3$ and $Ar_4$ are the same as those in the formula [I], in a solvent in the presence of a catalyst such as a basic compound and a transition metal according to Ullmann reaction to prepare an amino compound of the present invention.

As to the basic compound, alkali metal hydroxide, alkali metal carbonate, alkali metal bicarbonate and alkali metal alkolate are generally used. A quarternary ammonium compound and an organic base such as an aliphatic amine and an aromatic amine can be also used. Among these compounds, carbonates or bicarbonates of alkali metal or a quarternary ammonium are preferable. Carbonates or bicarbonates of alkali metal are most preferable from viewpoints of reaction rate and heat stability.

As to the transition metals or transition compounds, metals such as Cu, Fe, Co, Ni, Cr, V, Pd, Pt and Ag and compounds thereof are used. Copper, palladium and compounds thereof are preferable from the viewpoint of yield. As to copper compounds, almost all copper compounds known may be used without limitation. Preferable ones are exemplified by CuI, CuCl, $Cu_2O$, CuBr, CuCN, $Cu_2SO_4$, $CuSO_4$, $CuCl_2$, $Cu(OH)_2$, CuO, $CuBr_2$, $Cu_3(PO_4)_2$, $CuNO_3$, $Cu(NO_3)_2$, $CuCO_3$, $Cu(OCOCH_3)$, $Cu(OCOCH_3)_2$. Among those, CuCl, CuI, $Cu_2O$, CuBr, $CuSO_4$, $CuCl_2$, CuO, $CuBr_2$, $CuNO_3$, $Cu(NO_3)_2$, $CuCO_3$, $Cu(OCOCH_3)_2$ are preferable because of easy availability in the market. As to palladium compounds, halides, sulfates, nitrates and organic acid salts may be used. The usage of transition metals or transition compounds is 0.5–500 mole % on the basis of benzylphenyl halide [II].

The solvents used in the reaction may be the ones known, preferably aptotic polar solvents such as nitrobenzene, dimethylformamide, dimethyl sulfoxide and N-methylpyrrolidone.

The reaction is carried out at 100°–250° C. under normal prresure or under pressure. After reaction, the solids deposited in the reaction solution are removed and the solvent is removed to give amino compound products.

The amino compound represented by the general formula [I] can be used as a photosensitive material and is particularly excellent in charge transportability.

The amino compound represented by the general formula [I] may be applied to a photosensitive member as a photosensitive material and is particularly useful as a charge transporting material. The amino compound may be applied to a charge transporting layer of an electroluminescence device by taking advantage of its charge transportability.

First, it is expalined hererinafter that the amino compound represented by the general formula [I] is applied as a charge transporting material for a photosensitive member.

There are known various forms of photosensitive member. The amino compound of the present invention may be applied to any form of photosensitive member. For examlpe, there is known a monolayer type in which a photosensitive layer containing a charge generating material and a charge transporting material dispersed in a binder resin is formed on an electrically conductive substrate and a laminated type in which a charge generating layer containing a charge generating material as a main material is formed on an substrate, followed by formation of a charge transporting layer on the charge generating layer. One or more of the amino compound of the present invention are used as a charge transporting material. The amino compound can carry effectively electrical charges given by charge generating materials by light-absorption.

Further, the amino compound of the present invention is excellent in ozone-resistance and light stability. Therefore, a photosensitive member becomes excellent in durability.

Moreover, the amino compound of the present invention has good compatibility with a binder resin, resulting in rare deposition of crystals and contribution to improvement of sensitivity and repetition properties.

The amino compound of the present invention may be used in combination with other charge transporting material. In particular, the combination with a distyryl compound represented by the following general formula [V] gives good properties With respect to stabilization of repetition properties, prevention of lowering of $V_0$, prevention of increase of residual potential, ozone resistance and the like. The styryl compound of the formula [V] is contained at a weight ratio of 5/95–95/5, preferably 20/80–80/20 to the amino compound of the formula [I].

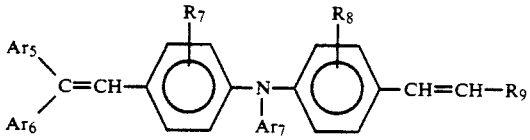

[V]

In the formula [V], $Ar_5$ and $Ar_6$ represent respectively an alkyl group such as methyl and ethyl or an aryl group such as phenyl and naphthyl, each of which may have a substituent such as lower alkyl, lower alkoxy, phenyl and a halogen atom.

$Ar_7$ represents an alkyl group such as methyl and ethyl, an aralkyl group such as benzyl and phenethyl or an aryl group such as phenyl and naphthyl, each of which may have a substituent such as lower alkyl, lower alkoxy phenyl and a halogen atom.

$R_7$ and $R_8$ represent respectively a hydrogen atom, an alkyl group, an alkoxy group or a halogen atom;

$R_9$ represents an alkyl group such as methyl, ethyl and propyl, an alkoxy group such as methoxy and ethoxy, an aralkyl group such as benzyl and phenethyl, an alkenyl group such as vinyl, an alkynyl group such as ethynyl, a thioether group, an aryl group such as phenyl and naphtyl, or a heterocyclic group of furan, thiophene or 1,3-dioxaindane, an aralkyloxy group such as benzyloxy and phenethyloxy, a phenoxy group. The aryl group and the heterocyclic group may have one or more substituents such as C1–C4 alkyl group, a C1–C4 alkoxy group, a halogen atom or a hydroxyl group.

Concrete compounds having the distyryl structure represented by the general formula [V] are exemplified as shown below:
[V-1]
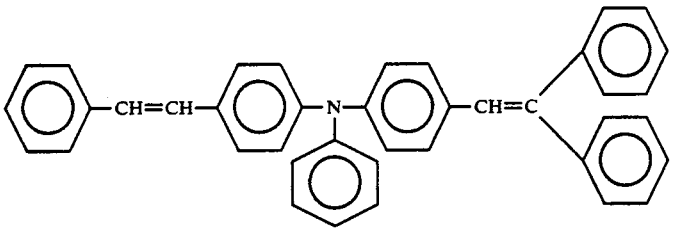
[V-2]
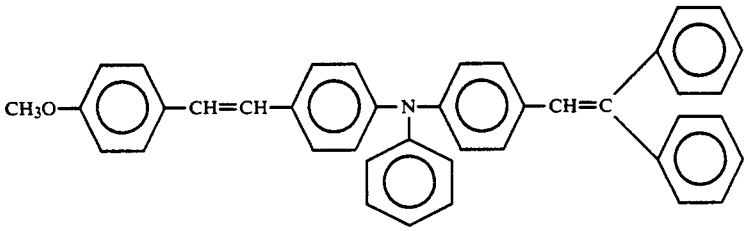
[V-3]
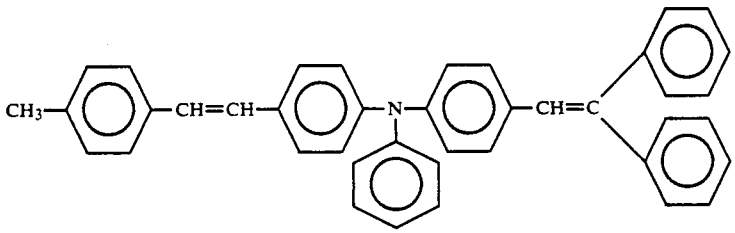
[V-4]
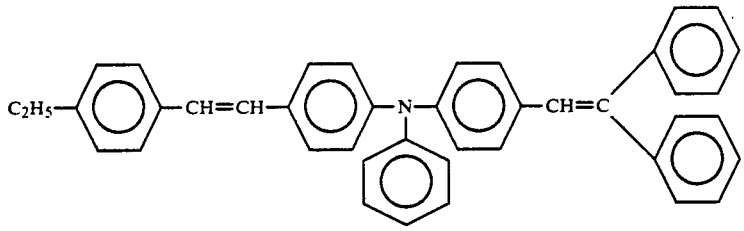
[V-5]
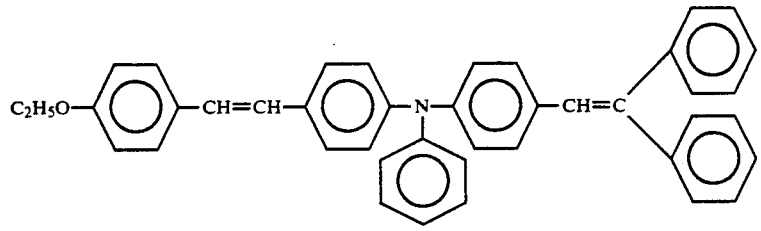
[V-6]
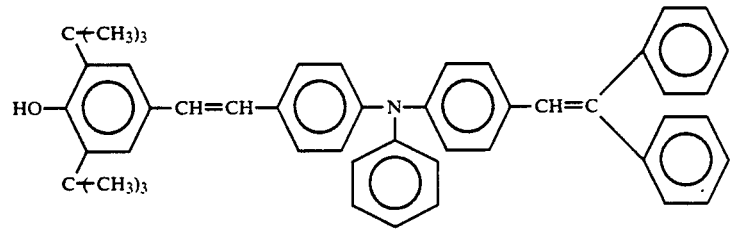

-continued
[V-7]
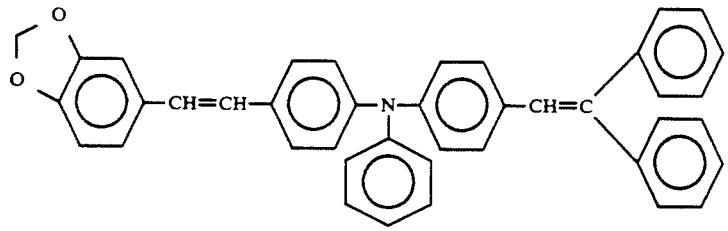
[V-8]
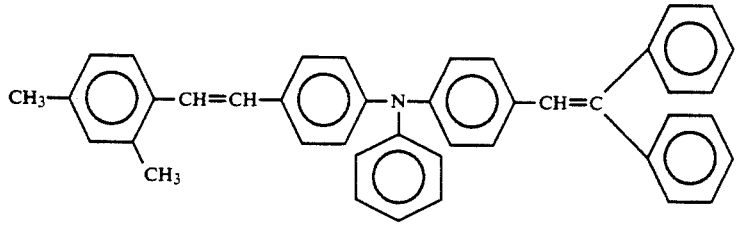
[V-9]
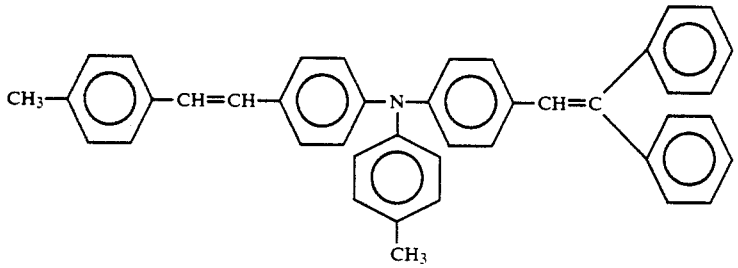
[V-10]
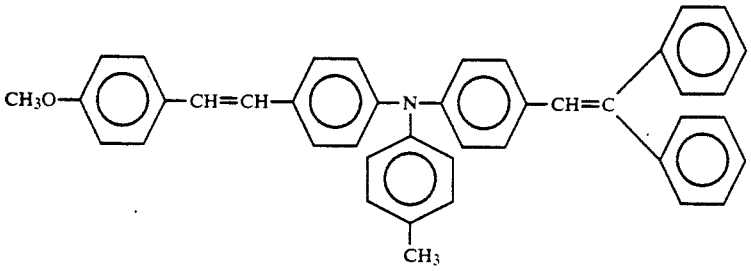
[V-11]
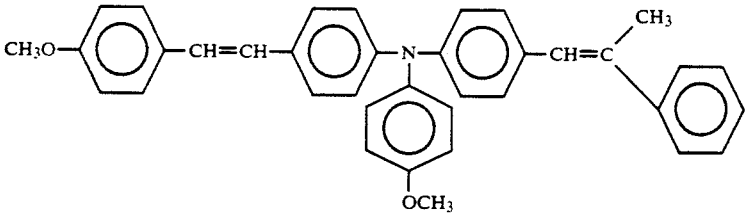
[V-12]
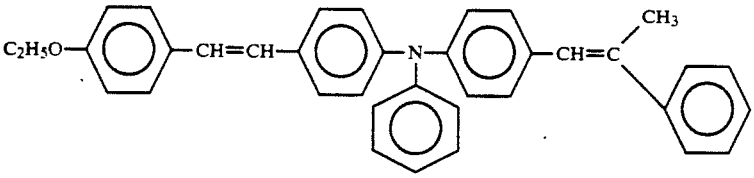
[V-13]
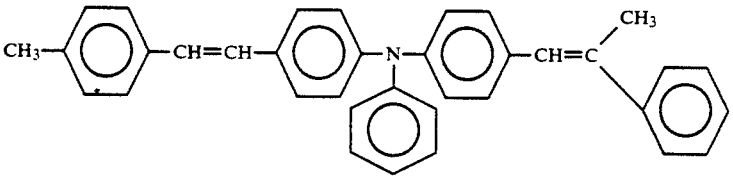

-continued
[V-14]
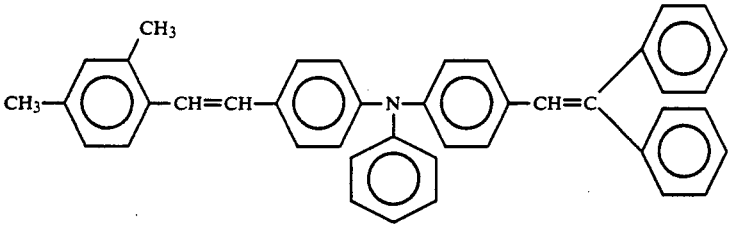
[V-15]
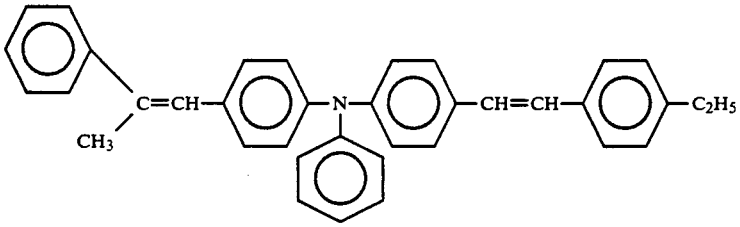
[V-16]
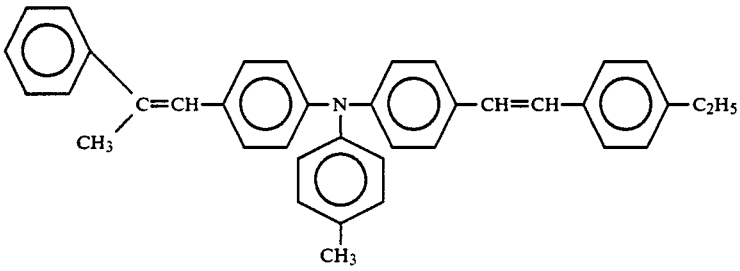
[V-17]
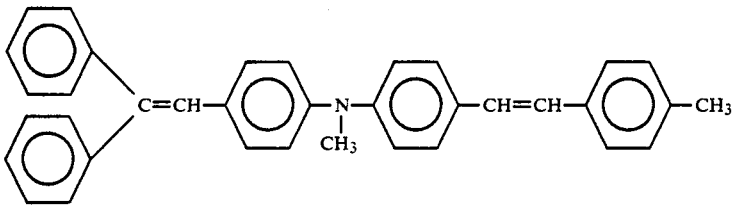
[V-18]
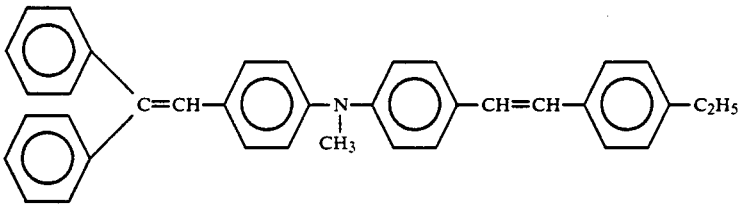
[V-19]
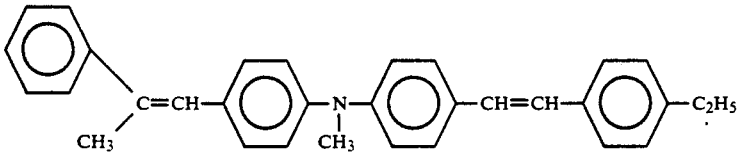
[V-20]
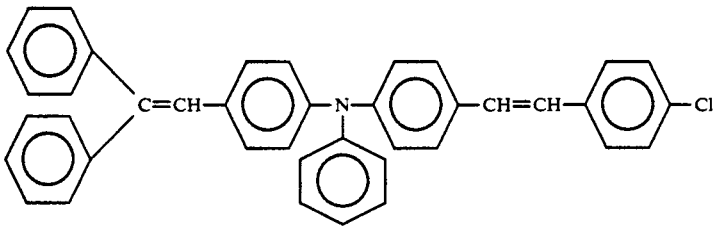

-continued
[V-21]
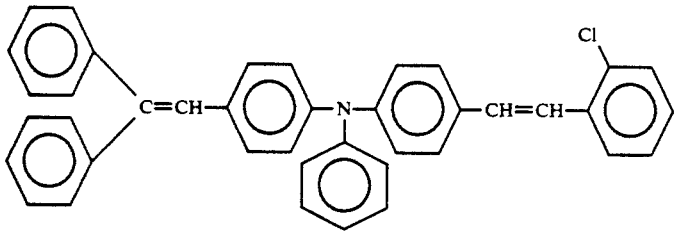
[V-22]
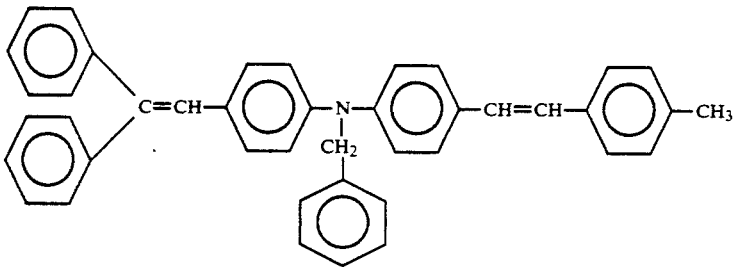
[V-23]
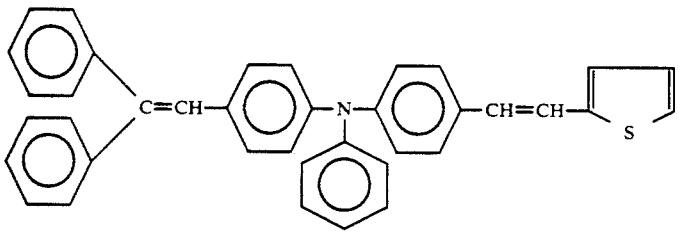
[V-24]
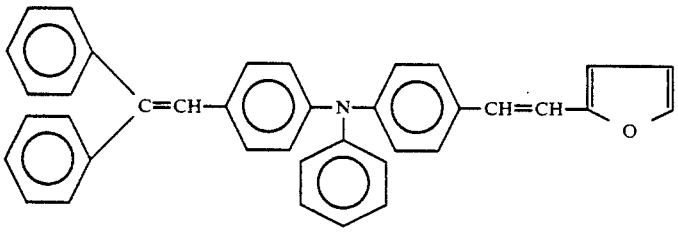
[V-25]
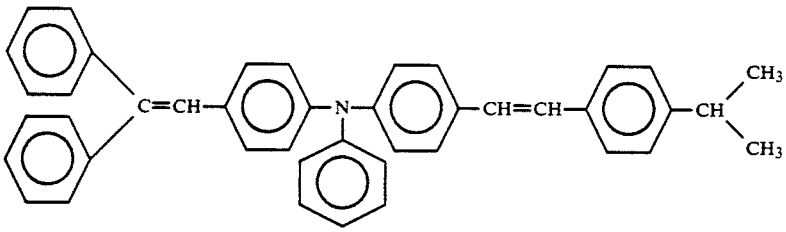
[V-26]
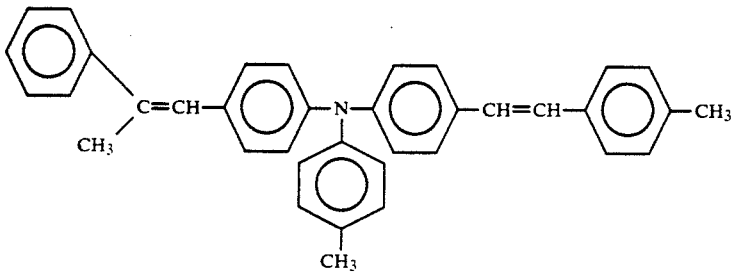

-continued
[V-27]
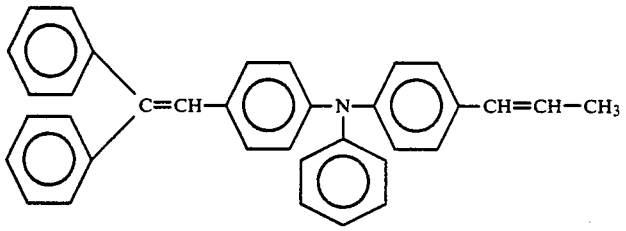
[V-28]
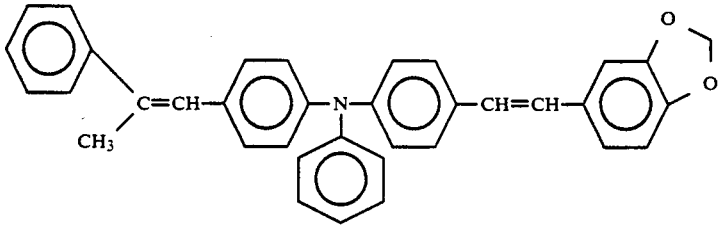
[V-29]
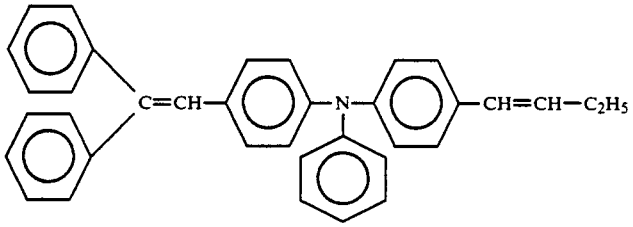
[V-30]
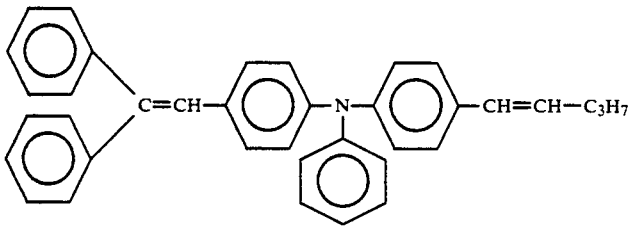
[V-31]
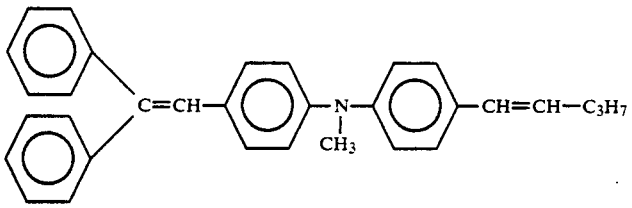
[V-32]
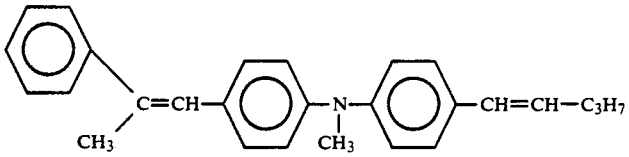
[V-33]
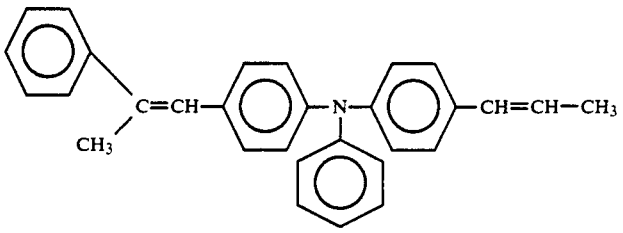

-continued
[V-34]
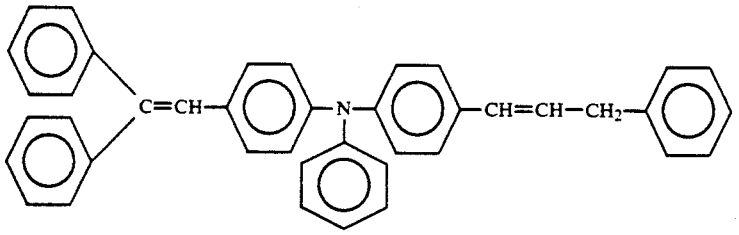
[V-35]
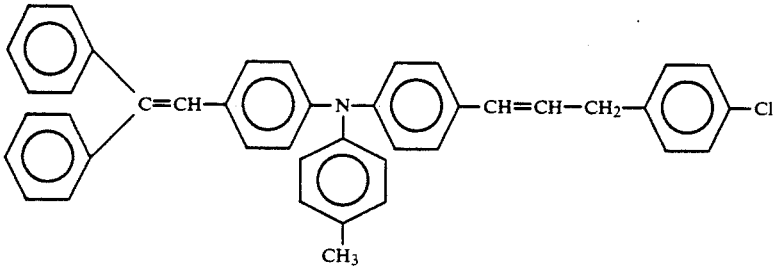
[V-36]
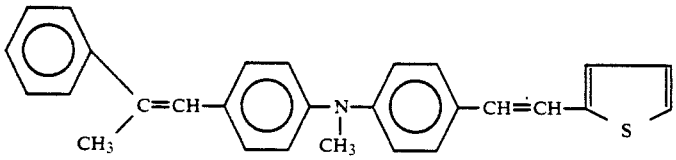
[V-37]
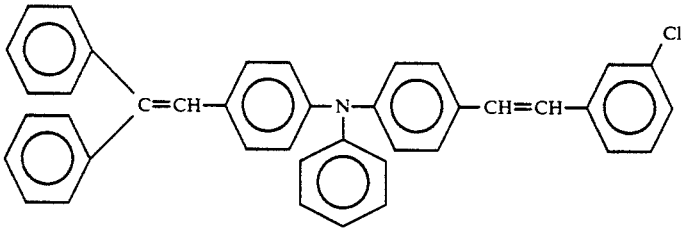
[V-38]
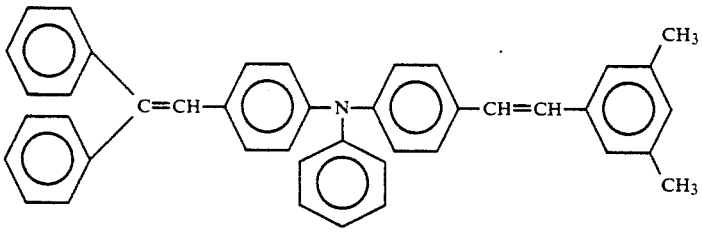
[V-39]
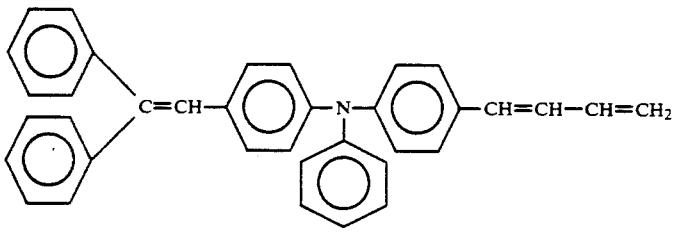
[V-40]
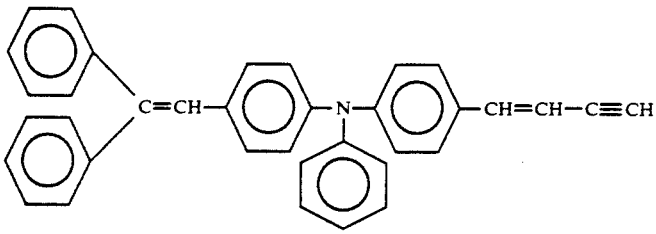

-continued
[V-41]
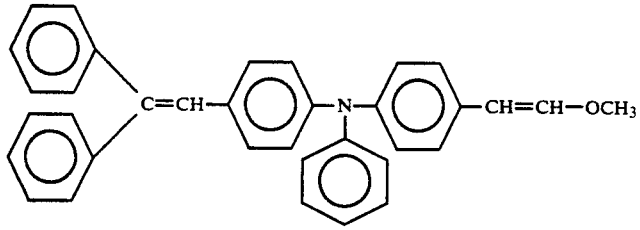
[V-42]
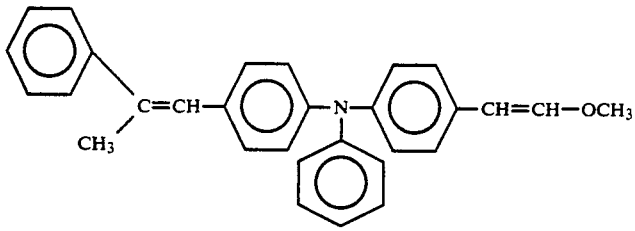
[V-43]
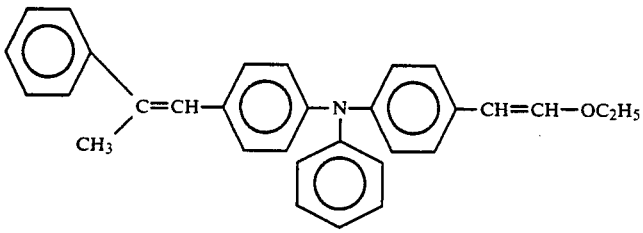
[V-44]
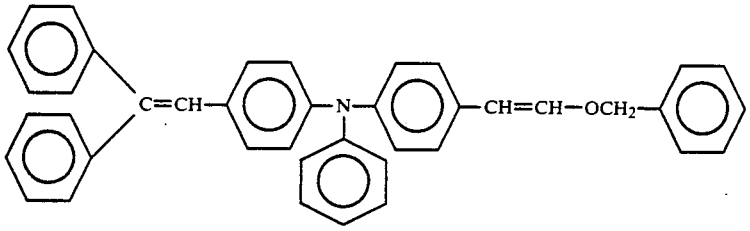
[V-45]
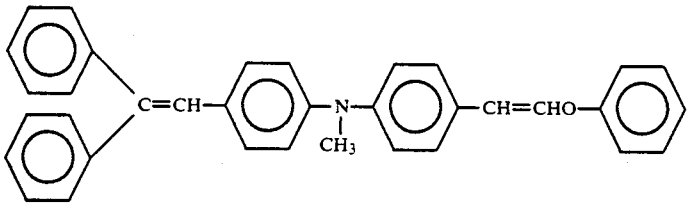
[V-46]
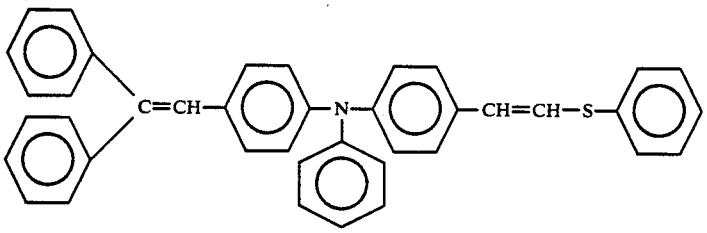
[V-47]
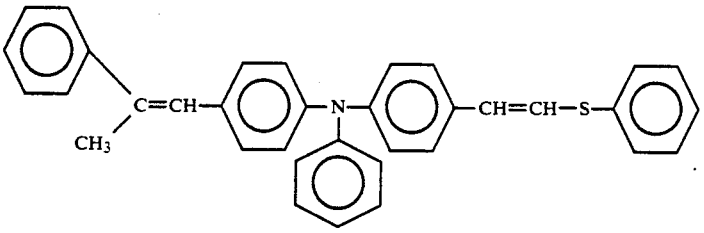

-continued

[V-48]

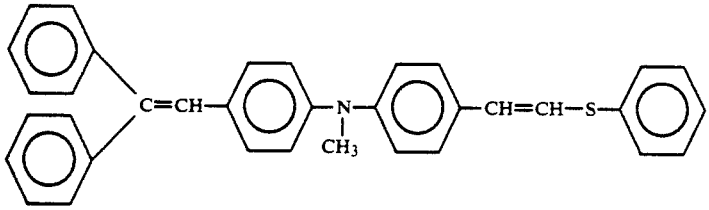

[V-49]

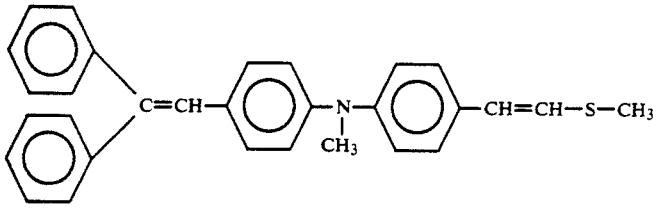

[V-50]

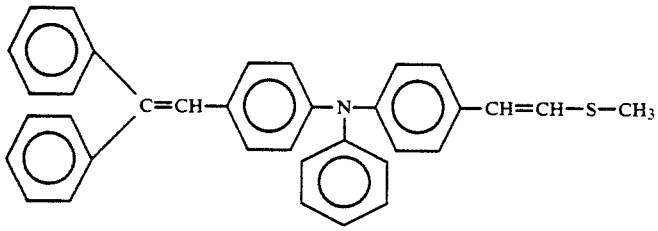

A charge generating material useful for the present photosensitive member is exemplified by organic substances such as bisazo dyes, triarylmethane dyes, thiazine dyes, oxazine dyes, xanthene dyes, cyanine coloring agents, styryl coloring agents, pyrylium dyes, thiapyrylium dyes, azo pigments, quinacridone pigments, indigo pigments, perylene pigments, polycyclic quinone pigments, bisbenzimidazole pigments, indanthrone pigments, squalylium pigments, azulene coloring agents, phthalocyanine pigments and pyrrolopyrrole; and inorganic substances such as selenium, selenium-tellurium, selenium arsenic, cadmium sulfide, cadmium selenide, zinc oxide and amorphous silicon. Any other material is also usable insofar as it generates charge carriers very efficiency upon adsorption of light.

In particular, the use of an bisazo pigment represented by the following general formula [VI] as a charge generating material gives a photosensitive member with high sensitivity.

[VI]

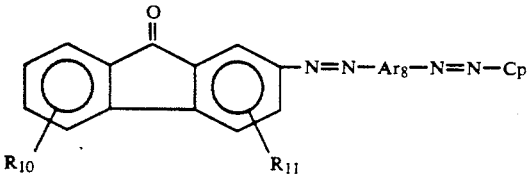

In the formula [VI], $R_{10}$ and $R_{11}$ are respectively a hydrogen atom, a halogen atom such as fluorine, chlorine, bromine and iodine, a nitro group, a hydroxy group, an alkyl group such as methyl, ethyl and propyl, an alkoxy group such as methoxy and ethoxy.

$Ar_8$ is an arylene group such as phenlene, which may have a substituent.

Cp represents a residue of a coupler having phenolic OH group and is exemplified by the one represented by the following general formulas [a]-[j].

[a]

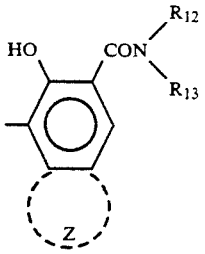

[b]

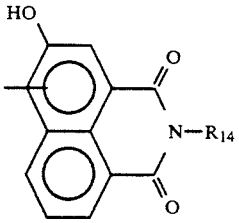

[c]

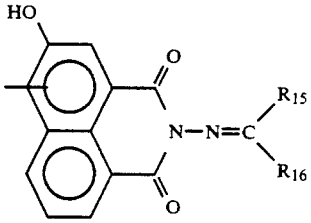

[d]

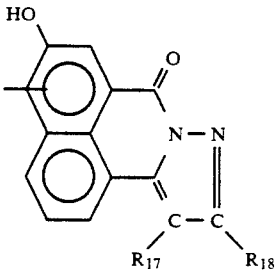

-continued

[e]

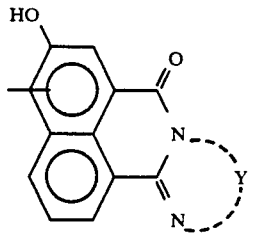

[f]

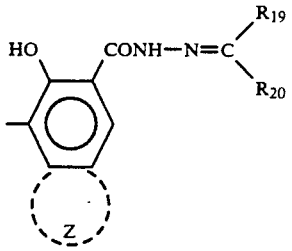

[g]

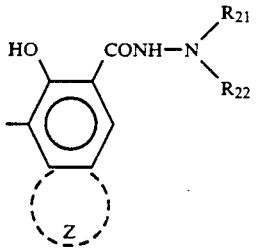

[h]

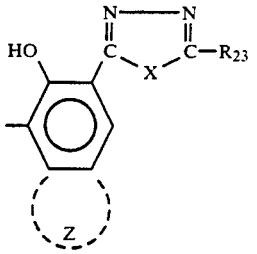

[i]

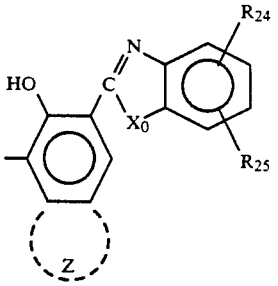

[j]

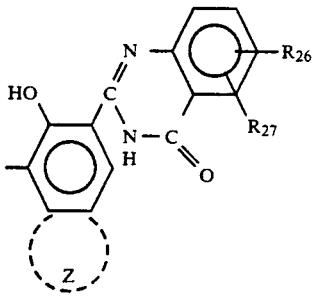

In the formula [a]-[j], $X_0$ is an oxgen atom, a sulfur atom or a nitrogen atom which may have a substituent. Y represents bivalent group of aromatic hydrocarbon or a bivalent group forming a heterocyclic ring in combination with the nitrogen atom. Z is a residue of a polycyclic conjugated ring or a heterocyclic ring condensed with the benzene ring. $R_{12}$, $R_{13}$, $R_{15}$, $R_{16}$, $R_{19}$, $R_{20}$, $R_{21}$, $R_{22}$ are respectively a hydrogen atom, an alkyl group, an aralkyl group, an aryl group or a heterocyclic group, each group of which may have a substituent. $R_{12}$ and $R_{13}$, $R_{15}$ and $R_{16}$, $R_{19}$ and $R_{20}$, and $R_{21}$ and $R_{22}$ may form a ring in combination. $R_{14}$ and $R_{25}$ are respectively an alkyl group, an aralkyl group, an aryl group or a heterocyclic group, each of which may have a substituent. $R_{17}$ and $R_{18}$ are respectively a hydrogen atom, an halogen atom, an alkyl group, an aralkyl group, an acyl group, an alkoxycarbonyl group, an aryl group, a condensed polycyclic group or a heterocyclic group, each group of which may have a substituent. $R_{24}$, $R_{25}$, $R_{26}$ and $R_{27}$ are respectively a hydrogen atom, a halogen atom, an alkyl group, a nitro group, a substituted solfone group, a carbamoyl group which may have a substituent at N-position, a sulfamoyl group which may have a substituent at N-position, an acylamino group which may have a substituent at N-positionn, or a phthtalimidyl group whch may have a substituent at N-position. $R_{24}$ and $_{25}$, $R_{26}$ and $R_{27}$ may form a ring in combination.

In particular, $R_{12}$, $R_{15}$, $R_{19}$ and $R_{21}$ are a hydrogen atom and $R_{13}$, $R_{16}$, $R_{20}$, $R_{22}$ and $R_{23}$ are a substituted phenyl group represented by the following general formula in preferable couplers having general formula [a], [c], [f], [g] and [h];

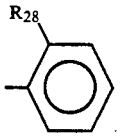

in which $R_{28}$ is a phenyl group having a substituent selected from the group consisting of a halogen atom, a nitro group, a cyano group and a trifluoromethyl group.

Concrete exmaples of the couplers are shown below.

[1]

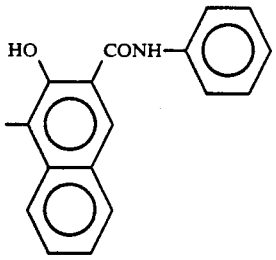

[2]

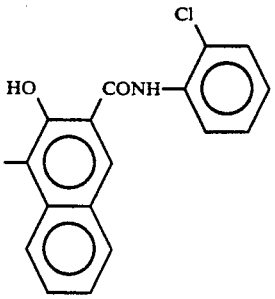

-continued
[3]
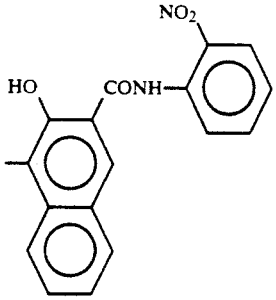
[4]
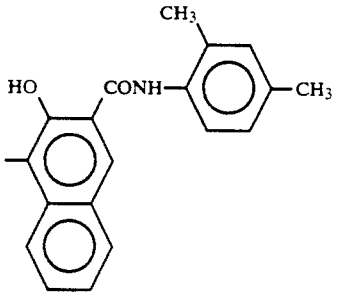
[5]
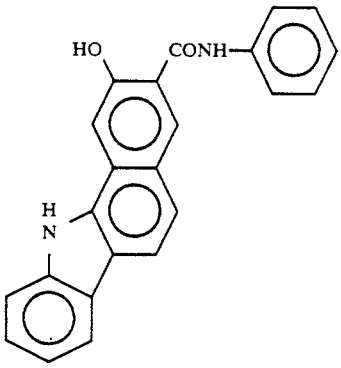
[6]
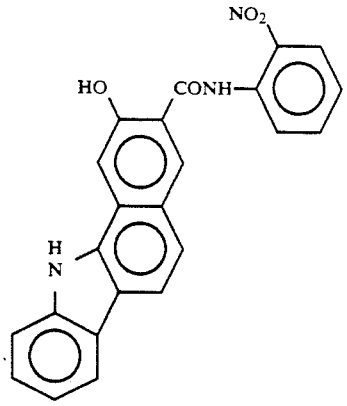
[7]
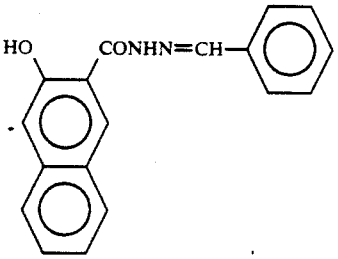
-continued
[8]
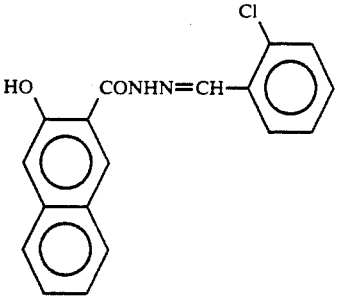
[9]
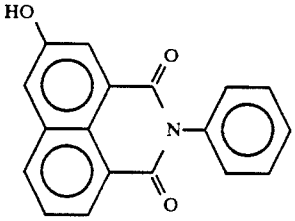
[10]
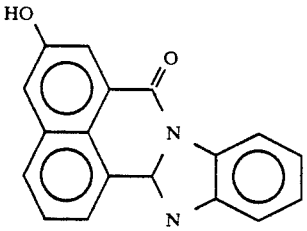
[11]
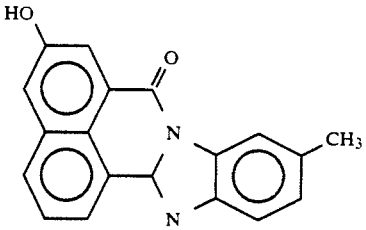
[12]
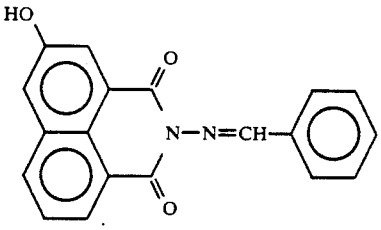
[13]
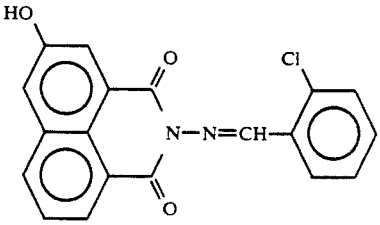

-continued
[14]
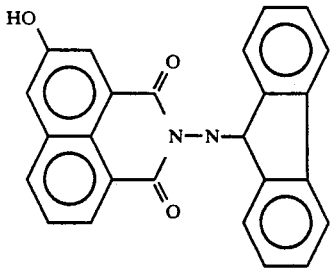
[15]
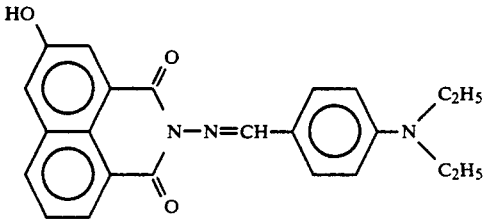
[16]
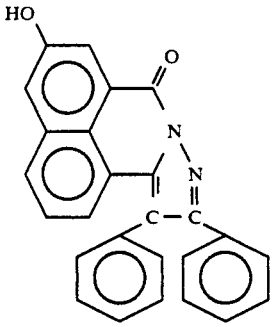
[17]
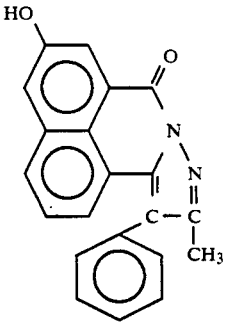
[18]
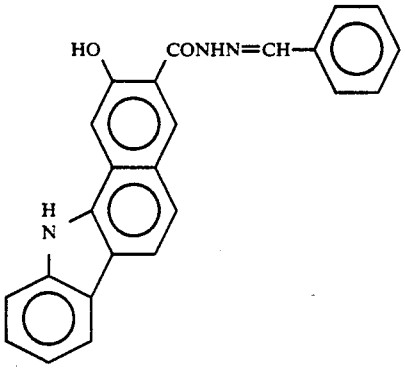
-continued
[19]
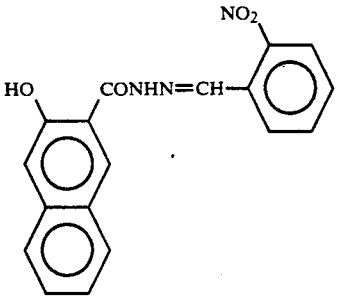
[20]
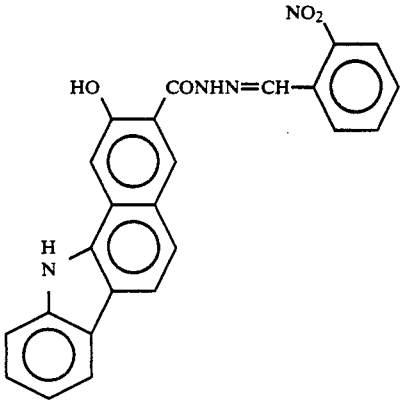
[21]
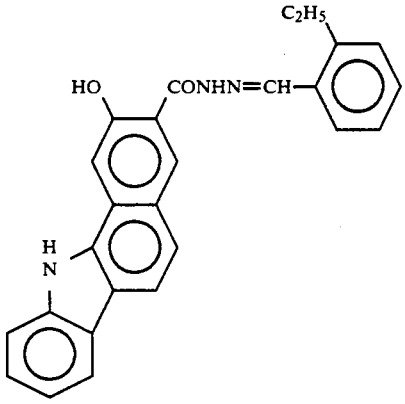
[22]
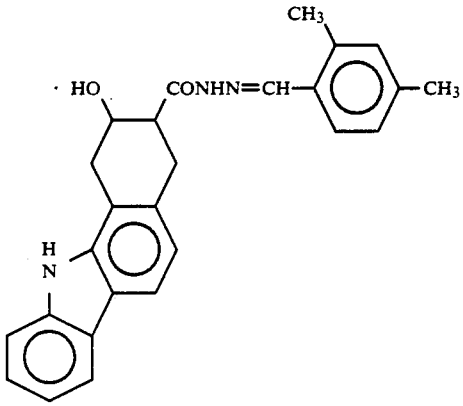

-continued
[23]
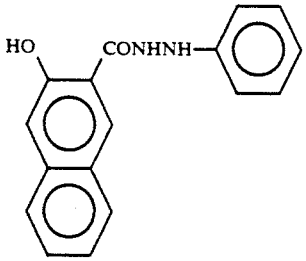
[24]
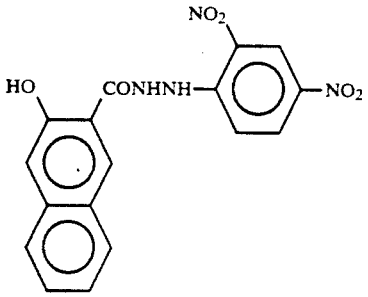
[25]
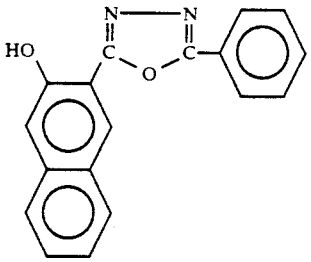
[26]
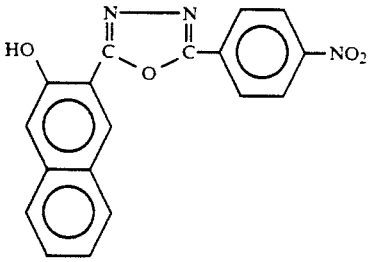
[27]
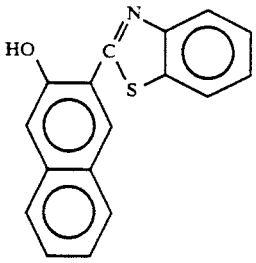
[28]
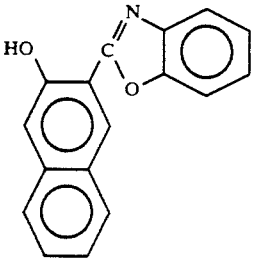
-continued
[29]
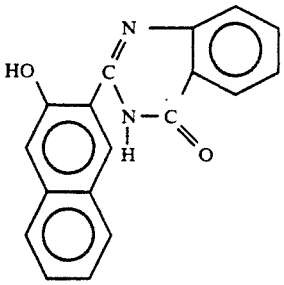
[30]
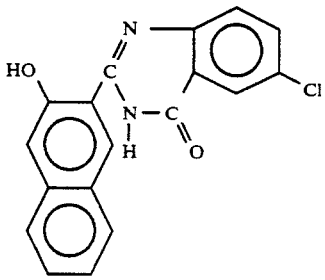
[31]
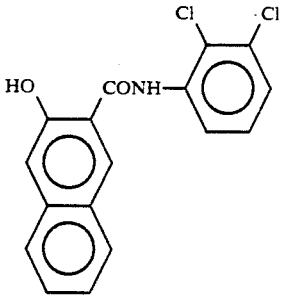
[32]
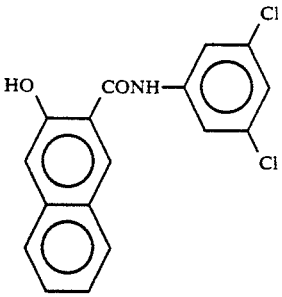
[33]
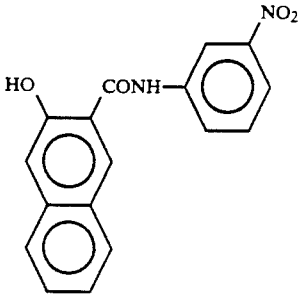

-continued
[34]
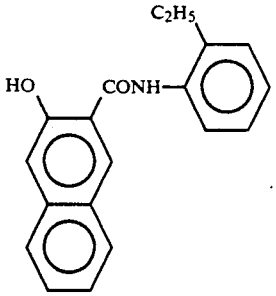
[35]
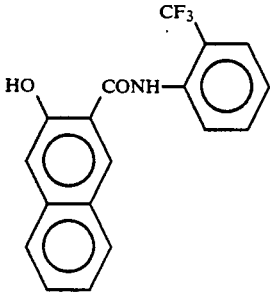
[36]
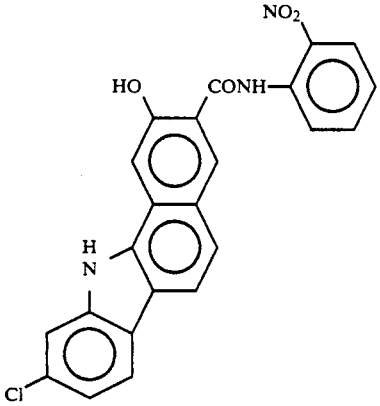
[37]
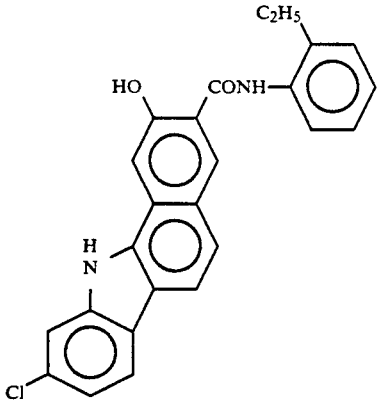
[38]
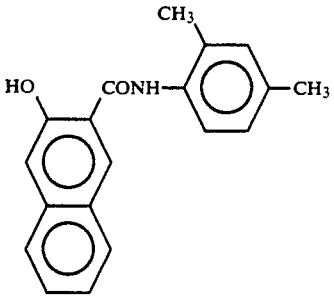
-continued
[39]
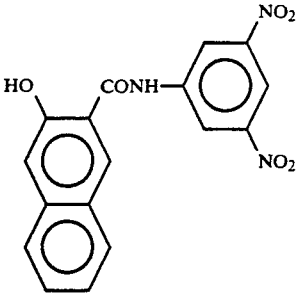
[40]
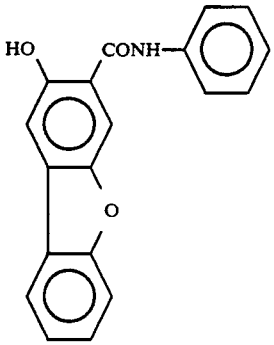
[41]
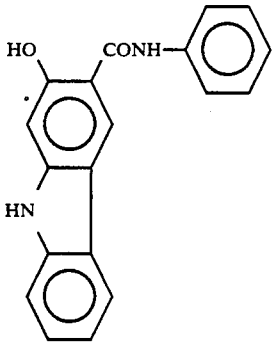
[42]
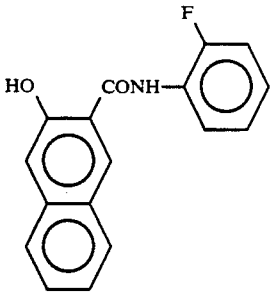
[43]
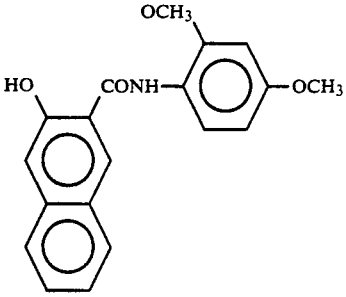

-continued

[44]

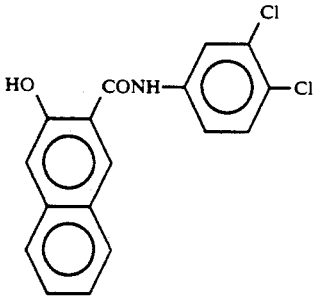

[45]

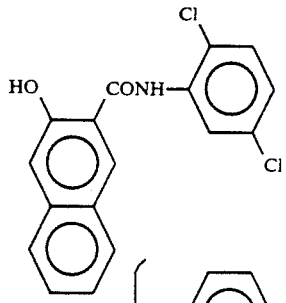

The binder resins used for forming a photosensitive layer are exemplified with no significance in resrticting the embodiments of the invention by thermoplastic resins such as saturated polyesters polyamides, acrylic resins, ethylene-vinyl acetate copolymers, ion cross-linked olefin copolymers (ionomer), styrene-butadiene block copolymers, polycarbonates, vinyl chloride-vinyl acetate copolymers, cellulose esters, polyimides and styrols; thermosetting resins such as epoxy resins, silicone resins, phenolic resins, melamine resins, alkyd resins and thermosetting acrylic resins; photocuring resins; and photoconductive resins such as poly-N-vinyl carbazole, polyvinyl pyrene, polyvinyl anthracene, polyvinylpyrrole, all named without any significance of restricting the use of them. Any of these resins can be used singly or in combination with other resins. It is desirable for any of these electrically insulative resins to have a volume resistance of $1\times10^{12}$ Ωcm or more when measured singly.

As to the binder resins, poly carbonates represented by the following general formulas [VII] and [VIII] are effective in improving durability and stability of a coating solution.

[VII]

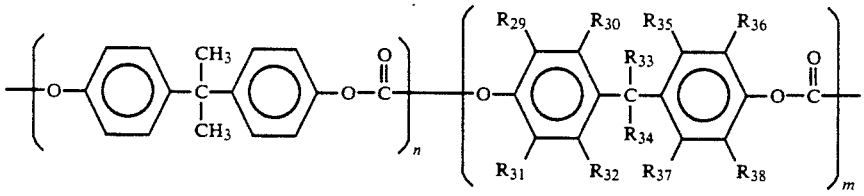

In the general formula [VII], $R_{29}$, $R_{30}$, $R_{31}$, $R_{32}$, $R_{35}$, $R_{36}$, $R_{37}$ and $R_{38}$ represent respectively a hydrogen atom, an alkyl group, an aryl group, a halogen atom. When both $R_{33}$ and $R_{34}$ are methyl groups, any of $R_{29}$, $R_{30}$, $R_{31}$, $R_{32}$, $R_{35}$, $R_{36}$, $R_{37}$ and $R_{38}$ is not a hydrogen atom; $R_{33}$ and $R_{34}$ represent respectively an alkyl group, a cycloalkyl group or an aryl group which may have a substituent. The small letter n is an integer of 0–100. The small letter m is an integer of 10–1000.

[VIII]

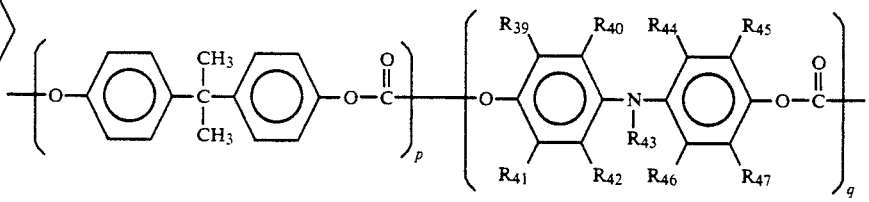

In the general formula [VIII], $R_{39}$, $R_{40}$, $R_{41}$, $R_{42}$, $R_{43}$, $R_{44}$, $R_{45}$, $R_{46}$ and $R_{47}$ represent respectively a hydrogen atom, an alkyl group, an aryl group which may have a substituent or a halogen atom. The small letter p is an integer of 0–100. The small letter q is an integer of 10–1000.

It is preferable that the polycarbonates of the formulas [VII] and [VIII] having number average molecular weight of $1\times10^4$ to $1\times10^5$, preferably $2\times10^4$ to $8\times10^4$, more preferably $4\times10^4$ to $6.5\times10^4$ are used as the binder resin from the viw points of durability and coatability. The poly carbonates of the formulas [VIII] and [VIII] may be used in combination with other binder resin. In this case, the polycarbonates of formulas [VII] and [VIII] are used at a content of 50% by weight or more on the basis of total binder weight of the layer containing the polycarbonate resin.

Concrete polycarbonates resins having the general formula [VIII ] are exemplified as shown below:

(VII-1)

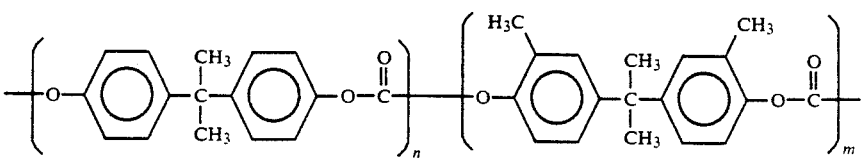

-continued
(VII-2)
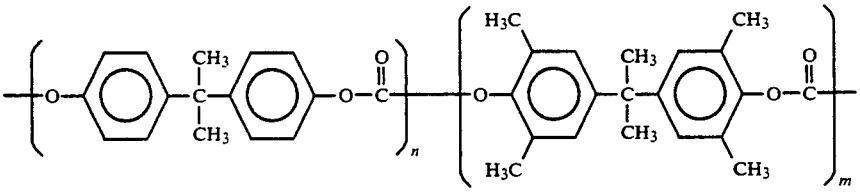
(VII-3)
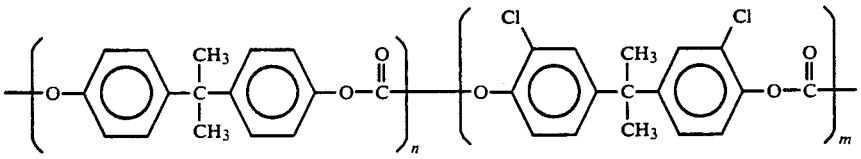
(VII-4)
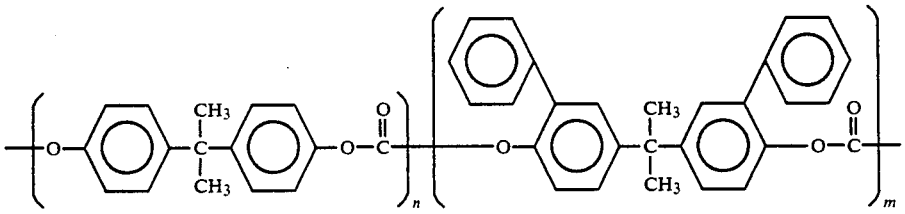
(VII-5)
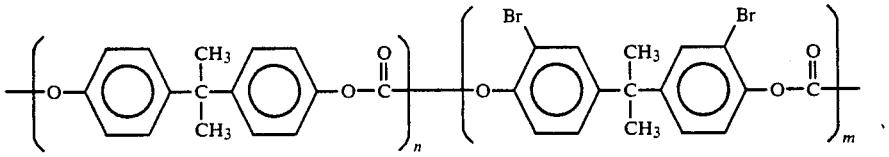
(VII-6)
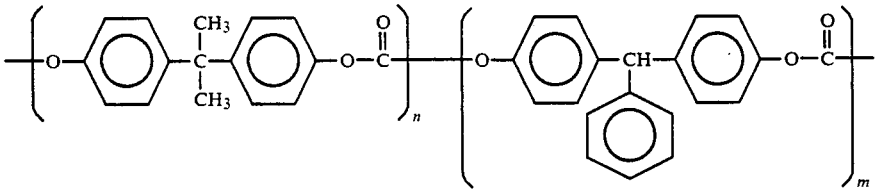
(VII-7)
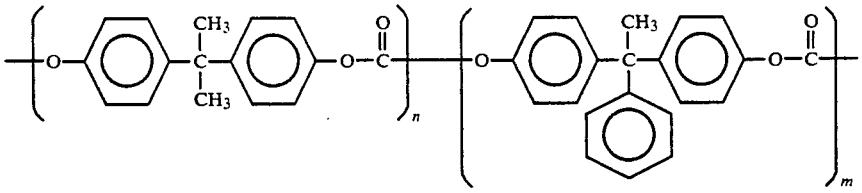
(VII-8)
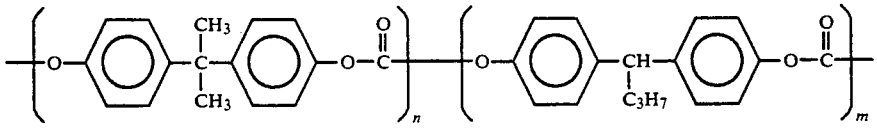
(VII-9)
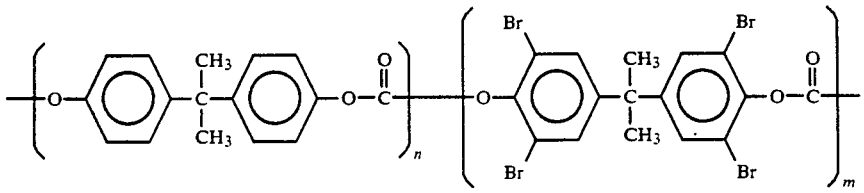

-continued
(VII-10)
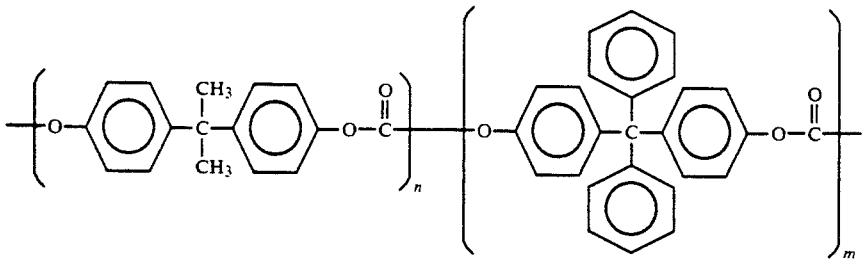
(VII-11)
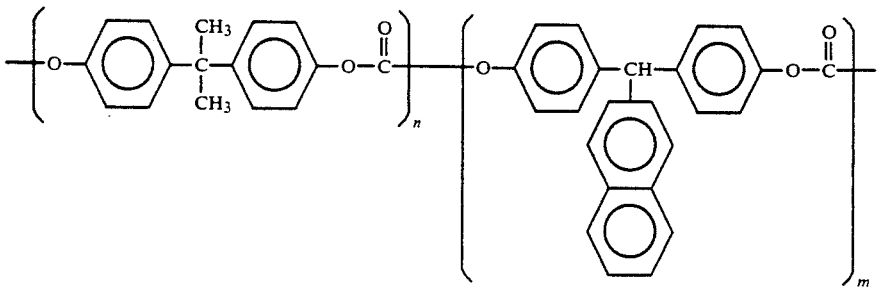
(VII-12)
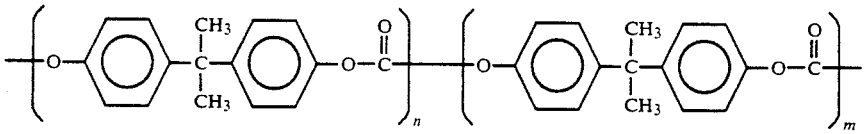
(VII-13)
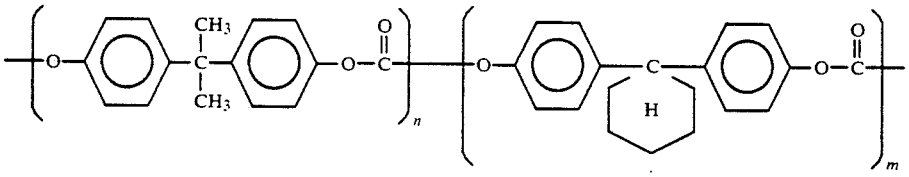
(VII-14)
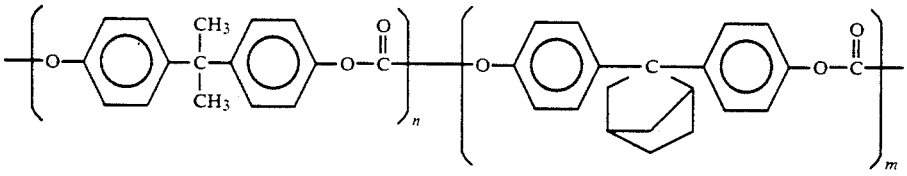
(VII-15)
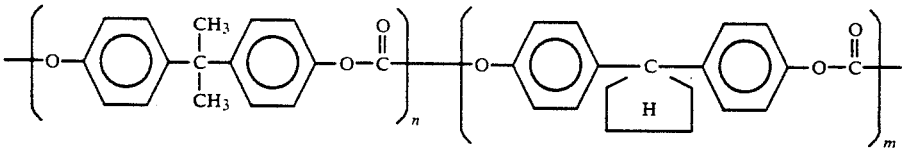
Concrete polycarbonates resins having the general formula [VIII] are exemplified as shown below:
[VIII-1]
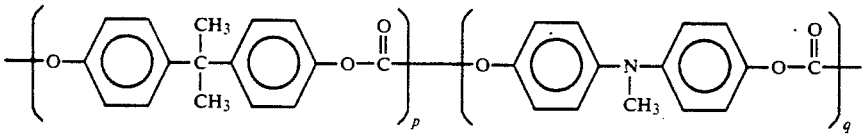
[VIII-2]
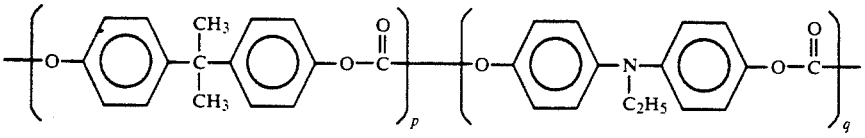

-continued
[VIII-3]
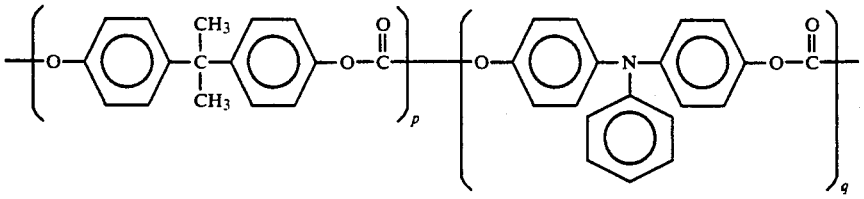
[VIII-4]
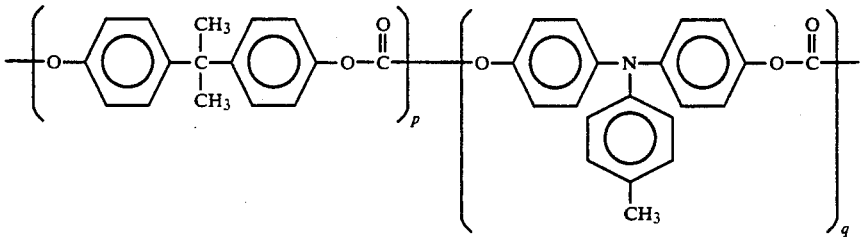
[VIII-5]
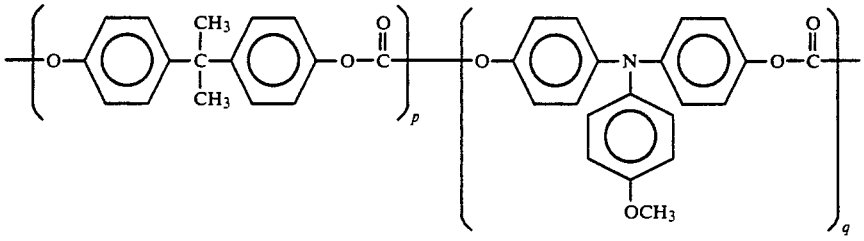
[VIII-6]
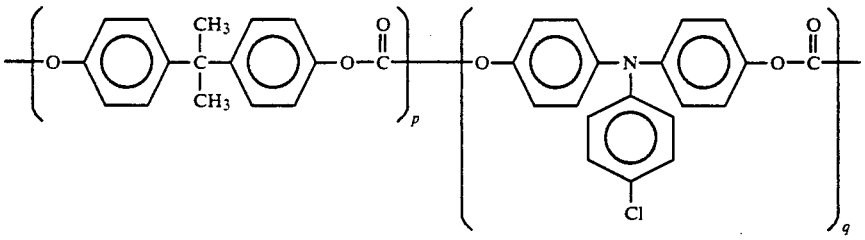
[VIII-7]
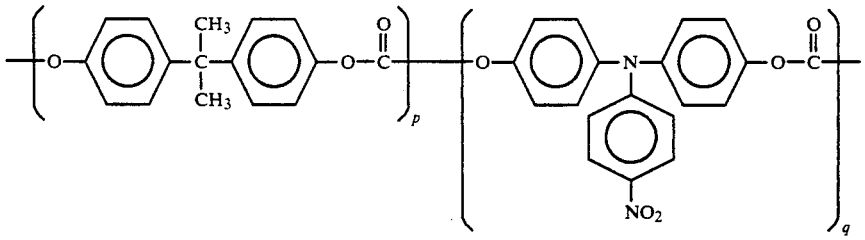
[VIII-8]
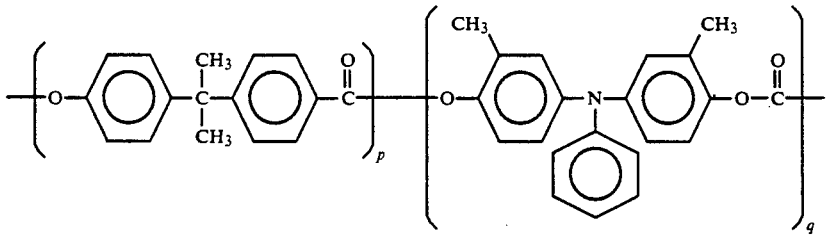
[VIII-9]
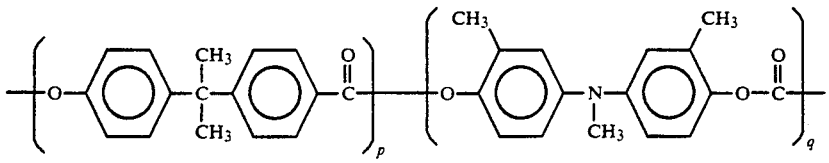

-continued

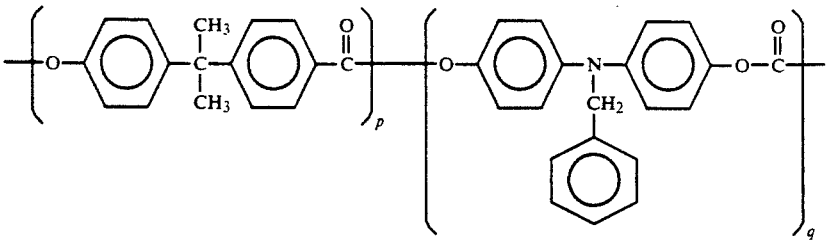

[VIII-10]

Further, a photosensitive member of the present invention may contain a hindered phenol compound represented by the following general formulas [IX]-[XI], or a hindered amine compound represented by the following general formula [XII]. These compounds work to prevent charge controlling compounds from degradation by light or oxdation, so that increase of residual potential caused by long repetition and decrease of surface potential can be prevented more effectively.

hindered phenol compound [IX]

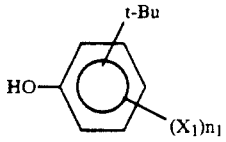

[IX]

In the general formula [IX], $X_1$ is a hydrogen atom, a hydroxy atom, an aryl group such as pheny, a heterocyclic group such as triazinylamino, a C1-C4 alkyl group, or a C1-C4 alkoxy group. The C1-C4 alkyl group may have a hydroxy group, a carbonyl group, an ester group, an amino group or a phenyl group. The letter $n_1$ is an integer of 0-4. When the letter $n_1$ is 2 or more, $X_1$ may be same or different.

hindered phenol compound [X]

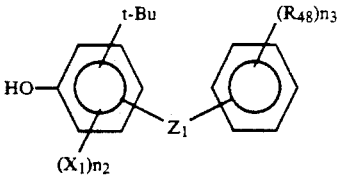

[X]

In the general formula [X], $X_1$ is the same as in the formula [IX]. The letter $n_2$ is an integer of 0-3. When the letter $n_2$ is 2 or more, $X_1$ may be same or different.

$R_{48}$ is a hydrogen atom, a hydroxy atom, a C1-C4 alkyl, an alkoxy group, a carbonyloxy group, an aralkyl such as benzyl, or a heterocyclic group such as pyrrolyl, thienyl and triazinyl.

The letter $n_3$ is an integer of 0-5. When the letter $n_3$ is 2 or more, $R_{48}$ may be same or different.

$Z_1$ represents —O—, —S—, —NH—, —$NR_{63}$—, —$CH_2$—, —$CHR_{64}$— (in which $R_{63}$ and $R_{64}$ represent respectively an alkyl group or an aryl group, each of which may have a substituent), an alkylene group, an arylene group, an aralkylene group, a bivalent residue of an alkane carboxylic acid or a bivalent residue of an alkyl ether.

hindered phenol compound [XI]

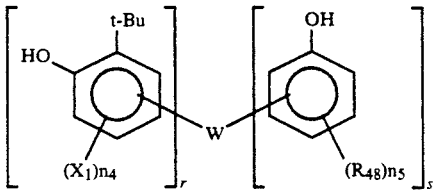

[XI]

In the general formula [XI], $X_1$ and $R_{48}$ are the same as in the formulas [IX] and [X]. The n4 is an integer of 0-3. The $n_5$ is an integer of 0-4. When $n_4$ and $n_5$ is an ineger of 2 or more respectively, $X_1$ or $R_{48}$ be same or different; W represents a bivalent residue of an alkyl carboxylate, a bivalent residue of alkyl carboxylate, a bivalent residue of alkyl ether (or thioether), a bivalent residue of aryloxy carbonyl ester, a bivalent residue of heterocyclic ether, an aralkylene group, di(alkylcarbamoylalkyl), a bivalent residue of aryl carboxylate or a bivalent residue of hydrazide of carboxylic acid.

The letters r and s are respectively an integer of 1 or more and the sum of r and s is 2-4.

hindered amine compound [XII]

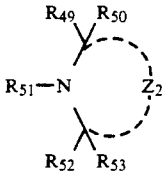

[XII]

In the general formula [XII], $R_{49}$, $R_{50}$, $R_{51}$, $R_{52}$ and $R_{53}$ represent respectively a hydrogen atom, an alkyl group or an aryl group. $Z_2$ is an atomic group necessary to form a cyclic ring containing the nitrogen atom. $R_{49}$ or $R_{50}$, and $R_{52}$ or $R_{53}$ may be included into $Z_2$ to form a double bond.

An addition amount of the hindered phenol compound represented by the general formulas [IX]-[XI] and the hindered amine compound represented by the general formula [XII] is 1-30% by weight, preferably 5-25% by weight, more preferably 10-20% by weight. If the addition amount is less than 1% by weight, an effect of addition is not given. If the addition amount is larger than 30% by weight, sensitivity becomes poor and charge transporting material is crystallized at coating time.

Concrete hindered phenol compounds represented by the general formulas [IX]-[XI] are exemplified as shown below:

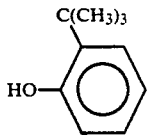
[50]
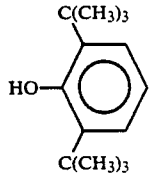
[51]
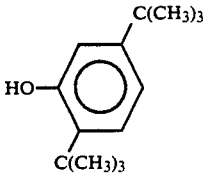
[52]
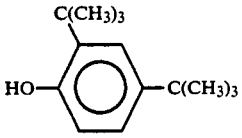
[53]
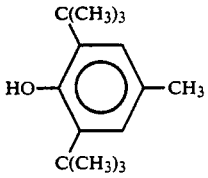
[54]
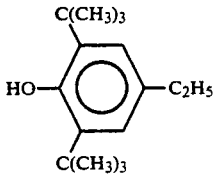
[55]
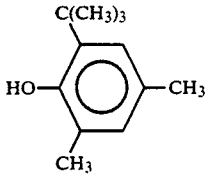
[56]
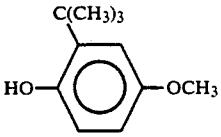
[57]
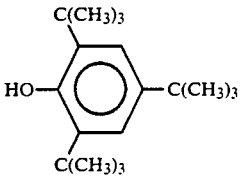
[58]
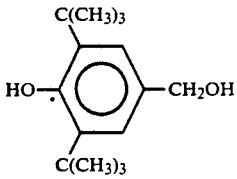
[59]
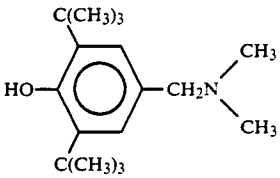
[60]
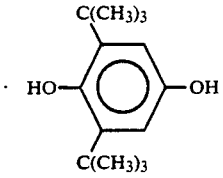
[61]
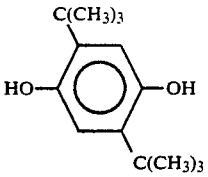
[62]
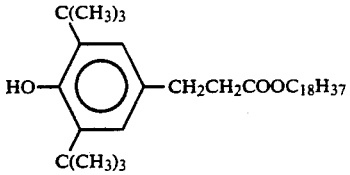
[63]
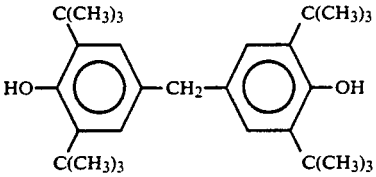
[64]
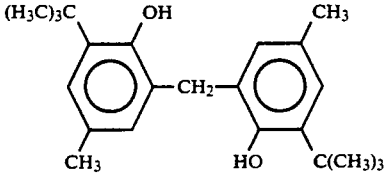
[65]
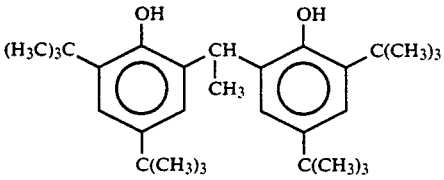
[66]
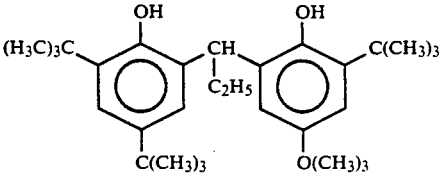
[67]

-continued
[68]
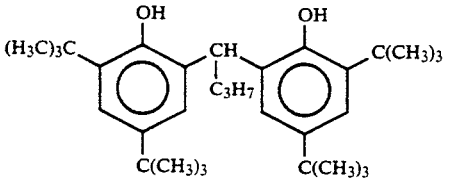
[69]
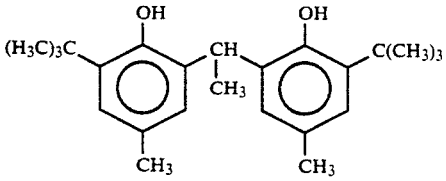
[70]
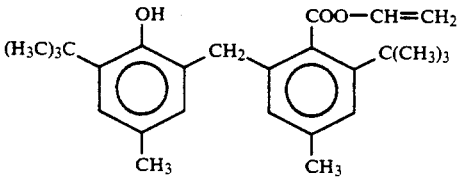
[71]
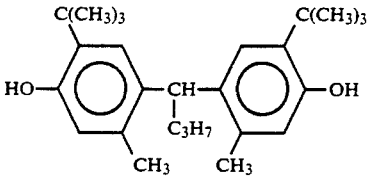
[72]
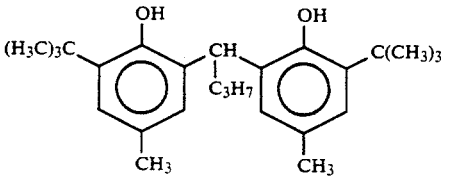
[73]
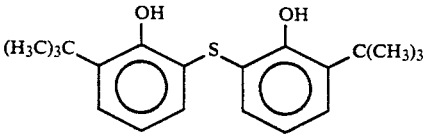
[74]
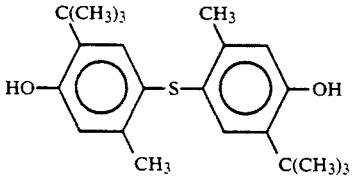
[75]
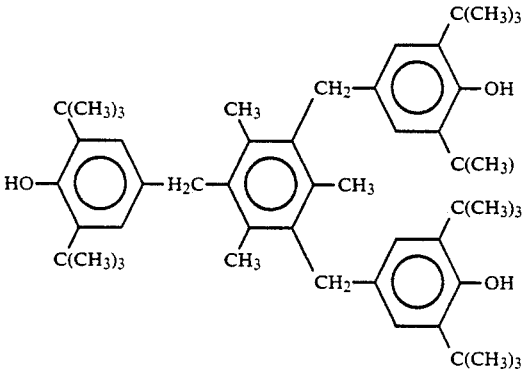
[76]
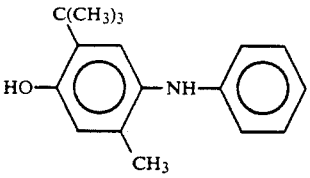
[77]
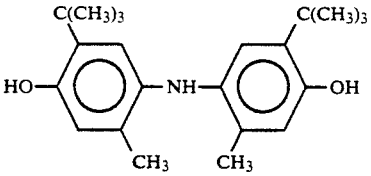
[78]
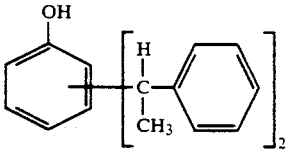
[79]
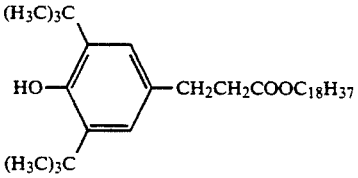
[80]
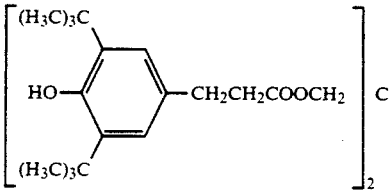
[81]
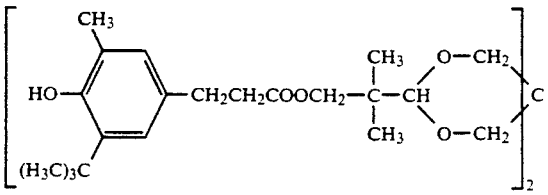

-continued
[82]
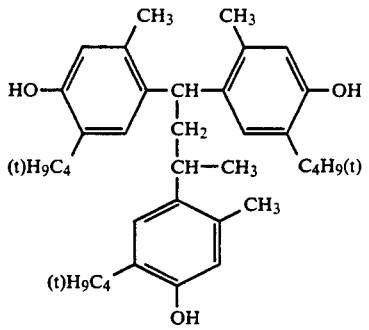
[83]
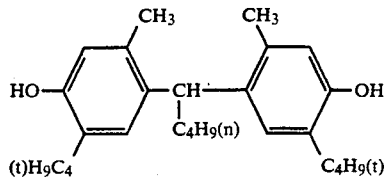
[84]
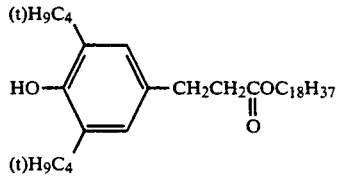
[85]
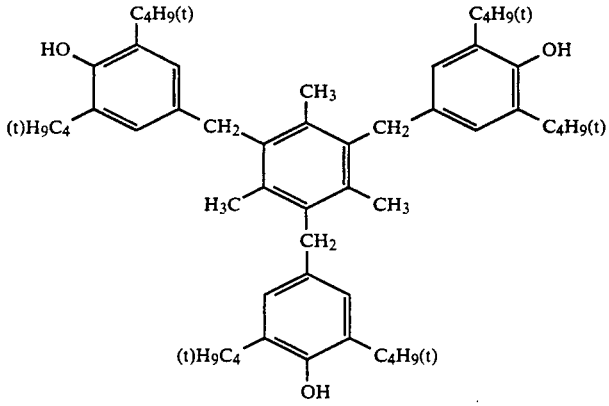
[86]
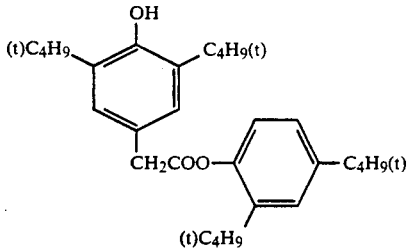
[87]
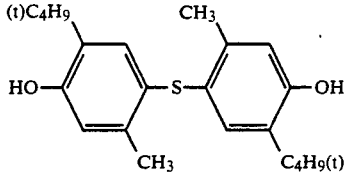
[88]
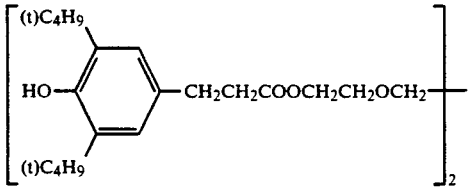
[89]
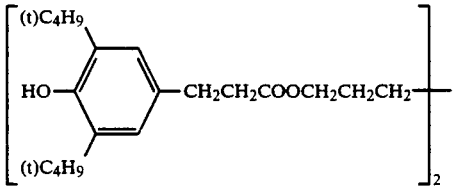
[90]
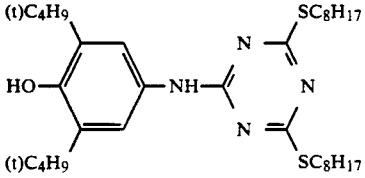
[91]
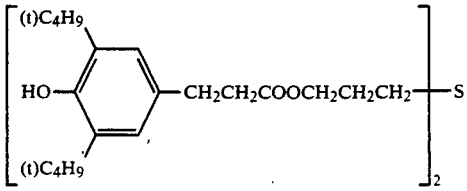

-continued
[92]
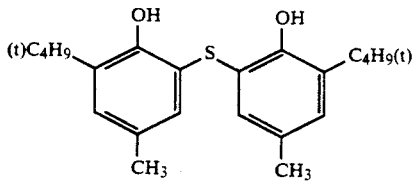
[93]
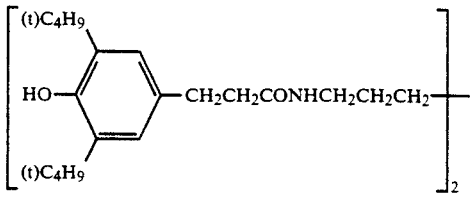
[94]
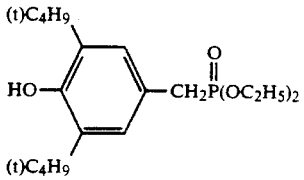
[95]
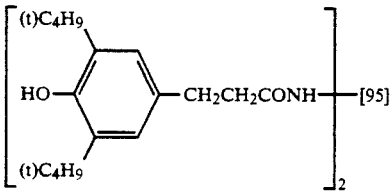
[96]
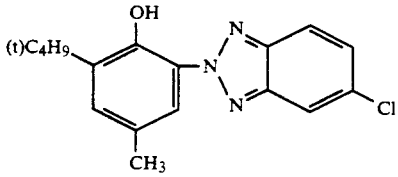
[97]
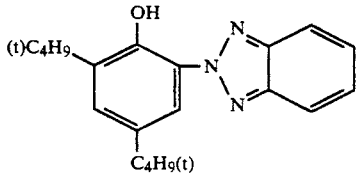
[98]
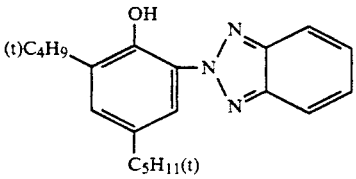
[99]
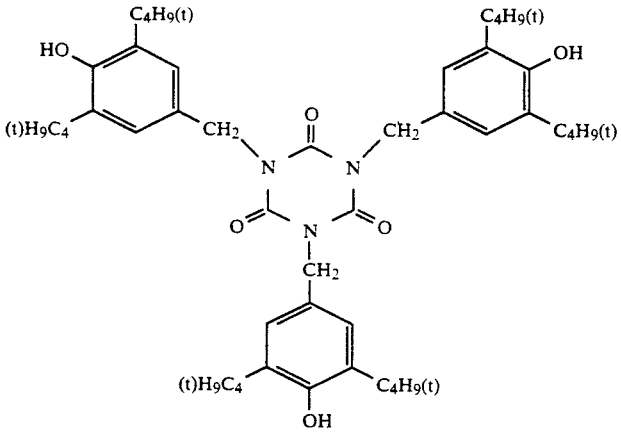
[100]
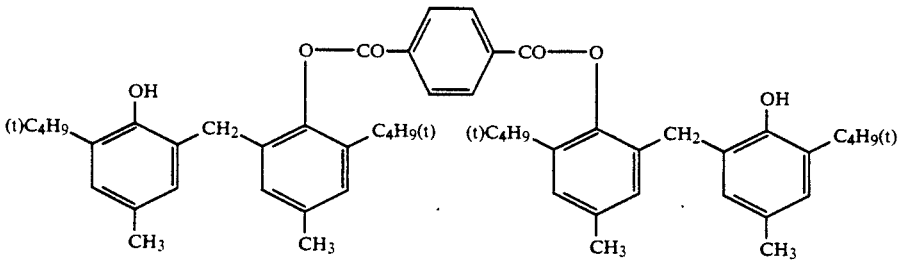
Concrete hindered amine compounds represented by the general formulas [IX]-[XI] are exemplified as shown below:
[101]
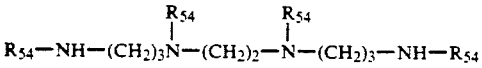

-continued
$R_{54}$: H [101-1]
[101-2]
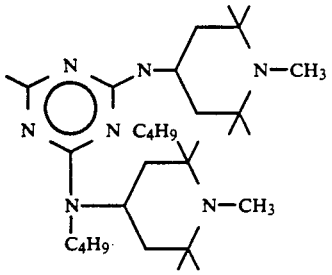
[101-3]
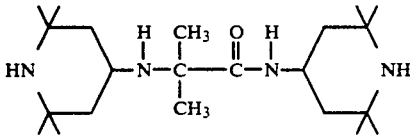
[101-4]
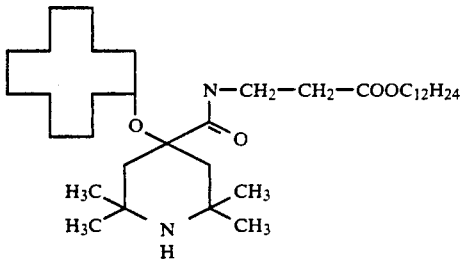
[102]
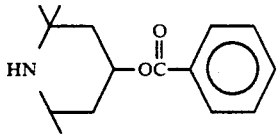
[103]
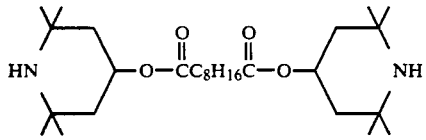
[104]
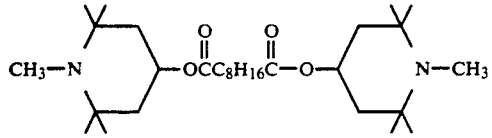
[105]
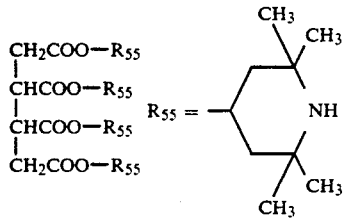

-continued
[106]
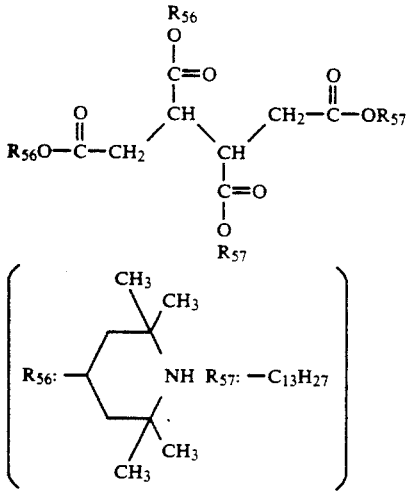
[107]
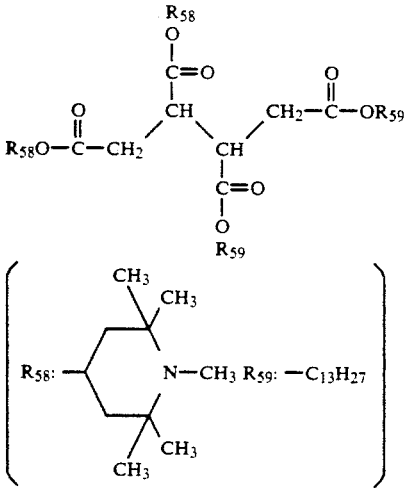
[108]
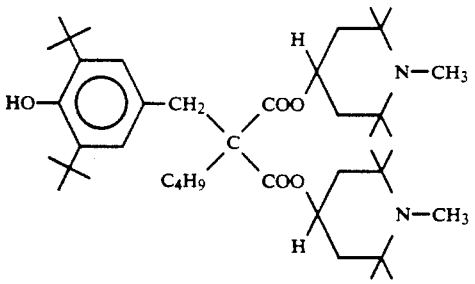
[109]
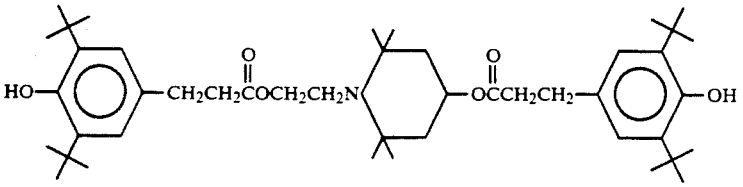

-continued
[110]
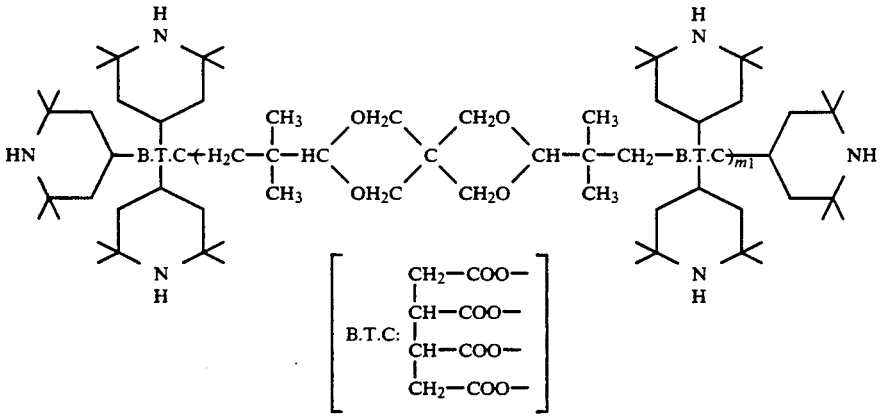
[111]
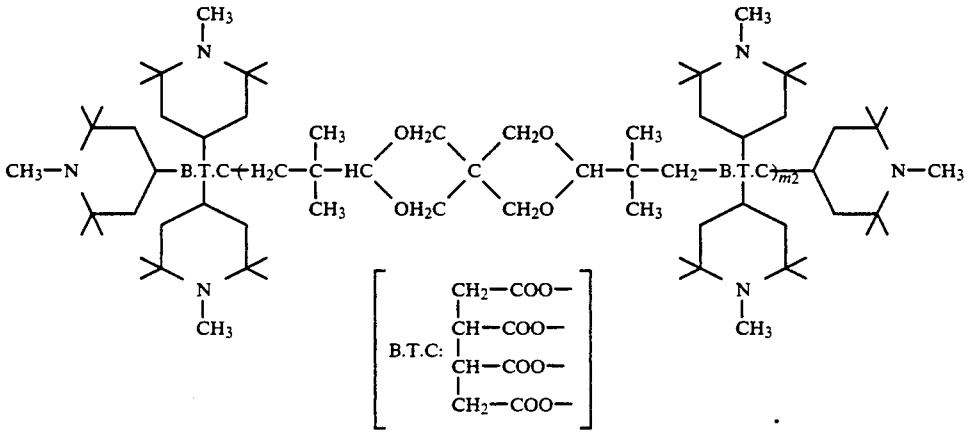
[112]
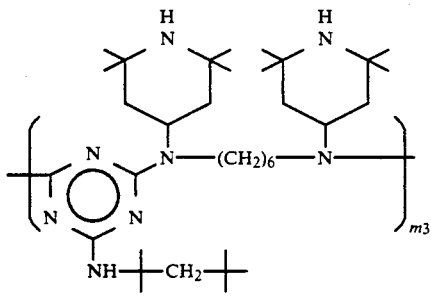
[113]
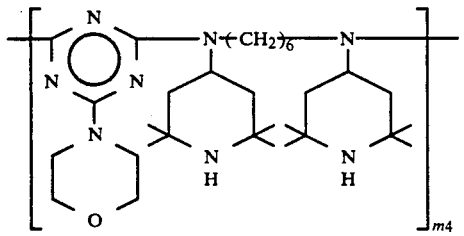
[114]
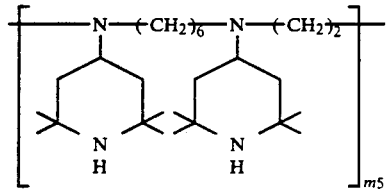

-continued

[115]

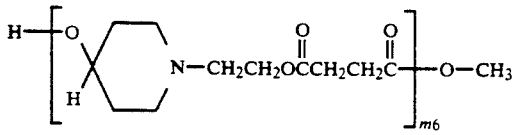

A photosensitive member of the present invention may contain a silicone oil represented by the following general formula [XIII];

$$(R_{60})_3SiO\text{-}(R_{61})_2SiO\text{-}_{n6}Si(R_{62})_3 \quad [XIII]$$

In the general formula [XIII], $R_{60}$, $R_{61}$ and $R_{62}$ represent respectively an alkyl group, an aryl group, a halogen-substituted alkyl group or a halogen-substituted aryl group. The letter $n_6$ is an integer of 1 or more.

Concrete examples of the silicone oil of formula [XIII] are dibuthyl silicone oil, phenyl methyl silicone oil, chloro phenyl silicone oil, alkyl silicone oil, fluoro silicone oil, methylstyrene-modified silicone oil, polyether-modified silicone oil, olefin-modified silicone oil, methyl hydrogen silicone oil. In particular, fluoro silicone oil containing a trifluoroalkyl group is preferable, because solvent resistance and wearing resistance are improved. It is effective that an addition amount of the silicone oil is 0.01–1% by weight, preferably 0.05–0.5% by weight on the basis of a charge transporting material. If the addition amount is less than 0.1% by weight, an effect of addition is not given. If the addition amount is larger than 1% by weight, the viscocity of a coating solution becomes so low that the coating solution may drop at coating time or the charge transporting material crystallize.

A photosensitive member of the present invention may contain an electron attracting compound represented by the following general formula [XIV];

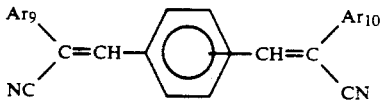

[XIV]

In the general formula [XIV] in which $Ar_9$ and $Ar_{10}$ represent respectively a cyano group, an aryl group such as phenyl and naphthyl, which may have a substituent, an alkoxycarbonyl group such as methoxycarbonyl, ethoxy carbonyl and benzyloxycarbonyl, an acyl group such as methylcarbonyl, ethylcarbonyl, propylcarbonyl and buthylcarbonyl, an aminocarbonyl group such as methylaminocarbonyl, a halogen atom such as fluorine, chlorine and bromine, an alkyl group such as methyl and ethyl, or a benzoyl group which may have a substituent. Among these compounds, the stronger the electron attraction is, the more preferable it is. From this point, a cyano group and alkoxycarbonyl group are preferable. The substituent which may be bonded to the aryl group or the benzoyl group are exemplified by a nitro group, a halogen atom such as chlorine and bromine, or a cyano groiup. A nitro group and a cyano group are preferable because of its strong electron attraction.

The addition of the electron-attracting compounds effect prevention of increase of residual potential during repetition use.

The electron-attracting compounds are used at a content of 0.01–10% by weight, preferably 0.05–5% by weight on the basis of a charge transporting material. If the content is less than 0.01% weight, the addition effect is not given. If the content is larger than 10% by weight, initial surface potential decreases. When the electron-attracting compounds are used in combination with the hindered phenol compounds or hindered amine compounds, the electron-attracting compounds are used at lower content than that of the hindered phenol compounds or the hindered amine compounds.

In order to form a photosensitive member of a monolayer type, fine particles of a charge generating material are dispersed in a resin solution or a solution containing a charge transporting material and a binder resin and then the solution is sprayed on an electrically conductive substrate followed by drying. A thickness of the photosensitive layer is 3–30 μm, preferably 5–20 μm. The sensitivity becomes poor if the charge generating material is used in an insufficient quantity, whereas the chargeability becomes poor and the mechanical strength of photosensitive layer is inadequate if used to excess. Therefore, the amount of the charge generating material is within the range of 0.01–2 parts by weight, preferably 0.2–1.2 parts by weight on the basis of one part by weight of the binder resin of the photosensitive layer.

In order to form a photosensitive member of a laminated type, a charge generating material is deposited in a vacuum on an electrically conductive substrate, a charge generating material is dissolved in a solvent such as amine-containing solvent to apply onto an electrically conductive substrate or an application solution containing a charge transporting material and, if necessary, a binder resin dissolved in an appropriate solvent is applied onto an electrically conductive substrate to be dried, for the formation of a charge generating layer on an electrically substrate. Then, a solution containing a charge transporting material and a binder resin is applied onto the charge generating layer followed by drying for the formation of a charge transporting layer. A thickness of the charge generating layer is 4 μm or less, preferably 2 μm or less. A thickness of the charge transporting layer is 3–30 μm, preferably 5–50 μm. A ratio of the charge transporting material in the charge transporting layer is 0.2–2 parts by weight, preferably 0.3–1.3 parts by weight on the basis of one part by weight of the binder resin.

A photosensitive member of the present invention permits, in combination with the binder, the use of a plasticizer such as halogenated paraffin, polybiphenyl chloride, dimethyl naphthalene, dibuthyl phthalate and o-terphenyl, the use of an electron-attracting sensitizer such as chloranyl, tetracyanoethylene, 2,4,7-trinitrofluorenone, 5,6-dicyanobenzoquinone, tetracyanoquinodimethane, tetrachlorophthalic anhydride and 3,5-dinitrobenzoic acid, or the use of a sensitizer such as methyl violet, rhodamine B, cyanine dye, pyrylium salt and thiapyrylium salt.

An electrically conductive substrate is exemplified by a sheet or a drum made of metal or alloy such as copper, aluminium, silver, iron and nickel; a substrate such as a plastic film on which the foregoing metal or alloy is adhered by a vacuum-deposition method or an electroless plating method and the like; substrate such as a plastic film and paper on which an electroconductive layer is formed by applying or depositing electroconductive polymer, indium oxide, tin oxide etc.

Figure 2:
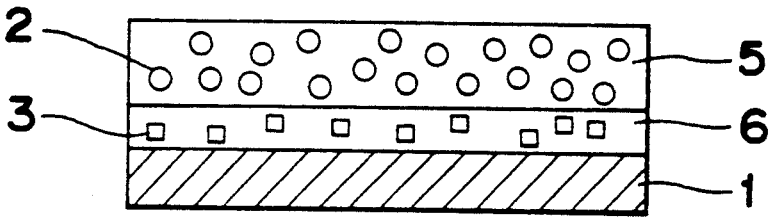
FIG. 2 is a schematic sectional view of a function-divided photosensitive member having a charge generating layer and a charge tranporting layer on an electrically conductive substrate in this order.

Concrete constitutions of a photosensitive member are shown in FIG. 1 to FIG. 2.

FIG. 1 shows a monolayer type in which a photosensitive layer (4) containing a charge generating material (3) and a charge transporting material (2) dispersed in a binder resin is formed on an electrically conductive substrate. The amino compound of the present invention is used as the charge transporting material.

FIG. 2. is a function-divided type in which a photosensitive layer is composed of a charge generating layer (6) and a charge transporting layer (5). The charge transporting layer (6) is formed on the surface of the charge generating layer (5). The amino compound of the present invention is incorporated into the charge transporting layer (5).

Figure 3:
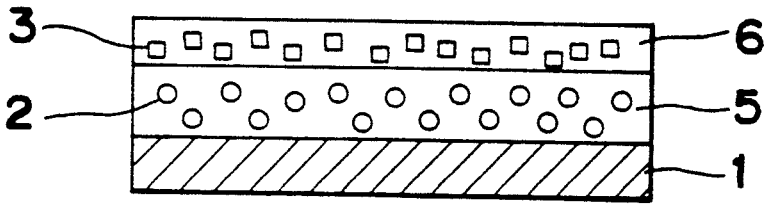
FIG. 3 is a schematic sectional view of a function-divided photosensitive member having a charge tranporting layer and a charge generating layer on an electrically conductive substrate in this order.

A photosensitive member shown in FIG. 3 is similar to that of FIG. 2 in a function divided type having a charge generating layer (6) and a charge transporting layer (5), but different in that the charge generating layer (6) is formed on the surface of the charge tranporting layer (5).

Figure 4:
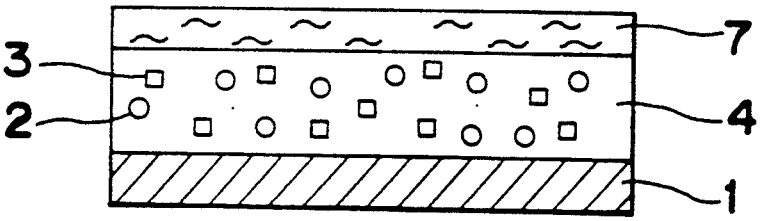
FIG. 4 is a schematic sectional view of a photosensitive member having a photosensitive layer and a surface protective layer on an electrically conductive substrate in this order.

A photosensitive member shown in FIG. 4 has further a surface protective layer (4) formed on the photosensitive member of FIG. 1. The photosensitive layer (4) may be a function divided type having a charge generating layer (6) and a charge transporting layer (5).

Figure 5:
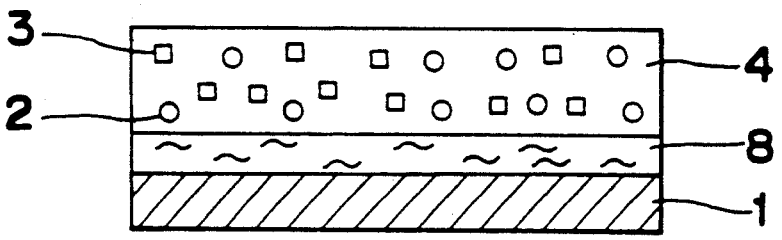
FIG. 5 is a schematic sectional view of a photosensitive member having an intermediate layer and a photosensitive layer on an electrically conductive substrate in this order.

A photosensitive member shown in FIG. 5 has an intermediate layer between a substrate (1) and a photosensitive layer (4). The intermediate layer is effective in improvement of adhesivity, improvement of coatability, protection of the substrate, improvement of chage injection from the substrate into the photososensitive layer.

Materials used for the formation of the intermediate layer is exemplified by polyimides, polyamides, nitrocelluloses, polyvinyl butyrals, polyvinyl alcohols and aluminium oxides. It is desirable that a thickness of the intermediate layer is 1 μm or less.

An amino compound of the present invention represented by the general formula [I] can be applied to a charge transporting layer of an electroluminescent device by taking advantage of its charge transporting properties. The application of the amino compound of the present invention to an electroluminescent device is explained hereinafter.

An electroluminescent device is composed of at least an organic luminous layer and a charge transporting layer between electrodes.

Figure 6:
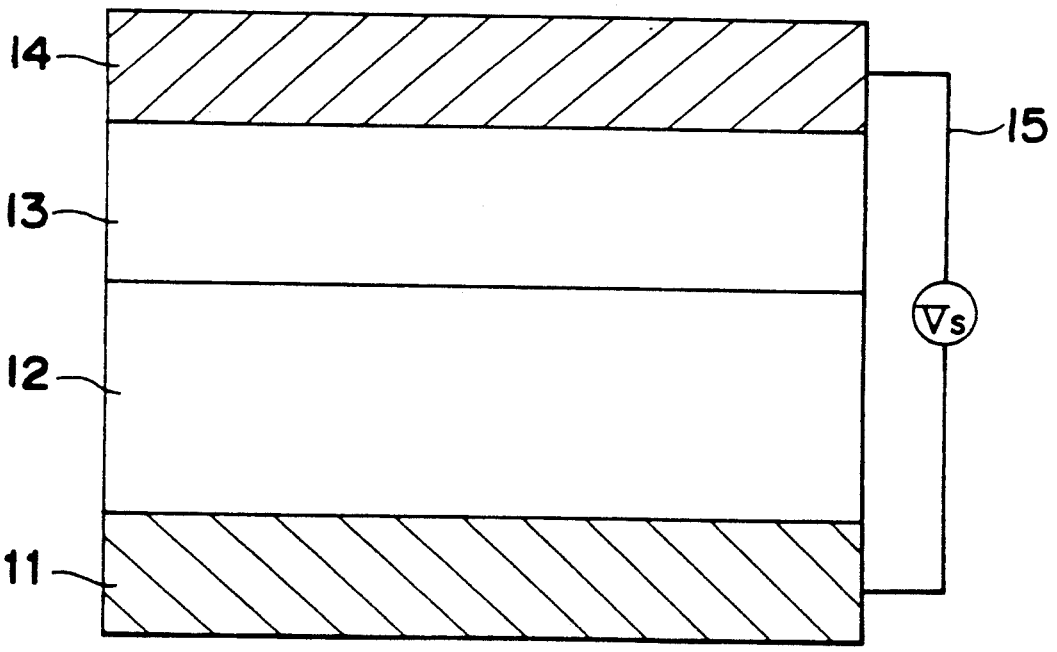
FIG. 6 is a schematic sectional view of an electroluminescence device.

A sectional schematic view of an electroluminescent device is shown in FIG. 6. In the figure, the reference number (11) is an anode, on which a charge transporting layer (12), an organic luminous layer (13) and a cathode (14) are laminated in the order. A an amino compound of the present invention represented by the general formula [I] is contained in the charge transporting layer.

A voltage is applied between the anode (11) and the cathode (14) to give luminescence.

As to an electrically conductive material used as the anode (11) of the organic electroluminescent device, the ones having work function of 4 eV or more are preferable and exemplified by carbon, aluminium, banadium, ferrite, cobalt, nickel, cupper, zinc, tungsten, silver, tin, gold, alloy thereof, tin oxide and indium oxide.

As to an electrically conductive material used as the cathode (14) of the organic electroluminescenct device, the ones having working function of 4 eV or less and exemplified by magnesium, calcium, yttrium, lithium, cadmium, ytterbium, ruthenium, manganese and an alloy thereof.

In the organic electroluminescenct device, at least one of the anode (11) or the cathode (14) is made transparent so that luminesence can be seen. A transparent electrode is formed by depositing or sputtering electroconductive materials above mentioned on a transparent substrate to give a desired tranparency. The transparent substrate is not particularly limited so far as it has an adequate strength and is not influenced adversely by heat generated in depositin process during the preparation of an electroluminescence device. Such a transparent material is exemplified by a glass substrate, transparent resin such as polyethylene, polypropylene, polyethersulfone, polyethertherketone.

A tranparent electrode avairable in the market such as ITO and NESA are known in which a tranparent electrode is formed on a glass substrate.

The charge transporting layer (12) may be formed by depositing an amino compound represented by the general formula [I] or spin-coating an adequate resin-solution of the amino compound.

When the charge transporting layer (12) is formed by a deposition method, its thickness is 0.01–0.3 μm in general. When the charge transporting layer (12) is formed by a spin-coating method, its thickness is 0.05–1.0 μm and the amino compound is incorporated at a content of 20–80% by weight on the basis of a binder resin.

Then, an organic luminous layer is formed on the charge transporting layer (12).

As to organic luminous materials incorporated in the organic luminous layer, the ones known can be used and exemplified by epitolidine, 2,5-bis[5,7-di-t-pentyl-2-benzoxazolyl]thiophene, 2,2'-(1,4-phenylenedivinylene)bisbenzothiazole, 2,2'-(4,4'-biphenylene)bisbenzothiazole, 5-methyl-2-{2-[4-(5-methyl-2-benzoxazolyl)phenyl]-vinyl}benzoxazole, 2,5-bis(5-methyl-2-benzoxazolyl)-thiophene, anthracene, naphthalene, pyrene, chrysene, perylene, perylenequinone, 1,4-diphenylbutadiene, tetraphenylbutadiene, coumarin, acridine stilbene, 2-(4-biphenyl)-6-phenylbenzoxazole, aluminium trioxine, magnecium bisoxine, zinc bis(benzo-8-qunolinol), bis(2-methyl-8-qunolinolate)aluminium oxide, indium trisoxine, aluminium tris(5-methyloxine), lithium oxine, gallium trioxine, carcium bis(5-chloroxine), polyzinc-bis(8-hydroxy-5-qunolinyl)methane), dilithium epindridione, zinc bisoxine, 1,2-phthaloperynone and 1,2-naphthaloperynone. Further, general fluorescent dyes such as fluorescent merocyanine dyes, fluorescent perylene dyes, fluorescent pyran dyes, fluorescent thiopyrane dyes, fluorescent polymethine, fluorescent merocyanine dyes and fluorescent imidazole dyes. The particulaly preferable ones are chelated oxinoides.

The organic luminous layer may be a monolayer type formed by the above mentioned luminous compounds or may be a multilayer type in order to adjust color of luminescence, strength of luminescence and the like.

Finally, a cathode is formed on the organic luminous layer obtained above, so that an organic luminescent device in which the chrage tranporting layer(12), the luminous layer (13) and the cathode (14) are laminateid on the anode(11) in the order is obtained. The luminous layer (13) and the charge transporting layer may be formed on the cathode (13) in the order.

A pair of transparent electrodes are bonded respectively to an adequate lead wire such as nichrome wire, gold wire, copper wire and platinum wire and a voltage is applied to the electrodes so that luminant light may be given.

An organic electroluminescence device can be applied to various kinds of display devices.

Specific examples are shown below. In the examples, the wording "part(s)" means "part(s) by weight" so far as it is not expalied particularly.

SYNTHETIC EXAMPLE 1

Synthetic Example of the compound [I-2]

4-iodobiphenyl-4'-p-iodobenzyl (50 g) (0.01 mole), 3-methyldiphenylamine of 44 g (0.24 mole), potassium carbonate of 35 g (0.3 mole), copper powder of 10 g (0.16 mole) and nitrobenzene of 400 g were placed in a four-necked flask of 1 liter capacity with a reflux condenser to be treated for 18 hours at 200 ° C. under nitrogen stream. After reaction, tetrahydrofuran of 200 g was added to the reaction solution and solids were filtrated. The filtrate was subjected to silica gel column chromatography. The separated products were purified by recrystallization from toluene-ethanol solvent to give white crystals having a melting point of 75°–76 ° C. The result of elemental analysis of the resultant ($C_{45}H_{38}N_2$) is shown below:

| | C(%) | H(%) | N(%) |
|---|---|---|---|
| calculated | 89.11 | 6.27 | 4.62 |
| found | 89.06 | 6.24 | 4.60 |

Figure 7:
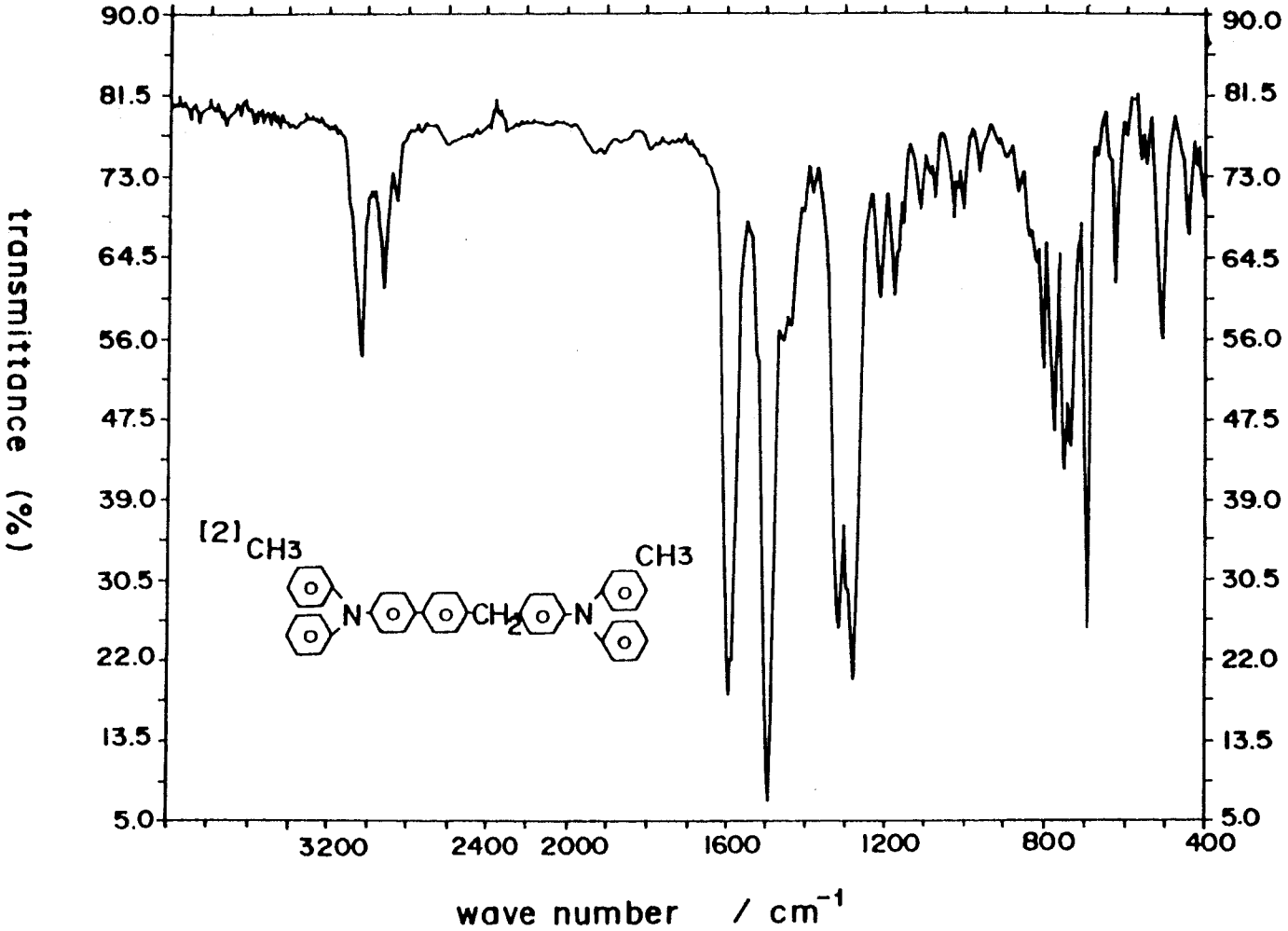
FIG. 7 is infrared absorption spectrum of one of amino compounds of the present invention.

The infrared absorption spectrum of the products is shwon in FIG. 7.

SYNTHETIC EXAMPLE 2

Synthetic Example of the compound [I-5]

The reaction was carried out in a manner similar to Synthetic Example 1 except that 4,4'-dimethyldiphenylamine of 47 g was used instead of 3-methyldiphenylamine in Synthetic Example 1. After reaction, tetrahydrofuran of 200 g was added to the reaction solution and solids were filtrated. The filtrate was subjected to silica gel column chromatography. The separated products were purified by recrystallization from toluene-ethanol solvent to give white oily crystals. The result of elemental analysis of the resultant ($C_{47}H_{42}N_2$) is shown below:

| | C(%) | H(%) | N(%) |
|---|---|---|---|
| calculated | 88.96 | 6.62 | 4.42 |
| found | 88.91 | 6.57 | 4.38 |

Figure 8:
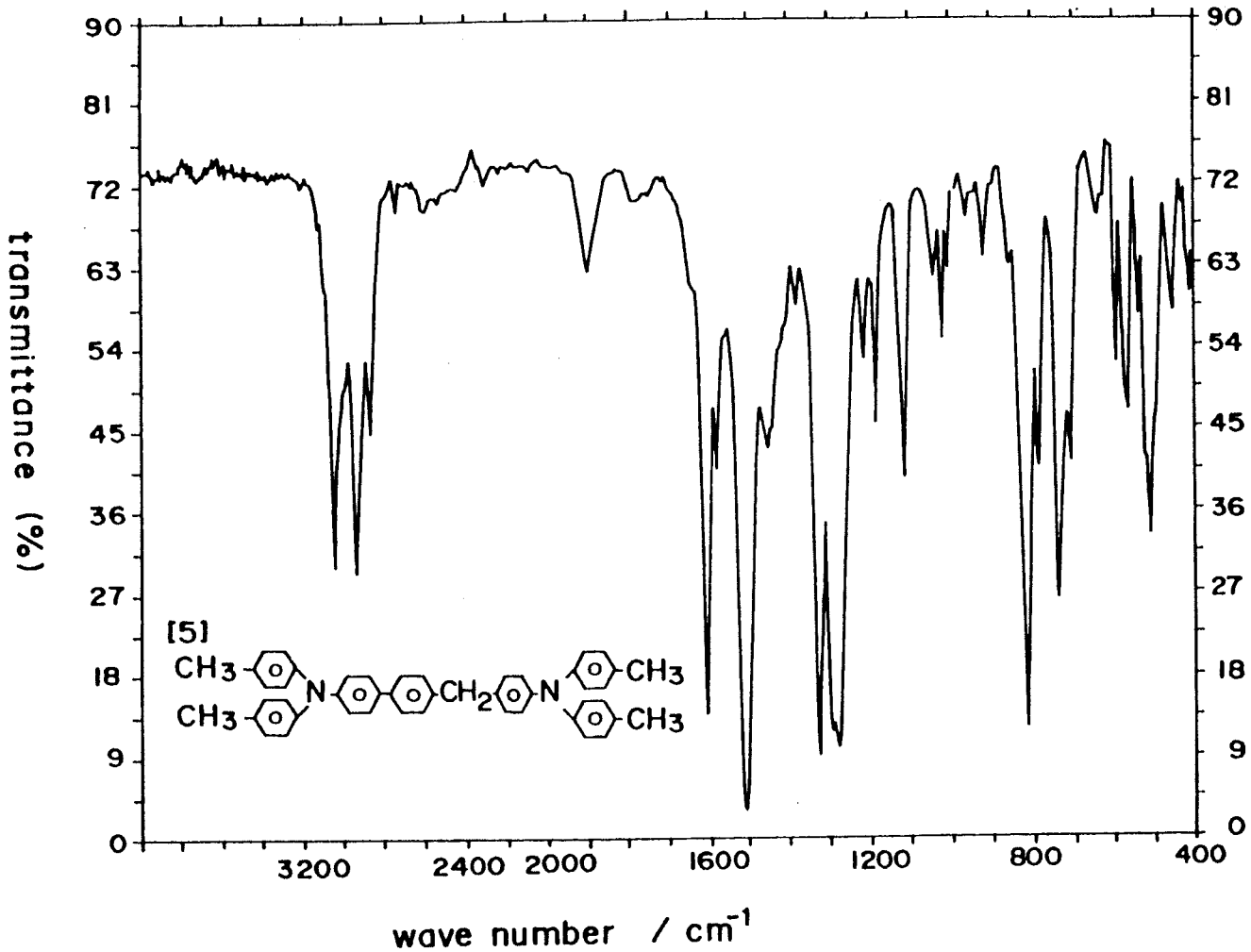
FIG. 8 is infrared absorption spectrum of one of amino compounds of the present invention.

The infrared absorption spectrum of the products is shown in FIG. 8.

SYNTHETIC EXAMPLE 3

Synthetic Example of the compound [I-43]

The reaction was carried out in a manner similar to Synthetic Example 1 except that N-p-tolyl-N-biphenylamine of 62.2 g was used instead of 3-methyldiphenylamine in Synthetic Example 1. After reaction, nitrobenzene was removed by steam distillation and toluene of 400 g was added to the reaction solution and solids were filtrated. The filtrate was subjected to silica gel column chromatography. The separated products were purified by recrystallization from isopropyl ether to give white oily crystals of 4.9 g. The melting point was 148°–149° C. The result of elemental analysis of the resultant ($C_{57}H_{46}N_2$) is shown below:

| | C(%) | H(%) | N(%) |
|---|---|---|---|
| calculated | 90.24 | 6.07 | 6.69 |
| found | 90.21 | 6.05 | 3.66 |

Figure 9:
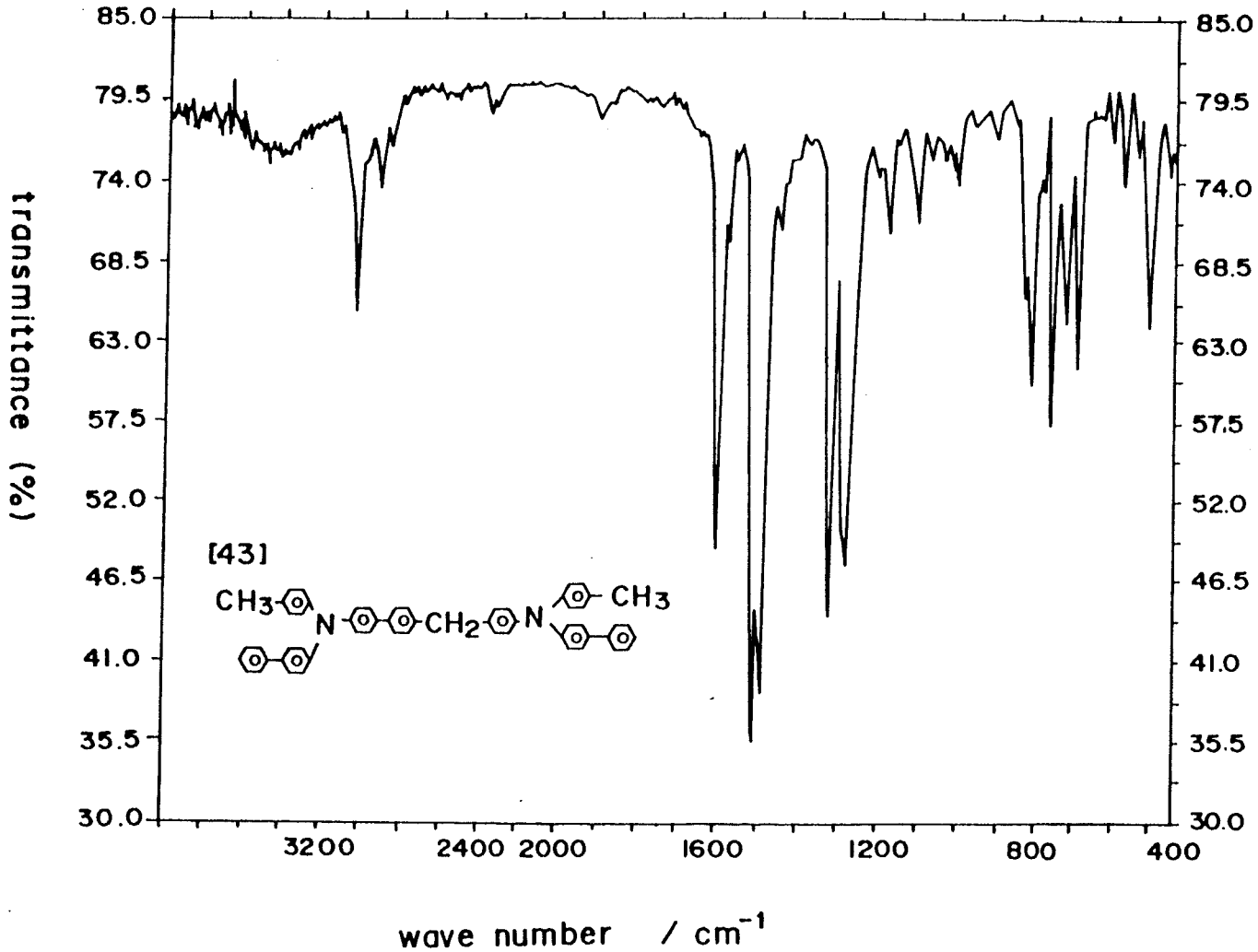
FIG. 9 is infrared absorption spectrum of one of amino compounds of the present invention.

The infrared absorption spectrum of the products is shwon in FIG. 9.

SYNTHETIC EXAMPLE 4

Synthetic Example of the compound [I-129]

Diiodo compound represented by the following formula:

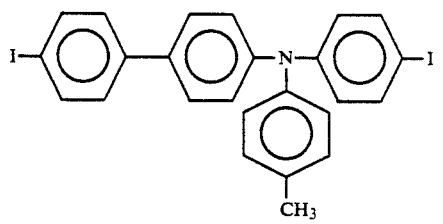

of 58.4 g (0.01 mole), 4,4'-ditolylamine of 47 g (0.24 mole), potassium carbonate of 35 g (0.3 mole), copper powder of 10 g (0.16 mole) and nitrobenzene of 400 g were placed in a four-necked flask of 1 liter capacity with a reflux condenser to be treated-for 24 hours at 200 ° C. under nitrogen stream. After reaction, nitrobenzene was removed by steam distillation and tetrahydrofuran of 300 g was added to the reaction solution and solids were filtrated. The filtrate was subjected to silica gel column chromatography. The separated products were purified by recrystallization from toluene-ethanol solvent to give white crystals of 55 g. The result of elemental analysis of the resultant ($C_{53}H_{47}N_3$) is shown below:

| | C(%) | H(%) | N(%) |
|---|---|---|---|
| calculated | 87.72 | 6.48 | 5.79 |
| found | 87.67 | 6.45 | 5.76 |

Application of Charge Transporting Material to Function-divided Photosensitive Member are shown hereinafter.

EXAMPLE 1

The bisazo compound (0.45 parts) represented by the general formula [A] below:

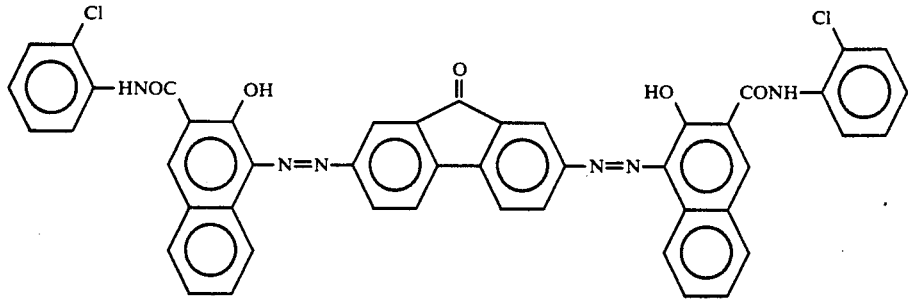

[A]

plyester resin (Vylon 200; made by Toyobo K.K.) of 0.45 parts and cyclohexanone of 50 parts were placed in Sand mill for dispersion. The dispersion solution of the bisazo compound was applied onto aluminotype-Mylar of 100 micron thickness by film applicator to form a charge generating layer so that the thickness of dried layer would be 0.3 g/m$^2$.

A solution containing the amino compound [I-1] of 50 parts and polycarbonate resin (Panlite K-1300, made by Teijin Kasei K.K.) of 50 parts dissolved in 1,4-dioxane of 400 parts was applied onto the charge generating layer to form a charge transporting layer so that the thickness of dried layer would be 16 microns. Thus, a photosensitive member with two layers was prepared.

The resultant photosensitive member was installed in an copying machine (EP-450Z; made by Minolta Camera K.K.) and corona-charged by power of −6 KV level to evaluate initial surface potential $V_0$ (V), half-reducing amount ($E_{\frac{1}{2}}$ (lux.sec)) and dark decreasing ratio of the initial surface potential ($DDR_1$). $E_{\frac{1}{2}}$ means an exposure ammount required to reduce the initial potential to half the value. $DDR_1$ is a decreasing ratio of the initial surface potential after the photosensitve member was left for 1 second in the dark.

EXAMPLES 2-4

Photosensitive members were prepared in a manner similar to Example 1 except that the amino compounds [I-2], [I-3] and [I-4] were used respectively instead of the amino compound [I-1].

$V_0$, $E_{\frac{1}{2}}$ and $DDR_1$ were evaluated on the obtained photosensitive members in a manner similar to Example 1.

EXAMPLE 5

The bisazo compound (0.45 parts) represented by the general formula [B] below:

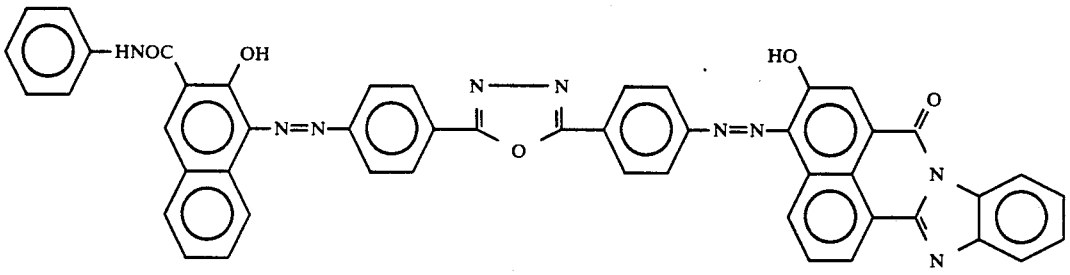

[B]

plystyrene resin (molecular weight of 40,000) of 0.45 parts and cyclohexanone of 50 parts were placed in Sand mill for dispersion.

The dispersion solution containing the bisazo compound was applied onto aluminotype-Mylar of 100 micron thickness by film applicator to form a charge generating layer so that the thickness of dried layer would be 0.3 g/m$^2$.

A solution containing the amino compound [I-5] of 50 parts and polyarylate resin (U-100; made by Yunichica K.K.) of 50 parts dissolved in 1,4-dioxane of 400 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive members in a manner similar to Example 1.

EXAMPLES 6-9

Photosensitive members were prepared in a manner similar to Example 5 except that the amino compounds [I-6], [I-7], [I-8] and [I-43] were used respectively instead of the amino compound [I-5].

$V_0$, $E_{\frac{1}{2}}$ and $DDR_1$ were evaluated on the obtained photosensitive members in a manner similar to Example 1.

EXAMPLE 10

The polycyclic quinone compound (0.45 parts) represented by the general formula [C] below:

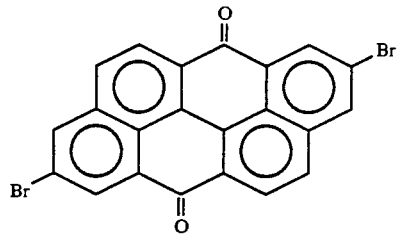

[C]

plycarbonate resin (Panlite K-1300; made by Teijin Kasei K.K.)of 0.45 parts and diclorothane of 50 parts were placed in Sand mill for dispersion. The dispersion solution of the polycyclic quinone pigments was applied onto aluminotype-Mylar of 100 micron thickness by film applicator to form a charge generating layer so that the thickness of dried layer would be 0.4 g/m$^2$.

A solution containing of the amino compound [I-9] of 60 parts and polyarylate resin (U-100; made by Yunichica K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive members in a manner similar to Example 1.

EXAMPLES 11-14

Photosensitive members were prepared in a manner similar to Example 10 except that the amino compounds [I-10], [I-11], [I-48] and [I-54] were used respectively instead of the amino compound [I-9].

$V_0$, $E_{\frac{1}{2}}$ and $DDR_1$ were evaluated on the obtained photosensitive members in a manner similar to Example 1.

EXAMPLE 15

The perylene pigments (0.45 parts) represented by the general formula [D] below:

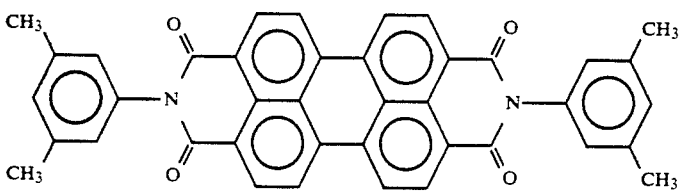

[D]

butyral resin (BX-1; made by Sekisui Kagaku Kogyo K.K.) of 0.45 parts and diclorothane of 50 parts were placed in Sand mill for dispersion.

The dispersion solution of the perylene pigment was applied onto aluminotype-Mylar of 100 micron thickness by film applicator to form a charge generating layer so that the thickness of dried layer would be 0.4 g/m$^2$.

A solution containing the amino compound [I-12] of 50 parts and polycarbonate resin (PC-Z; made by Mitsubishi Gas Kagaku K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive members in a manner similar to Example 1.

EXAMPLES 16-19

Photosensitive member were prepared in a manner similar to Example 15 except that the amino compounds [I-13], [I-14], [I-30] and [I-42] were used respectively instead of the amino compound [I-12].

$V_0$, $E_{\frac{1}{2}}$ and $DDR_1$ were evaluated on the obtained photosensitive members in a manner similar to Example 1.

EXAMPLE 20

Titanylphthalocyanine of 0.45 parts, butyral resin (BX-1; made by Sekisui Kagaku Kogyo K.K.) of 0.45 parts and diclorothane of 50 parts were placed in Sand mill for dispersion.

The dispersion solution of the phthalocyanine pigment was applied onto aluminotype-Mylar of 100 micron thickness by film applicator to form a charge generating layer so that the thickness of dried layer would be 0.3 g/m$^2$.

A solution containing the amino compound [I-15] of 50 parts and polycarbonate resin (PC-Z; made by Mitsubishi Gas Kagaku K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive members in a manner similar to Example 1.

EXAMPLES 21-24

Photosensitive members were prepared in a manner similar to Example 20 except that the amino compounds [I-16], [I-17], [I-48] and [I-58] were used respectively instead of the amino compound [I-15].

$V_0$, $E_{\frac{1}{2}}$ and $DDR_1$ were evaluated on the obtained photosensitive member in a manner similar to Example 1.

EXAMPLE 25

Copper phthalocyanine of 50 parts and tetranitro-copper phthalocyanine of 0.2 parts were dissolved in 98% conc. sulfuric acid of 500 parts with stirring. The solution was poured into water of 5000 parts to deposit a photoconductive composition of copper phthalocyanine and tetranitro-copper phthalocyanine. The obtained composition was filtered, washed and dried at 120° C. under vacuum conditions.

The photoconductive composition obtained above of 10 parts, thermosetting acrylic resin (Acrydick A405; made by Dainippon Ink K.K.) of 22.5 parts, melamine resin (Super Beckamine J820; made by Dainippon Ink K.K.) of 7.5 parts, the amino compound [I-18] of 15 parts and mixed solution of methyl ethyl ketone and xylene (1:1) of 100 parts were placed in a ball mill pot for dispersion. The mixture was dispersed for 48 hours to give a photosensitive application solution. The application solution is applied onto an aluminium substrate and dried. Thus, a photososensitive layer having thickness of 15 microns was formed.

$V_0$, $E_{\frac{1}{2}}$ and $DDR_1$ were evaluated on the obtained photosensitive member in a manner similar to Example 1 exept that the photosensitive member was corona-charged by power of +600 V level.

EXAMPLES 26-30

Photosensitive members were prepared in a manner similar to Example 25 except that the amino compounds [I-21], [I-23], [I-26], [I-42 ] and [I-45 ] were respectively used instead of the amino compound [I-18].

$V_0$, $E_{\frac{1}{2}}$ and $DDR_1$ were evaluated on the obtained photosensitive members in a manner similar to Example 1.

COMPARATIVE EXAMPLES 1-4

Photosensitive members were prepared in a manner similar to Example 25 except that the compounds represented by the-formulas [E], [F], [G] and [H] were respectively used instead of the amino compound [I-18].

$V_0$, $E_{\frac{1}{2}}$ and $DDR_1$ were evaluated on the obtained photosensitive members in a manner similar to Example 1.

[E]

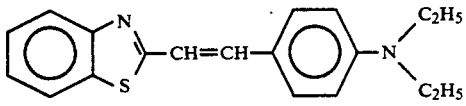

[F]

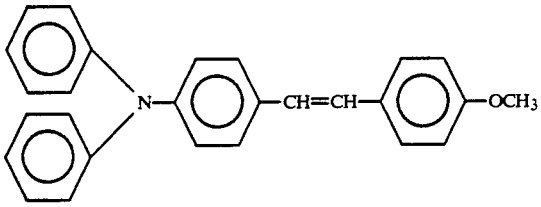

[G]

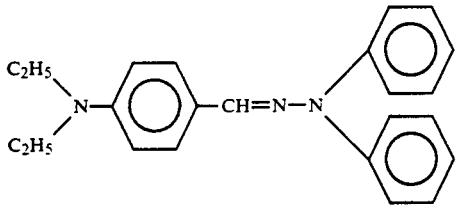

[H]

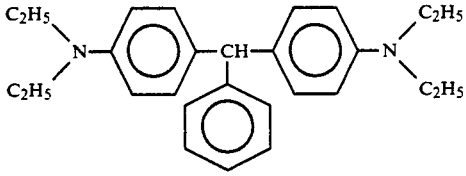

COMPARATIVE EXAMPLES 5-7

Photosensitive members were prepared in a manner similar to Example 25 except that the compounds represented by the following formulas [I], [J] and [K] were respectively used instead of the amino compound [I-18].

$V_0$, $E_{\frac{1}{2}}$ and $DDR_1$ were evaluated on the obtained photosensitive members in a manner similar to Example 1.

[I]

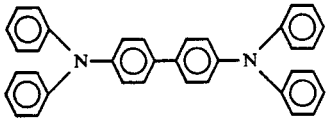

[J]

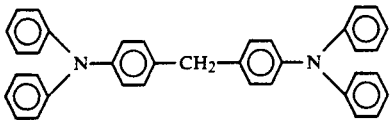

-continued

[K]

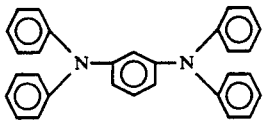

The results of $V_0$, $E_{\frac{1}{2}}$ and $DDR_1$ with respect to the photosensitive members obtained Examples 1-30 and Comparative Examples 1-7 were summarized in Table 1 below.

TABLE 1

| | $V_0$(V) | $E_{\frac{1}{2}}$ (lux. sec) | $DDR_1$(%) |
|---|---|---|---|
| Example 1 | −650 | 1.3 | 3.3 |
| Example 2 | −660 | 1.5 | 2.8 |
| Example 3 | −650 | 1.1 | 3.5 |
| Example 4 | −650 | 1.0 | 3.2 |
| Example 5 | −660 | 1.8 | 2.7 |
| Example 6 | −650 | 1.4 | 3.2 |
| Example 7 | −660 | 1.7 | 3.0 |
| Example 8 | −660 | 1.6 | 2.8 |
| Example 9 | −650 | 0.7 | 3.2 |
| Example 10 | −660 | 1.4 | 2.9 |
| Example 11 | −670 | 1.5 | 2.5 |
| Example 12 | −650 | 1.0 | 3.3 |
| Example 13 | −650 | 0.9 | 3.4 |
| Example 14 | −660 | 0.8 | 3.0 |
| Example 15 | −660 | 1.3 | 2.9 |
| Example 16 | −660 | 1.7 | 3.1 |
| Example 17 | −650 | 1.3 | 3.5 |
| Example 18 | −660 | 0.9 | 2.9 |
| Example 19 | −650 | 0.8 | 3.1 |
| Example 20 | −660 | 1.2 | 3.0 |
| Example 21 | −660 | 1.0 | 2.8 |
| Example 22 | −650 | 1.3 | 3.2 |
| Example 23 | −660 | 0.7 | 2.9 |
| Example 24 | −660 | 0.9 | 2.8 |
| Example 25 | +620 | 1.4 | 13.3 |
| Example 26 | +630 | 1.5 | 12.5 |
| Example 27 | +620 | 1.2 | 13.0 |
| Example 28 | +620 | 1.0 | 13.6 |
| Example 29 | +630 | 0.7 | 12.3 |
| Example 30 | +620 | 0.6 | 13.1 |
| Comp. Example 1 | +620 | 15.0 | 12.0 |
| Comp. Example 2 | +600 | 6.5 | 13.7 |
| Comp. Example 3 | +600 | 3.2 | 14.3 |
| Comp. Example 4 | +620 | 13.5 | 10.4 |
| Comp. Example 5 | +620 | 3.0 | 11.6 |
| Comp. Example 6 | +630 | 5.4 | 10.2 |
| Comp. Example 7 | +620 | 4.7 | 12.5 |

It is understood from Table 1 that the photosensitive members of the present invention, even though they are laminated types or monolayer-types, have sufficient charge keeping ability, low dark decreasing ratio such that the photosensitive members can be taken into pratical use and excellent sensitivity.

Further, the photosensitive member of Example 25 was installed into a copying machine (EP-350Z; made by Minolta Camera K.K.) to be subjected to repetition test. Even after 1000 times of copy, clear copied images exellent in gradation were formed both at initial stage and final stage of the test and the sensitivity was stable. Accordingly, the photosensitive members of the present invention were also excellent in repetion properties.

EXAMPLES 31-34

Photosensitive members were prepared in a manner similar to Example 1 except that the dispersions containing 70 parts of the dimino compounds [I-62] (Example 31), [I-65] (Example 32), [I-66] (Example 33) and [I-67] (Example 34) and 70 parts of polycarbonate resin dissolved in 1,4-dioxane of 400 parts were used respectively to form a charge transporting layer.

$V_0$, $E_{\frac{1}{2}}$ and $DDR_1$ were evaluated on the obtained photosensitive members in a manner similar to Example 1.

EXAMPLES 35-38

Photosensitive members were prepared in a manner similar to Example 5 except that the dispersion containing 70 parts of the dimino compounds [I-70] (Example 35), [I-71] (Example 36), [I-73] (Example 37) and [I-76] (Example 38) and 70 parts of polyarlate resin dissolved in 1,4-dioxane of 400 parts were used respectively to form a charge transporting layer of 16 micron thickness.

$V_0$, $E_{\frac{1}{2}}$ and $DDR_1$ were evaluated on the obtained photosensitive members in a manner similar to Example 1.

EXAMPLES 39-41

Photosensitive members were prepared in a manner similar to Example 10 except that the amino compounds [I-77], [I-78] and [I-85] were used respectively instead of the amino compound [I-9].

$V_0$, $E_{\frac{1}{2}}$ and $DDR_1$ were evaluated on the obtained photosensitive members in a manner similar to Example 1.

EXAMPLES 42-44

Photosensitive members were prepared in a manner similar to Example 15 except that the amino compounds [I-86], [I-88] and [I-89] were used resectively instead of the amino compound [I-12].

$V_0$, $E_{\frac{1}{2}}$ and $DDR_1$ were evaluated on the obtained photosensitive members in a manner similar to Example 1.

EXAMPLES 45-47

Photosensitive members were prepared in a manner similar to Example 20 except that the amino compounds [I-91], [I-96] and [I-97] were used resectively instead of the amino compound [I-15].

$V_0$, $E_{\frac{1}{2}}$ and $DDR_1$ were evaluated on the obtained photosensitive members in a manner similar to Example 1.

EXAMPLES 48-51

Photosensitive members were prepared in a manner similar to Example 25 except that the amino compounds [I-98], [I-102], [I-104] and [I-108] were used resectively instead of the amino compound [I-18].

$V_0$, $E_{\frac{1}{2}}$ and $DDR_1$ were evaluated on the obtained photosensitive members in a manner similar to Example 25.

COMPARATIVE EXAMPLE 8

Photosensitive member was prepared in a manner similar to Example 48 except that the amino compound represented by the following formula [L] was used instead of the amino compound [I-98].

[L]

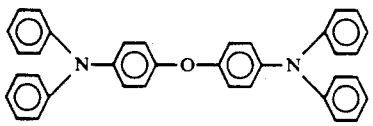

$V_0$, $E_{\frac{1}{2}}$ and $DDR_1$ were evaluated on the obtained photosensitive members in a manner similar to Example 48.

The results of $V_0$, $E_{\frac{1}{2}}$ and $DDR_1$ with respect to the photosensitive members obtained Examples 31-51 and Comparative Example 8 were summarized in Table 2 below.

TABLE 2

| | $V_0$(V) | $E_{\frac{1}{2}}$ (lux. sec) | $DDR_1$(%) |
|---|---|---|---|
| Example 31 | −650 | 1.3 | 3.2 |
| Example 32 | −660 | 1.0 | 2.8 |
| Example 33 | −650 | 1.2 | 3.0 |
| Example 34 | −650 | 1.3 | 3.5 |
| Example 35 | −660 | 1.5 | 3.1 |
| Example 36 | −660 | 1.3 | 2.9 |
| Example 37 | −650 | 1.0 | 3.3 |
| Example 38 | −670 | 1.5 | 2.5 |
| Example 39 | −660 | 1.4 | 2.8 |
| Example 40 | −660 | 1.6 | 2.9 |
| Example 41 | −660 | 1.5 | 2.8 |
| Example 42 | −650 | 1.8 | 3.2 |
| Example 43 | −660 | 1.4 | 2.7 |
| Example 44 | −650 | 1.3 | 3.2 |
| Example 45 | −650 | 1.5 | 3.5 |
| Example 46 | −660 | 1.0 | 2.8 |
| Example 47 | −660 | 1.2 | 3.0 |
| Example 48 | +630 | 1.5 | 12.6 |
| Example 49 | +630 | 1.3 | 12.8 |
| Example 50 | +620 | 1.4 | 13.2 |
| Example 51 | +620 | 1.1 | 13.5 |
| Comp. Example 8 | +630 | 5.9 | 10.1 |

It is understood from Table 2 that the photosensitive members of the present invention, even though they are laminated types or monolayer-types, have sufficient charge keeping ability, low dark decreasing ratio such that the photosensitive members can be taken into pratical use and excellent sensitivity.

Further, the photosensitive member of Example 48 was installed into a copying machine (EP-350Z; made by Minolta Camera K.K.) to be subjected to repetition test. Even after 1000 times of copy, clear copied images exellent in gradation were formed both at initial stage and final stage of the test and the sensitivity was stable. Accordingly, the photosensitive members of the present invention were also excellent in repetion properties.

EXAMPLES 52-55

Photosensitive members were prepared in a manner similar to Example 31 except that the amino compounds [I-112], [I-113], [I-115] and [I-116] were used respectively instead of the amino compound [I-62].

$V_0$, $E_{\frac{1}{2}}$ and $DDR_1$ were evaluated on the obtained photosensitive members in a manner similar to Example 1.

EXAMPLES 56-59

Photosensitive members were prepared in a manner similar to Example 35 except that the amino compounds [I-117], [I-118], [I-119] and [I-122] were used respectively instead of the amino compound [I-70].

$V_0$, $E_{\frac{1}{2}}$ and $DDR_1$ were evaluated on the obtained photosensitive members in a manner similar to Example 1.

EXAMPLES 60-62

Photosensitive members were prepared in a manner similar to Example 10 except that the amino compounds [I-124], [I-125] and [I-126] were used respectively instead of the amino compound [I-9].

$V_0$, $E_{\frac{1}{2}}$ and $DDR_1$ were evaluated on the obtained photosensitive members in a manner similar to Example 1.

EXAMPLES 63–65

Photosensitive members were prepared in a manner similar to Example 15 except that the perylene pigment represented by the following formula [M] instead of the perylene compound used in Example 15 and that the amino compounds [I-127], [I-128] and [I-129] were used resectively instead of the amino compound [I-12].

$V_0$, $E_{\frac{1}{2}}$ and $DDR_1$ were evaluated on the obtained photosensitive members in a manner similar to Example 1.

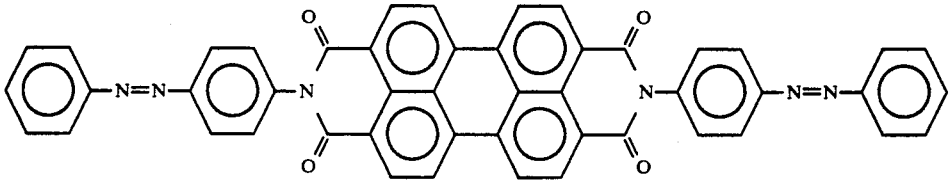

[M]

EXAMPLES 66–68

Photosensitive members were prepared in a manner similar to Example 20 except that the amino compounds [I-130], [I-133] and [I-135] were used resectively instead of the amino compound [I-15].

$V_0$, $E_{\frac{1}{2}}$ and $DDR_1$ were evaluated on the obtained photosensitive members in a manner similar to Example 1.

EXAMPLES 69–72

Photosensitive members were prepared in a manner similar to Example 25 except that the amino compounds [I-140], [I-143], [I-144] and [I-147] were used resectively instead of the amino compound [I-18].

$V_0$, $E_{\frac{1}{2}}$ and $DDR_1$ were evaluated on the obtained photosensitive members in a manner similar to Example 25.

COMPARATIVE EXAMPLES 9 AND 10

Photosensitive members were were prepared in a manner similar to Example 69 except that the amino compounds represented by the following formulas [N] and [O] were used instead of the amino compound [I-140].

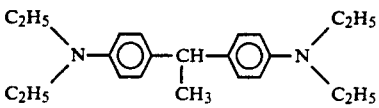

[N]

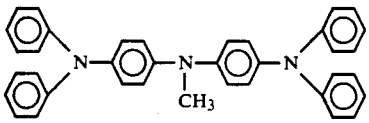

[O]

$V_0$, $E_{\frac{1}{2}}$ and $DDR_1$ were evaluated on the obtained photosensitive members in a manner similar to Example 69.

The results of $V_0$, $E_{\frac{1}{2}}$ and $DDR_1$ with respect to the photosensitive members obtained Examples 52–72 and Comparative Examples 9 and 10 were summarized in Table 3 below.

TABLE 3

| | $V_0$(V) | $E_{\frac{1}{2}}$ (lux. sec) | $DDR_1$(%) |
|---|---|---|---|
| Example 52 | −650 | 1.2 | 3.3 |
| Example 53 | −650 | 1.3 | 3.0 |
| Example 54 | −640 | 1.5 | 3.7 |
| Example 55 | −640 | 1.0 | 4.2 |
| Example 56 | −650 | 1.2 | 3.5 |
| Example 57 | −650 | 1.8 | 2.6 |
| Example 58 | −660 | 1.4 | 2.2 |
| Example 59 | −650 | 1.6 | 3.0 |
| Example 60 | −640 | 1.7 | 3.2 |
| Example 61 | −650 | 1.5 | 2.8 |
| Example 62 | −650 | 1.8 | 3.0 |
| Example 63 | −640 | 1.6 | 3.7 |
| Example 64 | −660 | 1.7 | 2.0 |
| Example 65 | −650 | 1.7 | 3.4 |
| Example 66 | −650 | 1.0 | 2.1 |
| Example 67 | −650 | 0.9 | 4.5 |
| Example 68 | −640 | 1.0 | 5.2 |
| Example 69 | +620 | 1.4 | 13.3 |
| Example 70 | +630 | 1.5 | 12.5 |
| Example 71 | +620 | 1.2 | 13.0 |
| Example 72 | +620 | 1.0 | 13.6 |
| Comp. Example 9 | +610 | 5.4 | 12.2 |
| Comp. Example 10 | +630 | 4.9 | 12.9 |

It is understood from Table 3 that the photosensitive members of the present invention, even though they are laminated types or monolayer-types, have sufficient charge keeping ability, low dark decreasing ratio such that the photosensitive members can be taken into pratical use and excellent sensitivity.

Further, the photosensitive member of Example 69 was installed into a copying machine (EP-350Z; made by Minolta Camera K.K.) to be subjected to repetition test. Even after 1,000 times of copy, clear copied images exellent in gradation were formed both at initial stage and final stage of the test and the sensitivity was stable. Accordingly, the photosensitive members of the present invention were also excellent in repetion properties.

EXAMPLE 73

Metal-free phthalocyanine of tau-type (1 part), polyvinylbutyral resin (S-Lec BM-2; made by Sekisui Kagaku Kogyo K.K.) of 1 part and cyclohexanone of 100 parts were placed in Ball mill pot to be dispersed for 24 hours. Thus, a photosensitive coating solution was obtained.

The coating solution was applied onto an aluminium substrate to form a charge generating layer so that the thickness of dried layer would be 0.3 microns.

A solution containing the distyryl compound [V-3] of 8 parts, the amino compound [I-43] of 2 parts and polycarbonate resin (Panlite K-1300; made by Teijin Kasei K.K.) of 10 parts dissolved in tetrahydrofuran of 180 parts was applied onto the charge generating layer to form a charge transporting layer so that the thickness of dried layer would be 15 microns. Thus, a photosensitive member with two layers was prepared.

The resultant photosensitive member was installed in an copying machine (EP-50; made by Minolta Camera K.K.) and corona-charged by powe of −6 KV level to evaluate initial surface potential $V_0$ (V), half-reducing amount ($E_{\frac{1}{2}}$ (lux.sec)) and dark decreasing ratio of the initial surface potential ($DDR_1$).

EXAMPLE 74–76

Photosensitive members were prepared in a manner similar to Example 73 except that the styryl compound [V-3] and the amino compound [I-43] used in Example 73 were incorporated at the content in Table 4.

TABLE 4

| | distyryl compound [V-3] (parts) | amino compound [I-43] (parts) |
|---|---|---|
| Example 74 | 6 | 4 |
| Example 75 | 4 | 6 |
| Example 76 | 2 | 2 |

$V_0$, $E_{\frac{1}{2}}$ and $DDR_1$ were evaluated on the obtained photosensitive members in a manner similar to Example 73.

EXAMPLE 77

Metal-free phthalocyanine of tau-type (1 part), polyvinylbutyral resin (S-Lec BM-1; made by Sekisui Kagaku Kogyo K.K.) of 2 parts and tetrahydrofuran of 100 parts were placed in Ball mill pot to be dispersed for 24 hours. Thus, a photosensitive coating solution was obtained.

The coating solution was applied onto an aluminium substrate to form a charge generating layer so that the thickness of dried layer would be 0.4 microns.

A solution containing of the distyryl compound V-4] of 3 parts, the amino compound [I-47] of 8 parts and polycarbonate resin (Panlite L-1250; made by Teijin Kasei K.K.) of 10 parts dissolved in tetrahydrofuran of 180 parts was applied onto the charge generating layer to form a charge transporting layer so that the thickness of dried layer would be 15 microns. Thus, a photosensitive member with two layers was prepared.

$V_0$, $E_{\frac{1}{2}}$ and $DDR_1$ were evaluated on the obtained photosensitive members in a manner similar to Example 73.

EXAMPLE 78

Photosensitive member was prepared in a manner similar to Example 77 except that the styryl compound [V-8] was used instead of the styryl compound [V-4] used in Example 77.

$V_0$, $E_{\frac{1}{2}}$ and $DDR_1$ were evaluated on the obtained photosensitive members in a manner similar to Example 73.

EXAMPLE 79

Titanyl phthalocyanine (1 part), polyester resin (Vylon 200; made by Teijin Kasei K.K.) of 1 part and cyclohexanone of 100 parts were placed in Ball mill pot to be dispersed for 24 hours. Thus, a photosensitive coating solution was obtained.

The coating solution was applied onto an aluminium substrate to form a charge generating layer so that the thickness of dried layer would be 0.2 microns.

A solution containing the distyryl compound [V-20] of 5 parts, the amino compound [I-65] of 5 parts and polycarbonate resin (Panlite K-1300; made by Teijin Kasei K.K.) of 10 parts dissolved in tetrahydrofuran of 180 parts was applied onto the charge generating layer to form a charge transporting layer so that the thickness of dried layer would be 15 microns. Thus, a photosensitive member with two layers was prepared.

$V_0$, $E_{\frac{1}{2}}$ and $DDR_1$ were evaluated on the obtained photosensitive members in a manner similar to Example 73.

EXAMPLE 80

A charge generating layer composed of titanylphthalocyanine was formed by means of a deposition apparatus under conditions shown below;

| | |
|---|---|
| degree of vacuum: | $1 \times 10^{-5}$ or less |
| boat temperature: | 400–500 °C. |
| deposition time: | 5 minutes |
| layer thickness: | 500 Å |

Then, a solution containing the distyryl compound [V-23] of 6 parts, the amino compound [I-71] of 4 parts and polycarbonate resin (PC-Z; made by Mitsubishi Gas Kagaku K.K.) of 10 parts dissolved in tetrahydrofuran of 180 parts was applied onto the charge generating layer to form a charge transporting layer so that the thickness of dried layer would be 15 microns. Thus, a photosensitive member with two layers was prepared.

$V_0$, $E_{\frac{1}{2}}$ and $DDR_1$ were evaluated on the obtained photosensitive members in a manner similar to Example 73.

EXAMPLE 81

Metal-free phthalocyanine of X type (1 part), polyester resin (Vylon 200; made by Toyobo K.K.) of 1 part and cyclohexanone of 100 parts were placed in Ball mill pot to be dispersed for 24 hours. Thus, a photosensitive coating solution was obtained.

The coating solution was applied onto an aluminium substrate to form a charge generating layer so that the thickness of dried layer would be 0.2 microns.

A solution containing the distyryl compound [V-30] of 7 parts, the amino compound [I-91] of 3 parts and polyarylate resin (U-polymer U-100; made by Yunichica K.K.) of 10 parts dissolved in tetrahydrofuran of 180 parts was applied onto the charge generating layer to form a charge transporting layer so that the thickness of dried layer would be 15 microns. Thus, a photosensitive member with two layers was prepared.

The resultant photosensitive member was installed in an laser printer (NC-1; made by Minolta Camera K.K.) and corona-charged by power of −6 KV level to evaluate initial surface potential $V_0$ (V), half-reducing amount ($E_{\frac{1}{2}}$ (erg/cm$^2$) and dark decreasing ratio of the initial surface potential ($DDR_1$). $E_{\frac{1}{2}}$ means an exposure ammount required to reduce the initial potential to half the value. $DDR_1$ is a decreasing ratio of the initial surface potential after the photosensitve member was left for 1 second in the dark.

EXAMPLE 82

Metal-free phthalocyanine of X type (1 part), polystyrene resin (molecular weight of 40,000) of 2 parts and tetrahydrofuran of 100 parts were placed in Ball mill pot to be dispersed for 24 hours. Thus, a photosensitive coating solution was obtained.

The coating solution was applied onto an aluminium substrate to form a charge generating layer so that the thickness of dried layer would be 0.3 microns.

A solution containing the distyryl compound [V-37] of 8 parts, the amino compound [I-89] of 2 parts and polycarbonate resin (PC-Z; made by Mitsubishi Gas Kagaku K.K.) of 10 parts dissolved in tetrahydrofuran of 180 parts was applied onto the charge generating layer to form a charge transporting layer so that the thickness of dried layer would be 15 microns. Thus, a photosensitive member with two layers was prepared.

$V_0$, $E_{\frac{1}{2}}$ and $DDR_1$ were evaluated on the obtained photosensitive members in a manner similar to Example 81.

EXAMPLE 83

The bisazo compound used in Example 1 (1 part), polyester resin (Vylon 200; made by Toyobo K.K.) of 1 part and cyclohexanone of 100 parts were placed in Sand grinder to be dispersed for 24 hours. Thus, a photosensitive coating solution was obtained.

The coating solution was applied onto an aluminium substrate to form a charge generating layer so that the thickness of dried layer would be 0.3 microns.

A solution containing the distyryl compound [V-41] of 9 parts, the amino compound [I-79]of 1 parts and polycarbonate resin (Polycarbonate Z made by Mitsubishi Gas Kagaku K.K.) of 10 parts dissolved in tetrahydrofuran of 100 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive members in a manner similar to Example 73.

EXAMPLES 84-87

A photosensitive member was prepared in amanner similar to Exampple 83 except that the usage of the distyryl compound [V-41] and the usage of the amino compound [I-79] were changed as shown in Table 5.

TABLE 5

| | distyryl compound [V-41] (parts) | amino compound [I-79] (parts) |
|---|---|---|
| Example 84 | 7 | 3 |
| Example 85 | 5 | 5 |
| Example 86 | 3 | 7 |
| Example 87 | 1 | 9 |

$V_0$, $E_{\frac{1}{2}}$ and $DDR_1$ were evaluated on the obtained photosensitive members in a manner similar to Example 73.

COMPARATIVE EXAMPLE 11

A photosensitive member was prepared in a manner similar to Example 83 except that only the distyryl compound [V-41] of 10 parts was used.

$V_0$, $E_{\frac{1}{2}}$ and $DDR_1$ were evaluated on the obtained photosensitive members in a manner similar to Example 83.

The results of $V_0$, $E_{\frac{1}{2}}$ and $DDR_1$ with respect to the photosensitive members obtained Examples 73-87 and Comparative Example 11 were summarized in Table 6 below.

TABLE 6

| | $V_0$(V) | $E_{\frac{1}{2}}$ (lux. sec) | $DDR_1$(%) |
|---|---|---|---|
| Example 73 | −660 | 0.8 | 2.6 |
| Example 74 | −650 | 0.8 | 3.0 |
| Example 75 | −660 | 0.7 | 2.5 |
| Example 76 | −670 | 0.7 | 2.2 |
| Example 77 | −670 | 0.8 | 2.3 |
| Example 78 | −650 | 0.7 | 2.8 |
| Example 79 | −660 | 0.6 | 2.3 |
| Example 80 | −660 | 0.7 | 2.2 |
| Example 81 | −670 | 2.8(erg/cm$^2$) | 2.0 |
| Example 82 | −680 | 3.0(erg/cm$^2$) | 1.8 |
| Example 83 | −660 | 1.0 | 2.4 |
| Example 84 | −660 | 1.0 | 2.6 |
| Example 85 | −670 | 0.9 | 2.2 |
| Example 86 | −660 | 0.8 | 2.7 |
| Example 87 | −670 | 0.7 | 2.3 |
| Comp. Example 11 | −660 | 1.2 | 2.1 |

Figure 10:
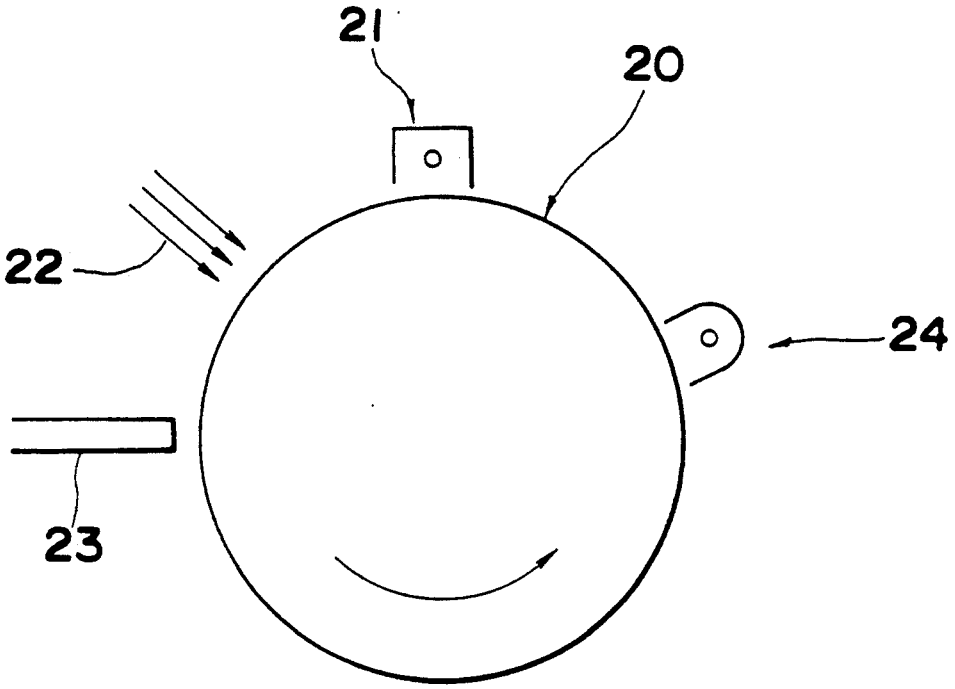
FIG. 10 is a schematic view of a tester for a photosensitive member.

Further, the photosensitive member obtained Examples 73-87 and Comparative Example 11 were installed in a tester for a photosensitive member (FIG. 10) the constitution of which is as same as that of a copying machine in order to evluate photosensitive properties.

The photosensitive member was attached to a drum for photosensitive member (20). The photosensitive member was electrically charged to about −500 V level. After 0.3 seconds, the surface potential ($V_0$) was measureed as an initial surface potential. After charged, the photosoensitive member was exposed to white light (22) gererated by a halogen lamp to measure surface potential (Vi). After exposed, the surface potential was erased by a light eraser (24) to measure a resudial potential (Vr). Each surface potential was measured by a probe (23).

Each potential was measured at initial stage and after 5,000 times repetition of the electrophotographic process to evaluate repetition stability.

The results are summarized in Table 7.

TABLE 7

| | initial stage | | | after 5000 times | | |
|---|---|---|---|---|---|---|
| | $V_0$(V) | Vi(V) | Vr(V) | $V'_0$(V) | V'i(V) | Vr'(V) |
| Ex. 73 | −500 | −75 | −5 | −480 | −65 | −5 |
| Ex. 74 | −510 | −75 | −5 | −490 | −70 | −5 |
| Ex. 75 | −510 | −70 | −5 | −490 | −70 | −5 |
| Ex. 76 | −510 | −70 | −5 | −500 | −70 | −10 |
| Ex. 77 | −510 | −75 | −5 | −510 | −75 | −10 |
| Ex. 78 | −510 | −70 | −5 | −510 | −80 | −20 |
| Ex. 83 | −510 | −90 | −5 | −460 | −65 | −5 |
| Ex. 84 | −510 | −85 | −5 | −480 | −70 | −5 |
| Ex. 85 | −510 | −80 | −5 | −495 | −80 | −5 |
| Ex. 86 | −515 | −75 | −5 | −510 | −75 | −10 |
| Ex. 87 | −515 | −70 | −5 | −515 | −85 | −15 |
| C. Ex. 11 | −500 | −100 | −10 | −435 | −110 | −10 |

EXAMPLE 88

The bisazo compound (0.45 parts) represented by the general formula [P] below:

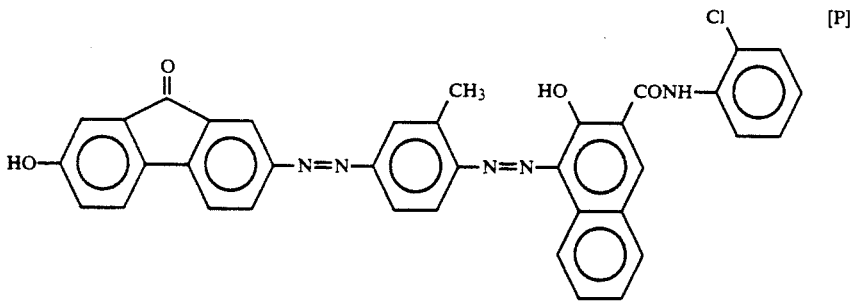

[P]

polybutyral resin (S-Lec BH-3;made by Sekisui Kagaku K.K.) of 0.45 parts and cyclohexanone of 50 parts were placed in Sand grinder for dispersion. The dispersion solution of the bisazo compound was applied onto aluminotype-Mylar of 100 micron thickness by film applicator to form a charge generating layer so that the thickness of dried layer would be 0.3 g/m$^2$.

A solution containing the amino compound [I-42] of 70 parts and polycarbonate resin (K-1300, made by Teijin Kasei K.K.) of 70 parts dissolved in 1,4-dioxane of 400 parts was applied onto the charge generating layer to form a charge transporting layer so that the thickness of dried layer would be 16 microns. Thus, a photosensitive member with two layers was prepared.

EXAMPLES 89-97

Photosensitive members were prepared in a manner similar to Example 88 except that the azo pigment represented by the general formula [VI] having such $R_{10}$, $R_{11}$ and Cp that shown in Table 8 were used and that the charge transporting materials shown in Table 8 were incorporated into charge transporting layers.

The number of Cp shown in Table 8 corresponds to the number of the chemical formula of Cp exemplified above.

TABLE 8

| | $R_{10}$ | $R_{11}$ | $Ar_6$ | Cp | CT |
|---|---|---|---|---|---|
| Example 89 | 7-OH | H | 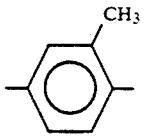 | 10 | I-43 |
| Example 90 | 7-OH | 6-Cl | 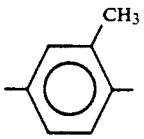 | 25 | I-65 |
| Example 91 | 7-OH | H | 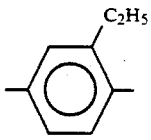 | 31 | I-71 |
| Example 92 | 7-OH | 6-Br | 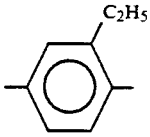 | 35 | I-78 |

TABLE 8-continued

| | $R_{10}$ | $R_{11}$ | $Ar_6$ | Cp | CT |
|---|---|---|---|---|---|
| Example 93 | 7-OH | H | 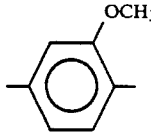 | 37 | I-86 |
| Example 94 | 7-OH | 3-Br | 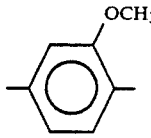 | 44 | I-103 |
| Example 95 | 7-OH | H | 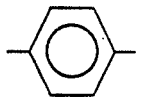 | 45 | I-112 |
| Example 96 | 7-OH | H | 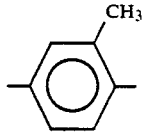 | 44 | I-128 |
| Example 97 | 7-OH | H | 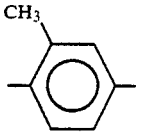 | 32 | I-132 |

The obtained photosensitive members were installed into a copying machine (EP-470Z; made by Minolta Camera K.K. ) to be electrically charged by power of −6 KV. $V_0$, $E_{\frac{1}{2}}$ and $DDR_1$ were evaluated. The results are shown in Table 9.

TABLE 9

| | $V_0$(V) | $E_{\frac{1}{2}}$ (lux. sec) | $DDR_1$(%) |
|---|---|---|---|
| Example 88 | −660 | 0.5 | 2.6 |
| Example 89 | −660 | 0.6 | 2.7 |
| Example 90 | −670 | 0.7 | 2.2 |
| Example 91 | −660 | 0.5 | 2.5 |
| Example 92 | −650 | 0.6 | 3.1 |
| Example 93 | −660 | 0.6 | 2.6 |
| Example 94 | −650 | 0.7 | 3.2 |
| Example 95 | −660 | 0.6 | 2.4 |
| Example 96 | −670 | 0.6 | 2.0 |
| Example 97 | −660 | 0.5 | 2.5 |

EXAMPLE 98

Photosensitive member was prepared in a manner similar to Example 31 except that the amino compound [I-5] was used instead of the amino compound [I-62]

used in Example 31 and that the polycarbonate resin [VII-1] (in which m and n are about 40) was used instead of the polycarbonate reisn used in Example 31.

$V_0$, $E_{\frac{1}{2}}$ and $DDR_1$ were evaluated on the obtained photosensitive members in a manner similar to Example 1 except that a copying machine EP-470Z (made by Minolta Camera K.K.) was used instead of EP-450Z.

Further, the photosensitive member of Example 98 and the photosensitive members obtained in Examples 99 and 125, which are described hereinafter, were installed in a copying machine (EP-5400; made by Minolta Camera K.K.) to be subjected to repetition test under negatively charged conditions.

After 10,000 times of copy, $V_0$, $E_{\frac{1}{2}}$ $V_R(V)$ and worn amount ($\mu$m) were measured and photosensitive properties were evaluated totally. The results are summarized in Table 11. In the evaluation of total photosensitive properties in Table 11.

In the photosensitive members obtained in Examples 98, 99 and 125, clear copied images exellent in gradation were formed both at initial stage and final stage of the test and the sensitivity was stable. Accordingly, it is understood that the photosensitive members of the present invention are also excellent in repetion properties.

EXAMPLES 99–102

Four kinds of Photosensitive members were prepared in a manner similar to Example 98 except that the amino compounds [I-8], [I-10], [I-41] and [I-42] were used respectively instead of the amino compound [I-5].

$V_0$, $E_{\frac{1}{2}}$ and $DDR_1$ were evaluated on the obtained photosensitive members in a manner similar to Example 98.

EXAMPLE 103

The bisazo compound (0.45 parts) represented by the general formula [Q] below:

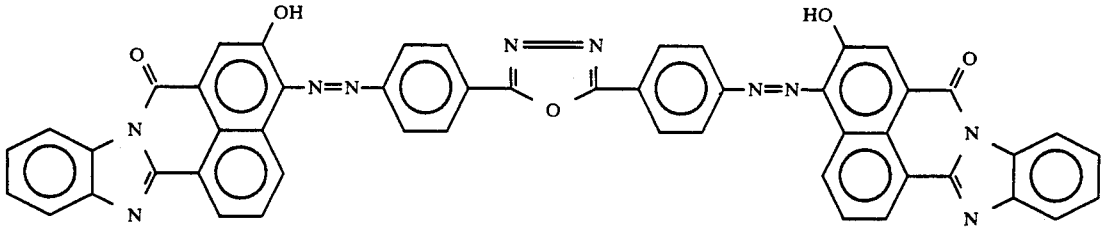

[Q]

polybutyral resin of 0.45 parts and cyclohexanone of 50 parts were placed in Sand grinder for dispersion. The dispersion solution of the bisazo compound was applied onto aluminotype-Mylar of 100 micron thickness by film applicator to form a charge generating layer so that the thickness of dried layer would be 0.3 g/m$^2$.

A solution containing-the amino-compound [I-43] of 40 parts and the polycarbonate resin represented by the chemical formula [VII-4] (in which n is about 50 and m is about 100) of 60 parts dissolved in 1,4-dioxane of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ *and* $DDR_1$ were evaluated on the obtained photosensitive member in a manner similar to Example 98. The results are shown in Table 10.

EXAMPLES 104–107

Photosensitive members were prepared in a manner similar to Example 103 except that the amino compounds [I-48], [I-47], [I-54] and [I-52] were used respectively instead of the amino compound [I-43].

$V_0$, $E_{\frac{1}{2}}$ and $DDR_1$ were evaluated on the obtained photosensitive members in a manner similar to Example 98. The results are shown in Table 10.

EXAMPLE 108

Metal-free phthalocyanine of tau type of 1 part, polyvinylbutyral resin of 0.5 parts and tetrahydrofuran of 50 parts were placed in Sand grinder for dispersion. The dispersion solution of the phthalocyanine compound was applied onto aluminotype-Mylar of 100 micron thickness by film applicator to form a charge generating layer so that the thickness of dried layer would be 0.2 g/m$^2$.

A solution containing the amino compound [I-65] of 40 parts and the polycarbonate resin represented by the chemical formula [VII-10] (in which n is zero and m is about 100) of 60 parts dissolved in dichloroethane of 500 parts was applied onto the charge generating layer to form a charge transporting layer so that the thickness of dried layer would be 25 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLES 109–112

Photosensitive members were prepared in a manner similar to Example 108 except that the amino compounds [I-68], [I-70], [I-71] and [I-76] were used respectively instead of the amino compound [I-65].

$V_0$, $E_{\frac{1}{2}}$ and $DDR_1$ were evaluated on the obtained photosensitive members in a manner similar to Example 98. The results are shown in Table 10.

EXAMPLE 113

Titanylphthalocyanine pigment of 0.5 parts, phenoxy resin of 0.2 parts, polyvinylbutyral resin of 0.3 parts and cyclohexanone of 50 parts were placed in Sand grinder for dispersion. The dispersion solution of the titanylphthalocyanine pigment was applied onto aluminotype-Mylar of 100 micron thickness by film applicator to form a charge generating layer so that the thickness of dried layer would be 0.25 g/m$^2$.

A solution containing the amino compound [I-78] of 70 parts and the polycarbonate resin represented by the chemical formula [VII-13] (in which n is zero, m is about 100 and molecular weight is about 24,000) of 25 parts dissolved in mixed solvent of 1,4-dioxane of 400 parts and cyclohexanone of 100 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLES 114–117

Photosensitive members were prepared in a manner similar to Example 113 except that the amino compounds [I-79], [I-85], [I-88] and [I-89] were used respectively instead of the amino compound [I-78].

$V_0$, $E_{\frac{1}{2}}$ and $DDR_1$ were evaluated on the obtained photosensitive members in a manner similar to Example 98. The results are shown in Table 10.

EXAMPLES 118

Dibromoanthanthrone of 0.5 parts, polyvinylbutyral resin of 0.5 parts and cyclohexanone of 50 parts were placed in Sand grinder for dispersion. The dispersion solution was applied onto aluminotype-Mylar of 100 micron thickness by film applicator to form a charge generating layer so that the thickness of dried layer would be 0.8 g/m$^2$.

A solution containing the amino compound [I-90] of 40 parts, the polycarbonate resin represented by the chemical formula [VII-8] (in which the ratio of n:m is one and molecular weight is about 20,000) of 20 parts and the polycarbonate resin represented by the chemical formula [VII-1] (in which the ratio of n:m is one and molecular weight is about 40,000) of 50 parts dissolved in tetrahydrofuran of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLES 119–122

Photosensitive members were prepared in a manner similar to Example 118 except that the amino compounds [I-91], [I-97], [I-101] and [I-103] were used respectively instead of the amino compound [I-90].

$V_0$, $E_{\frac{1}{2}}$ and $DDR_1$ were evaluated on the obtained photosensitive members in a manner similar to Example 98. The results are shown in Table 10.

EXAMPLE 123

A charge generating layer was prepared in a manner simmilar to Example 98.

A solution containing the amino compound [I-108] of 30 parts, the polycarbonate resin represented by the chemical formula [VII-13] (in which n is zero and molecular weight is about 40,000) of 50 parts and poly(-methyl methacrylate) (BR-85; made by Mitsubishi raiyon K.K.) of 20 parts dissolved in tetrahydrofuran of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLE 124

A charge generating layer was prepared in a manner simmilar to Example 98.

A solution containing the amino compound [I-41] of 40 parts and the polycarbonate resin represented by the chemical formula [VII-1] (in which the ratio of n:m is 1:1 and molecular weight is about 40,000) of 60 parts and polyester resin (Vylon 200; made by Toyobo K.K.) of 10 parts dissolved in tetrahydrofuran of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLE 125

A charge generating layer was prepared in a manner simmilar to Example 98.

A solution containing the amino compound [I-43] of 50 parts and polycarbonate resin represented by the chemical formula [VIII-1] (in which the ratio of p:q is 1:1 and molecular weight is about 26,000) of 70 parts dissolved in tetrahydrofuran of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLE 126

A charge generating layer was prepared in a manner simmilar to Example 98.

A solution containing the amino compound [I-47] of 50 parts and the polycarbonate resin represented by the chemical formula [VIII-3] (in which the ratio of p:q is 1:1 and molecular weight is about 36,000) of 70 parts dissolved in tetrahydrofuran of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLE 127

A charge generating layer was prepared in a manner simmilar to Example 98.

A solution containing the amino compound [I-5] of 20 parts, the amino compound [I-43] of 20 parts and the polycarbonate resin represented by the chemical formula [VIII-4] (in which the ratio of p:q is 2:3 and molecular weight is about 35,000) of 70 parts dissolved in tetrahydrofuran of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

EXAMPLE 128

A charge generating layer was prepared in a manner simmilar to Example 98.

A solution containing the amino compound [I-43] of 40 parts, the polycarbonate resin represented by the chemical formula [VII-2] (in which n is zero and molecular weight is about 25,000) of 30 parts and the polycarbonate resin represented by the chemical formula [VIII-8] (in which p is zero and and molecular weight is about 40,000) of 30 parts dissolved in dichloroethane of 500 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example 98. The results are shown in Table 10.

TABLE 10

| | $V_0$(V) | $E_{\frac{1}{2}}$ (lux. sec) | $DDR_1$(%) |
|---|---|---|---|
| Example 98 | −650 | 1.0 | 3.1 |
| Example 99 | −650 | 1.2 | 3.0 |
| Example 100 | −660 | 0.9 | 2.6 |
| Example 101 | −650 | 0.8 | 2.8 |
| Example 102 | −650 | 0.8 | 3.0 |
| Example 103 | −660 | 0.7 | 3.7 |
| Example 104 | −650 | 0.7 | 3.1 |
| Example 105 | −640 | 0.7 | 3.3 |
| Example 106 | −650 | 0.8 | 2.9 |
| Example 107 | −660 | 0.7 | 2.5 |
| Example 108 | −650 | 1.1 | 2.8 |
| Example 109 | −650 | 1.2 | 3.1 |
| Example 110 | −640 | 0.9 | 3.4 |
| Example 111 | −650 | 0.8 | 2.9 |
| Example 112 | −650 | 0.8 | 3.0 |
| Example 113 | −660 | 0.7 | 2.5 |
| Example 114 | −650 | 0.7 | 2.9 |
| Example 115 | −650 | 0.6 | 3.1 |
| Example 116 | −660 | 0.7 | 2.4 |
| Example 117 | −640 | 0.7 | 3.3 |
| Example 118 | −660 | 1.2 | 2.3 |
| Example 119 | −650 | 1.5 | 2.9 |
| Example 120 | −640 | 1.0 | 3.3 |
| Example 121 | −660 | 1.4 | 2.6 |
| Example 122 | −650 | 1.2 | 3.0 |
| Example 123 | −660 | 0.9 | 2.5 |
| Example 124 | −660 | 0.8 | 2.4 |
| Example 125 | −650 | 0.7 | 2.1 |
| Example 126 | −650 | 0.7 | 2.8 |
| Example 127 | −650 | 0.8 | 2.9 |
| Example 128 | −640 | 0.7 | 3.5 |

TABLE 11

| | initial stage | | | after 10000 times | | | image pro- | worn |
|---|---|---|---|---|---|---|---|---|
| | $V_0$ | $E_{\frac{1}{2}}$ | $V_R$ | $V_0$ | $E_{\frac{1}{2}}$ | $V_R$ | perties | amount |
| Ex. 98 | −650 | 1.0 | 5 | −640 | 1.1 | 5 | exellent | 0.1 |
| Ex. 99 | −650 | 1.2 | 5 | −650 | 1.3 | 20 | exellent | 0.2 |
| Ex. 125 | −650 | 0.7 | 0 | −650 | 0.7 | 10 | exellent | 0.1 |

EXAMPLE 129

An aluminium drum (outer diameter:80 mm, length:350 mm) was used as an electrically substrate.

The bisazo compound (0.45 parts) represented by the general formula [R] below:

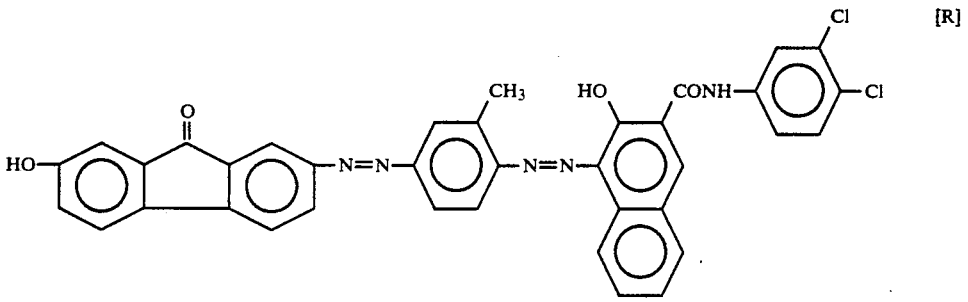

poly(vinylbutyral) resin (BX-1; made by Sekisui Kagaku K.K.) of 0.45 parts and cyclohexanone of 50 parts were placed in Sand mill for dispersion. The dispersion solution of the bisazo compound was applied onto the aluminium drum to form a charge generating layer so that the thickness of dried layer would be 0.3 g/m$^2$.

A solution containing the amino compound [I-43] of 50 parts, polycarbonate resin (Panlite K-1300, made by Teijin Kasei K.K.) of 50 parts, the hindered phenol compound [54] of 5 parts and the electron attracting compound represented by the following formula:

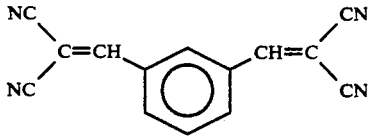

of 1 part and fluorosilicone oil (X-22-8-19; made by Shinetsu Kagaku K.K.) of 0.05 parts dissolved in dicholiromethane of 400 parts was applied onto the charge generating layer to form a charge transporting layer so that the thickness of dried layer would be 20 microns. Thus, a photosensitive member with two layers was prepared.

EXAMPLE 130–133

Photosensitive members were prepared in a manner similar to Example 129 except that 2.5 parts, 7.5 parts, 10 parts and 15 parts of the hindered phenol compound [54] were used respectively.

EXAMPLE 134

The dispersiton solution of the bisazo pigment used in Example 1 was applied onto the aluminium drum used in Example 129 to form a charge generating layer so that the thickness of dried layer would be 0.3 g/m$^2$.

A solution containing the amino compound [I-47] of 50 parts, polycarbonate resin (Panlite K-1300, made by Teijin Kasei K.K.) of 50 parts, the hindered phenol compound [64] of 5 parts, benzyldiphenyl of 10 parts, malononitrile compound (the electron attracting compound used in Example 129) of 1 part and fluorosilicone oil (FL-100; made by Shinetsu Kagaku K.K.) of 0.1 parts dissolved in tetrahydrofuran of 400 parts was applied onto the charge generating layer to form a charge transporting layer so that the thickness of dried layer would be 20 microns. Thus, a photosensitive member with two layers was prepared.

EXAMPLES 135–138

Photosensitive members were prepared in a manner similar to Example 134 except that amino compounds, hindered phenol compounds, usage of the benzyldiphenyl and usage of silicone oil were selected as shown in Table 12.

TABLE 12

| | diamino compound | hindered phenol (usage) | usage of benzyl-diphenyl | usage of silicone oil |
|---|---|---|---|---|
| Example 135 | [I-45] | [68] 2.5 | 12.5 | 0.02 |
| Example 136 | [I-65] | [72] 10 | 2.5 | 0.05 |
| Example 137 | [I-71] | [79] 12.5 | 5 | 0.1 |
| Example 138 | [I-89] | [90] 7.5 | 7.5 | 0.2 |

EXAMPLE 139

An aluminium drum (outer diameter:80 mm, length:350 mm) was used as an electrically substrate.

Metal free phthlocyanine of tau type (0.45 parts), butyral resin (BH-3; made by Sekisui Kagaku K.K.) of 0.45 parts and dichloroethane of 50 parts were placed in Sand mill for dispersion. The dispersion solution of the phthalocyanine pigment was applied onto the aluminium drum to form a charge generating layer so that the thickness of dried layer would be 0.2 g/m$^2$.

A solution containing the amino compound [I-91] of 50 parts, polycarbonate resin (PC-Z; made by Mitsubishi Gas Kagaku K.K.) of 50 parts, the hindered amino compound [103] of 7.5 parts, o-terphenyl of 4 parts, malononitrile compound (the electron attracting compound used in Example 129) of 0.6 parts and dimethylsilicone oil (KF-69;made by Shinetsu Kagaku K.K.) of 0.03 parts dissolved in dicholiroethane of 400 parts was applied onto the charge generating layer to form a charge transporting layer so that the thickness of dried layer would be 25 microns. Thus, a photosensitive member with two layers was prepared.

EXAMPLE 140–143

Photosensitive members were prepared in a manner similar to Example 139 except that amino compounds, hindered amino compounds, usage of the silicone oil and usage of o-terphenyl were selected as shown in Table 13.

TABLE 13

| | diamino compound | hindered amine (usage) | silicone oil (usage) | usage of o-ter-phenyl |
|---|---|---|---|---|
| Example 140 | [I-41] | [105] 12.5 | KF99*1) 0.05 | 2.5 |
| Example 141 | [I-48] | [107] 10 | KF54*2) 0.1 | 5 |
| Example 142 | [I-65] | [108] 7.5 | KF410*3) 0.05 | 7.5 |
| Example 143 | [I-97] | [112] 5 | KF995*4) 0.1 | 10 |

*1)methyl hydrogen silicone oil
*2)alpha-phenyl silicone oil
*3)alpha-methylstyrene-modified silicone oil
*4)polyether-modified silicone oil

EXAMPLES 144

Photosensitive member was prepared in a manner similar to Example 139 except that the hindered phenol [54] of 5 parts and the hindered amine [108] of 5 parts were used instead of the hindered amine [103] of 7.5 parts used in Example 139.

The photosensitive members obtained in Examples 129–144 were installed in a copying machine (EP-5400; made by Minolta camera K.K.) and corona-charged by power of −6 KV level to evaluate initial surface potential $V_0$(V), half-reducing amount ($E_{\frac{1}{2}}$ (lux.sec)) and dark decreasing ratio of the initial surface potential ($DDR_1$). The results are shown in Table 14.

Further, the copying process was repeated 5,000 times without developing machine installed to measure $V_0$, $E_{\frac{1}{2}}$ and $DDR_1$. At this time, the charging and the discharging from the trasferring chager were carried out under continuous conditions. The results are shown in Table 15.

TABLE 14

| | (at initial stage) $V_0$(V) | $E_{\frac{1}{2}}$ (lux. sec) | $DDR_1$(%) |
|---|---|---|---|
| Example 129 | −650 | 0.6 | 2.8 |
| Example 130 | −650 | 0.6 | 3.0 |
| Example 131 | −650 | 0.6 | 2.7 |
| Example 132 | −660 | 0.7 | 2.5 |
| Example 133 | −670 | 0.9 | 2.2 |
| Example 134 | −660 | 1.0 | 2.4 |
| Example 135 | −650 | 0.9 | 2.8 |
| Example 136 | −660 | 1.0 | 2.5 |
| Example 137 | −670 | 1.1 | 2.2 |
| Example 138 | −650 | 1.0 | 3.0 |
| Example 139 | −660 | 0.8 | 2.6 |
| Example 140 | −660 | 0.9 | 2.5 |
| Example 141 | −656 | 0.8 | 2.9 |
| Example 142 | −650 | 0.8 | 2.8 |
| Example 143 | −650 | 0.7 | 2.7 |
| Example 144 | −660 | 1.0 | 2.3 |

TABLE 15

| | (after repeated 5000 times) $V_0$(V) | $E_{\frac{1}{2}}$ (lux. sec) | $DDR_1$(%) |
|---|---|---|---|
| Example 129 | −650 | 0.5 | 3.0 |
| Example 130 | −630 | 0.5 | 3.6 |
| Example 131 | −650 | 0.6 | 3.1 |
| Example 132 | −660 | 0.7 | 2.8 |
| Example 133 | −660 | 1.0 | 2.5 |
| Example 134 | −650 | 1.0 | 2.7 |
| Example 135 | −650 | 0.9 | 3.1 |
| Example 136 | −630 | 0.9 | 3.5 |
| Example 137 | −650 | 1.2 | 2.8 |
| Example 138 | −640 | 1.0 | 2.9 |
| Example 139 | −640 | 0.7 | 3.1 |
| Example 140 | −640 | 1.0 | 2.8 |
| Example 141 | −650 | 0.8 | 3.1 |
| Example 142 | −650 | 0.8 | 3.0 |
| Example 143 | −640 | 0.8 | 3.3 |
| Example 144 | −660 | 1.1 | 2.6 |

What is claimed is:

1. A photosensitive member having a photosensitive layer comprising an amino compound represented by the following general formula [I]:

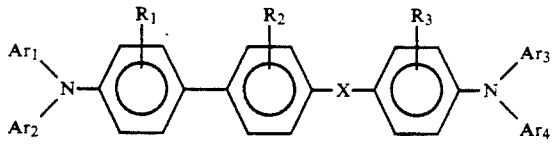

[I]

in which $Ar_1$, $Ar_2$, $Ar_3$, $Ar_4$ represent respectively an alkyl group, an aralkyl group, an aryl group, a biphenyl group or a heterocyclic group, each of which may have a substituent; $Ar_1$ and $Ar_2$, and/or $Ar_3$ and Ar4 may form a ring in combination; $R_1$, $R_2$ and $R_3$represent respectively a hydrogen atom, an alkyl group, an alkoxy group or a halogen atom; X represent —O—, —S—,

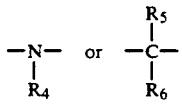

(in which $R_4$ represents an alkyl group, an aralkyl group, an aryl group, a biphenyl group or a heterocyclic group, each of which may have a substituent; $R_5$ and $R_6$ represent respectively a hydrogen atom, an alkyl group or an aryl group).

2. A photosensitive member of claim 1, in which the photosensitive layer comprises a charge generating material.

3. A photosensitive member of claim 1, in which the photosensitive layer has a thickness of 3–30 μm.

4. A photosensitive member of claim 3, in which the photosensitive layer contains the charge generating material at the content of 0.01 to 2 parts by weight on the basis of 1 part by weight of resin.

5. A photosensitive member of claim 4, in which the charge transporting layer contains the amino compound at the content of 0.2 to 2 parts by weight on the basis of 1 part by weight of a binder resin.

6. A photosensitive member of claim 1, in which the photosensitive layer comprises a charge generating layer and a charge transporting layer.

7. A photosensitive member of claim 6, in which the charge generating layer has a thickness of 4 μm or less.

8. A photosensitive member of claim 6, in which the charge transporting layer has a thickness of 3 to 30 μm.

9. A photosensitive member of claim 6, in which the charge transporting layer contains the amino compound represented by the general formula [I] and a binder resin and the charge generating layer contains a bisazo compound represented by the following general formula [VI] and a binder resin:

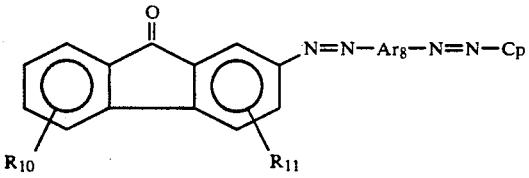

[VI]

in which $R_{10}$ and $R_{11}$ represent respectively a hydrogen atom, a halogen atom, a nitro group, a hydroxyl group, an alkyl group or an alkoxy group; $Ar_8$ represents an arylene group; Cp represents a residue of a coupler having a naphtholic OH group.

10. A photosensitive member of claim 9, in which the amino compound is contained in the charge transporting layer at the content of 0.2 to 2 parts by weight on the basis of 1 party by weight of the binder resin.

11. A photosensitive member of claim 9, in which the bisazo compound is contained in the charge generating layer at the content of 0.01 to 2 parts by weight on the basis of 1 part by weight of the resin.

12. A photosensitive member of claim 1, in which at least one of the $Ar_1$ to $Ar_4$ is a biphenyl group which may have a substituent.

13. A photosensitive member of claim 1, in which X is $—CH_2—$.

14. A photosensitive member of claim 1, in which X is —O—.

15. A photosensitive member of claim 1, in which X is —S—.

16. A photosensitive member of claim 1, in which X is

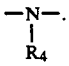

17. A photosensitive member of claim 1, in which X is

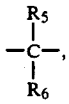

wherein $R_5$ and $R_6$ represent respectively an alkyl group or an aryl group.

18. A photosensitive member of claim 1, in which the photosensitive layer comprises a binder resin, a charge transporting material of the amino compound represented by the general formula [I] and a charge transporting material of a distyryl compound represented by the following general formula [V]:

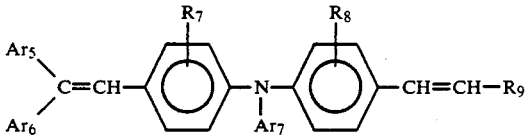

[V]

in which $Ar_5$ and $Ar_6$ represent respectively an alkyl group or an aryl group, each of which may have a substituent; $Ar_7$ represents an alkyl group, an aralkyl group or an aryl group, each of which may have a substituent; $R_7$ and $R_8$ represent respectively a hydrogen atom, an alkyl group, an alkoxy group or a halogen atom; $R_9$ represents a hydrogen atom, an alkyl group, an alkoxy group, an aralkyl group, an alkenyl group, an alkynyl group, a thioether group, an aryl group which may have a substituent or a heterocyclic group which may have a substituent.

19. A photosensitive member of claim 18, in which the photosensitive layer contains the charge transporting material at the content of 0.2 to 2 parts by weight on the basis of the 1 part by weight of the binder resin.

20. A photosensitive member of claim 18, in which the weight ratio of the amino compound to the distyryl compound is 5/95 to 95/5.

21. A photosensitive member of claim 1, in which the photosensitive layer further comprises a polycarbonate resin represented by the following general formula [VII] or [VIII];

[VII]

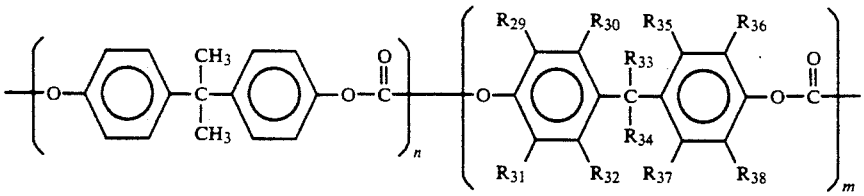

in which $R_{29}$, $R_{30}$, $R_{31}$, $R_{32}$, $R_{35}$, $R_{36}$, $R_{37}$ and $R_{38}$ represent respectively a hydrogen atom, an alkyl group, an aryl group, a halogen atom; when both $R_{33}$, $R_{34}$, are methyl groups, any of $R_{29}$, $R_{30}$, $R_{31}$, $R_{32}$, $R_{35}$, $R_{36}$, $R_{37}$ and $R_{38}$ is not a hydrogen atom; $R_{33}$ and $R_{34}$ represent respectively an alkyl group, a cycloalkyl group or an aryl group which may have a substituent; n is an integer of 0–100; m is an integer of 10–1000;

[VIII]

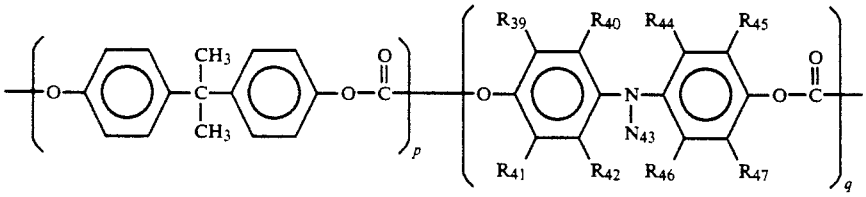

in which $R_{39}$, $R_{40}$, $R_{41}$, $R_{42}$, $R_{43}$, $R_{44}$, $R_{45}$, $R_{46}$ and $R_{47}$ represent respectively a hydrogen atom, an alkyl group, an aryl group which may have a substituent or a halogen atom; p is an integer of 0–100; q is an integer of 10–1000.

22. A photosensitive member of claim 21, in which the polycarbonate has a number average molecular weight of $1\times10^4$ to $1\times10^5$.

23. A photosensitive member of claim 1, in which the photosensitive layer comprises a binder resin, a charge generating material, the amino compound represented by the general formula [I] and at least one of the compounds selected from the group consisting of hindered phenol compounds represented by the following general formulas [IX] to [XI] and hindered amine compounds represented by the following general formula [XII];

[IX]

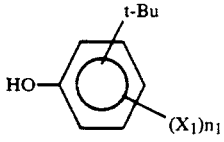

in which $X_1$ is an alkyl group, an alkoxy group, an aryl group, a heterocyclic group, each of which may have a substituent, a hydrogen atom, a hydroxy group; $n_1$ is an integer 0–4; when $n_1$ is two or more, $X_1$ may be the same or different;

[X]

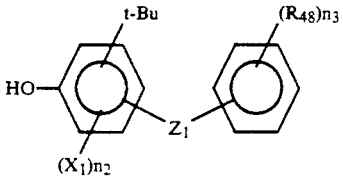

in which $X_1$ is the same as in the formula [IX]; $n_2$ is an integer of 0–3; when $n_2$ is two or more, $X_1$ may be the same or different; $R_{48}$ represents a hydrogen atom, a hydroxyl group, an alkyl group, an alkoxy group, a carbonyloxy group, an aralkyl group or a heterocyclic group; $n_3$ is an integer of 0–5; when $n_3$ is two or more, $R_{48}$ may be same or different; $Z_1$ represents —O—, —S—, —NH—, —$NR_{63}$—, —$CH_2$—, —$CHR_{64}$— (in which $R_{63}$ and $R_{64}$ represent respectively an alkyl group or an aryl group, each of which may have a substituent), an alkylene group, an arylene group, an aralkylene group, a bivalent residue of an alkane carboxylic acid or a bivalent residue of an alkyl ether;

[XI]

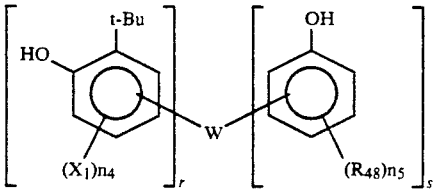

in which $X_1$ and $R_{48}$ ar the same as in the formula [VII]; $n_4$ is an integer of 0–3; $n_5$ is an integer of 0–4; when $n_4$ and $n_5$ is two or more respectively, $X_1$ or $R_{48}$ may be same or different; W represents a bivalent residue of an alkyl carboxylate, a bivalent residue of alkyl carboxylate, a bivalent residue of alkyl ether (or thioether), a bivalent residue of aryloxycarbonyl ester, a bivalent residue of heterocyclic ether, an aralkylene group, di(alkylcarbamoylalkyl), a bivalent residue of aryl carboxylate or a bivalent residue of hydrazide of carboxylic acid; r and s are respectively an integer of 1 or more and the sum of r and s is 2–4;

[XII]

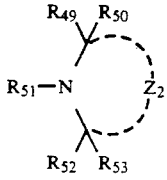

in which $R_{49}$, $R_{50}$, $R_{51}$, $R_{52}$ and $R_{53}$ represent respectively a hydrogen atom, an alkyl group or an aryl group; $Z_2$ is an atomic group necessary to form a cyclic ring containing a nitrogen atom; $R_{49}$ or $R_{50}$, and $R_{52}$ and $R_{53}$ may be included into $Z_2$ to form a double bond.

24. A photosensitive member of claim 23, in which the hindered phenol compounds or the hindered amine compounds are contained at a content of 1–30% by weight on the basis of the amino compound.

25. A photosensitive member of claim 23, in which the photosensitive layer contains a silicone oil represented by the following general formula [XIII];

$$(R_{60})_3SiO\left[(R_{61})_2SiO\right]_{n6}Si(R_{62})_3 \quad [XIII]$$

in which $R_{60}$, $R_{61}$ and $R_{62}$ represent respectively an alkyl group, an aryl group, a halogen-substituted alkyl group or a halogen-substituted aryl group; $n_6$ is an integer of 1 or more.

26. A photosensitive member of claim 1, in which the photosensitive layer comprising a binder resin, a charge generating material, the amino compound represented by the general formula [I] and an electron attracting compound represented by the following general formula [XIV];

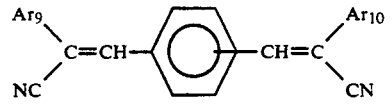

[XIV]

in which $Ar_9$ and $Ar_{10}$ represent respectively a cyano group, an aryl group which may have a substituent, an alkoxycarbonyl group, an acyl group, an aminocarbonyl group, a halogen atom, an alkyl group, a benzoyl group which may have a substituent.

27. A photosensitive member of claim 26, in which $Ar_9$ and $Ar_{10}$ are respectively a cyano group or an alkoxycarbonyl group.

28. A photosensitive member of claim 26, in which the electron attracting compound is contained at a content of 0.01–10% by weight on the basis of the amino compound.

* * * * *